US010072359B2

(12) United States Patent
Aso et al.

(10) Patent No.: US 10,072,359 B2
(45) Date of Patent: Sep. 11, 2018

(54) OIL AGENT FOR CARBON FIBER PRECURSOR ACRYLIC FIBER, OIL COMPOSITION FOR CARBON FIBER PRECURSOR ACRYLIC FIBER, PROCESSED-OIL SOLUTION FOR CARBON-FIBER PRECURSOR ACRYLIC FIBER, AND METHOD FOR PRODUCING CARBON-FIBER PRECURSOR ACRYLIC FIBER BUNDLE, AND CARBON-FIBER BUNDLE USING CARBON-FIBER PRECURSOR ACRYLIC FIBER BUNDLE

(75) Inventors: Hiromi Aso, Otake (JP); Masaaki Tsuchihashi, Wakayama (JP); Tetsuo Takano, Wakayama (JP)

(73) Assignee: Mitsubishi Chemical Corporation, Chiyoda-ku (JP)

( * ) Notice: Subject to any disclaimer, the term of this patent is extended or adjusted under 35 U.S.C. 154(b) by 1084 days.

(21) Appl. No.: 14/123,915

(22) PCT Filed: Jun. 6, 2012

(86) PCT No.: PCT/JP2012/064595

§ 371 (c)(1),
(2), (4) Date: Dec. 4, 2013

(87) PCT Pub. No.: WO2012/169551

PCT Pub. Date: Dec. 13, 2012

(65) Prior Publication Data

US 2014/0134094 A1 May 15, 2014

(30) Foreign Application Priority Data

| | | |
|---|---|---|
| Jun. 6, 2011 | (JP) | 2011-126008 |
| Jun. 6, 2011 | (JP) | 2011-126009 |
| Jun. 6, 2011 | (JP) | 2011-126010 |
| Jun. 6, 2011 | (JP) | 2011-126011 |
| Oct. 24, 2011 | (JP) | 2011-233008 |
| Oct. 24, 2011 | (JP) | 2011-233009 |
| Oct. 24, 2011 | (JP) | 2011-233010 |
| Oct. 24, 2011 | (JP) | 2011-233011 |
| Jun. 4, 2012 | (JP) | 2012-127586 |

(51) Int. Cl.

| | |
|---|---|
| ***D01F 9/22*** | (2006.01) |
| ***D01F 9/21*** | (2006.01) |
| ***D06M 13/224*** | (2006.01) |
| ***D06M 15/568*** | (2006.01) |
| ***D06M 13/425*** | (2006.01) |
| ***D06M 13/00*** | (2006.01) |
| ***D06M 15/643*** | (2006.01) |
| *D06M 101/28* | (2006.01) |

(52) U.S. Cl.

CPC ..... *D01F 9/21* (2013.01); *D01F 9/22* (2013.01); *D06M 7/00* (2013.01); *D06M 13/224* (2013.01); *D06M 13/425* (2013.01); *D06M 15/568* (2013.01); *D06M 15/6436* (2013.01); *D06M 2101/28* (2013.01)

(58) Field of Classification Search

CPC ..... D01F 9/21

See application file for complete search history.

(56) References Cited

U.S. PATENT DOCUMENTS

| | | | | |
|---|---|---|---|---|
| 2,258,591 | A | 10/1941 | Moser et al. | |
| 2,293,419 | A | 8/1942 | Van Ess | |
| 3,172,897 | A | 3/1965 | Rai et al. | |
| 4,009,248 | A | 2/1977 | Kishimoto et al. | |
| 4,293,305 | A | 10/1981 | Wilson | |
| 5,318,711 | A | 6/1994 | Evans et al. | |
| 5,780,400 | A | 7/1998 | MacNeil et al. | |
| 5,783,305 | A | 7/1998 | Masaki et al. | |
| 5,939,366 | A | 8/1999 | MacNeil et al. | |
| 6,228,282 | B1 * | 5/2001 | Shimomura | C09K 5/041 252/67 |
| 2002/0102382 | A1 | 8/2002 | Kwong et al. | |
| 2003/0065213 | A1 | 4/2003 | Zofchak | |
| 2009/0263576 | A1 | 10/2009 | Okabe et al. | |
| 2010/0247911 | A1 | 9/2010 | Aso et al. | |

(Continued)

FOREIGN PATENT DOCUMENTS

| | | | |
|---|---|---|---|
| CN | 101831119 | A | 9/2010 |
| EP | 0 790 337 | A1 | 8/1997 |
| GB | 586461 | A | 3/1947 |

(Continued)

OTHER PUBLICATIONS

Machine translation of JP-2010-174409A.*

Notice of Allowance dated Jun. 16, 2015 in Japanese Patent Application No. 2011-126010 (with English translation).

Extended European Search Report dated Nov. 12, 2014, in Patent Application No. 12796697.6.

Office Action dated Apr. 5, 2016 in Japanese Patent Application No. 2012-127586 (with English language translation).

International Search Report dated Aug. 28, 2012 in PCT/JP12/064595 Filed Jun. 6, 2012.

(Continued)

*Primary Examiner* — Larry Thrower

(74) *Attorney, Agent, or Firm* — Oblon, McClelland, Maier & Neustadt, L.L.P.

(57) ABSTRACT

The present invention relates to an oil agent for carbon-fiber precursor acrylic fiber, including at least one type of compound selected from groups of a hydroxybenzoate (Compound A), a cyclohexanedicarboxylic acid (Compound B and C), a cyclohexanedimethanol and/or a cyclohexanediol and a fatty acid (Compound D and E) and an isophorone-diisocyanate-aliphatic alcohol adduct (Compound F), an oil composition for carbon-fiber precursor acrylic fiber, a processed-oil solution for carbon-fiber precursor acrylic fiber, and a method for producing a carbon-fiber precursor acrylic fiber bundle, and a carbon-fiber bundle using the carbon-fiber precursor acrylic fiber bundle.

16 Claims, No Drawings

(56) References Cited

U.S. PATENT DOCUMENTS

2014/0134094 A1 5/2014 Aso et al.

FOREIGN PATENT DOCUMENTS

| | | | | |
|---|---|---|---|---|
| GB | 2 272 437 | A | | 5/1994 |
| JP | 51-70396 | | | 6/1976 |
| JP | 57-95373 | A | | 6/1982 |
| JP | 10-88481 | A | | 4/1998 |
| JP | 11-61646 | A | | 3/1999 |
| JP | 2000 199183 | | | 7/2000 |
| JP | 2001-3266 | A | | 1/2001 |
| JP | 2001-348783 | A | | 12/2001 |
| JP | 2002-226542 | A | | 8/2002 |
| JP | 2003 055881 | | | 2/2003 |
| JP | 2004 149937 | | | 5/2004 |
| JP | 2004-211240 | A | | 7/2004 |
| JP | 2004-292961 | A | | 10/2004 |
| JP | 2004-300630 | A | | 10/2004 |
| JP | 2005-519176 | A | | 6/2005 |
| JP | 2005 264361 | | | 9/2005 |
| JP | 2005 264384 | | | 9/2005 |
| JP | 2006-70375 | A | | 3/2006 |
| JP | 2006-97167 | A | | 4/2006 |
| JP | 2006-161170 | A | | 6/2006 |
| JP | 2006-306986 | A | | 11/2006 |
| JP | 2006-307352 | | | 11/2006 |
| JP | 2007-154337 | A | | 6/2007 |
| JP | 2007-332518 | A | | 12/2007 |
| JP | 2009-41135 | A | | 2/2009 |
| JP | 2010 024582 | | | 2/2010 |
| JP | 2010 053467 | | | 3/2010 |
| JP | 2010 174409 | | | 8/2010 |
| JP | 2010174409 | A | * | 8/2010 |
| JP | 2011 42916 | | | 3/2011 |
| JP | 2011-106045 | A | | 6/2011 |
| JP | 2011-208290 | A | | 10/2011 |
| JP | 2012-251266 | | | 12/2012 |
| JP | 2012-251267 | A | | 12/2012 |
| JP | 2012-251269 | | | 12/2012 |
| JP | 2013-91864 | A | | 5/2013 |
| JP | 2013-91865 | A | | 5/2013 |
| WO | WO 94/17162 | A1 | | 8/1994 |
| WO | 97 09474 | | | 3/1997 |
| WO | 2007 066517 | | | 6/2007 |
| WO | WO 2012/169551 | A1 | | 12/2012 |

OTHER PUBLICATIONS

Office Action dated Sep. 15, 2015 in Japanese Patent Application No. 2011-233009 (with English language translation).

Office Action dated Sep. 29, 2015 in Japanese Patent Application No. 2011-233008 (with English language translation).

Office Action dated Sep. 29, 2015 in Japanese Patent Application No. 2011-233010 (with English language translation).

Combined Taiwanese Office Action and Search Report dated Jan. 26, 2015 in Patent Application No. 101120254 (with English language translation).

Extended European Search Report dated Mar. 12, 2015 in Patent Application No. 12796697.6.

Notice of Allowance dated Apr. 1, 2015 in Japanese Patent Application No. 2011-126008 (with English language translation).

Notice of Allowance dated Apr. 1, 2015 in Japanese Patent Application No. 2011-126009 (with English language translation).

Notice of Allowance dated Apr. 1, 2015 in Japanese Patent Application No. 2011-126011 (with English language translation).

"Hexamoll Dinch (Technical Data Sheet)", BASF Petrochemicals, XP055016502, (Jan. 1, 2009), 2 pages, Retrieved from the Internet:URL:http://www2.basf.us/plasticizers/pdfs/products/TDS_DINCH.pdf [retrieved on Jan. 13, 2012].

* cited by examiner

OIL AGENT FOR CARBON FIBER PRECURSOR ACRYLIC FIBER, OIL COMPOSITION FOR CARBON FIBER PRECURSOR ACRYLIC FIBER, PROCESSED-OIL SOLUTION FOR CARBON-FIBER PRECURSOR ACRYLIC FIBER, AND METHOD FOR PRODUCING CARBON-FIBER PRECURSOR ACRYLIC FIBER BUNDLE, AND CARBON-FIBER BUNDLE USING CARBON-FIBER PRECURSOR ACRYLIC FIBER BUNDLE

TECHNICAL FIELD

The present invention relates to an oil agent for carbon-fiber precursor acrylic fiber, an oil agent composition for carbon-fiber precursor acrylic fiber, a processed-oil solution for carbon-fiber precursor acrylic fiber, and a method for producing a carbon-fiber precursor acrylic fiber bundle, and a carbon-fiber bundle using the carbon-fiber precursor acrylic fiber bundle.

The present application claims priority to the following applications and the entire contents of these applications are incorporated herein by reference:

Japanese Patent Application No. 2011-126008, filed Jun. 6, 2011;

Japanese Patent Application No. 2011-126009, filed Jun. 6, 2011;

Japanese Patent Application No. 2011-126010, filed Jun. 6, 2011;

Japanese Patent Application No. 2011-126011, filed Jun. 6, 2011;

Japanese Patent Application No. 2011-233008, filed Oct. 24, 2011;

Japanese Patent Application No. 2011-233009, filed Oct. 24, 2011;

Japanese Patent Application No. 2011-233010, filed Oct. 24, 2011;

Japanese Patent Application No. 2011-233011, filed Oct. 24, 2011; and

Japanese Patent Application No. 2012-127586, filed Jun. 4, 2012.

BACKGROUND ART

As a method for manufacturing carbon fiber bundles, a conventionally known method is as follows: converting a carbon-fiber precursor acrylic fiber bundle (hereinafter, may also be referred to as a "precursor fiber bundle") made of acrylic fiber or the like into a stabilized fiber bundle by heating the bundle at 200~400° C. under oxidizing atmosphere (stabilization process); and carbonizing the bundle at 1000° C. or higher under inert atmosphere (carbonization process). A carbon-fiber bundle manufactured using such a method has excellent mechanical characteristics and is put into wide industrial applications especially as reinforced fiber for composite materials.

However, during stabilization and the subsequent carbonization process (hereinafter, a stabilization process and a carbonization process may be combined and referred to as a "heating process") of such a method for manufacturing carbon-fiber bundles, problems may occur such as fuzzy fibers or yarn breakage because of single fibers fused during stabilization for converting a precursor fiber bundle to a stabilized fiber bundle. As a method for preventing single fibers from fusing, applying an oil agent composition on surfaces of precursor fiber bundles is known (oil treatment), and various oil agent compositions have been studied.

Generally used oil agent compositions are silicone-based oil agents whose main component is silicone, which is effective in preventing fusion among single fibers.

However, when silicone-based oil agents are heated, cross-linking reactions progresses to cause high viscosity, and such viscose material is likely to be deposited on surfaces of fiber transport rollers and guides used during a manufacturing process or during stabilization of precursor fiber bundles. Accordingly, the precursor fiber bundles or stabilized fiber bundles may become wound around or snagged onto transport rollers or guides and cause yarn breakage. As a result, operating efficiency may be lowered.

Moreover, during the heating process, a precursor fiber bundle with applied silicone-based oil agent is likely to produce silicon compounds such as silicon oxide, silicon carbide and silicon nitride, thus lowering industrial productivity and product quality.

In recent years, as an increase in demand for carbon fibers has led to a call for even larger production equipment and greater productivity, one of the issues to be solved is lowered industrial productivity caused by silicon compounds produced during the heating process such as those described above.

Accordingly, oil agent compositions that have reduced silicone content or do not contain silicone are proposed for reducing silicone content in oil-treated precursor fiber bundles. An example is an oil agent composition whose silicone content is lowered by adding 40~100 mass % of an emulsifier that contains a polycyclic aromatic compound at 50~100 mass % (see patent publication 1.)

Also proposed is such an oil agent composition containing silicone and a heat-resistant resin whereby the amount of remaining oil agent is 80 mass % or greater after being heated at 250° C. for 2 hours in air (see patent publication 2).

Other examples are an oil agent composition made of a bisphenol A aromatic compound and an amino-modified silicone (see patent publications 3 and 4), and an oil agent composition mainly containing a fatty acid ester of bisphenol A-alkylene oxide adduct (see patent publication 5).

Yet another example is an oil agent composition with a silicone content lowered by using an ester compound containing at least three ester groups in the molecule (see patent publication 6).

Moreover, by using a water-soluble amide and an ester compound containing at least three ester groups in the molecule, the silicone content is lowered while fusion of fibers is prevented and stable operating efficiency is achieved (see patent publication 7).

Further proposed is an oil agent composition containing at least 10 mass % of a compound having a reactive functional group without containing a silicone compound, or if a silicone compound is contained, its content is 2 mass % or lower in terms of silicon mass (see patent publication 8).

Yet further proposed is an oil agent composition which contains 0.2~20 wt. % of an acrylic polymer having an aminoalkylene group in the side chain, 60~90 wt. % of a specific ester compound and 10~40 wt. % of a surfactant (see patent publication 9).

PRIOR ART PUBLICATION

Patent Publication

Patent publication 1: Japanese Laid-Open Patent Publication 2005-264384

Patent publication 2: Japanese Laid-Open Patent Publication 2000-199183

Patent publication 3: Japanese Laid-Open Patent Publication 2003-55881

Patent publication 4: Japanese Laid-Open Patent Publication 2004-149937

Patent publication 5: International Publication WO1997/009474

Patent publication 6: International Publication WO2007/066517

Patent publication 7: Japanese Laid-Open Patent Publication 2010-24582

Patent publication 8: Japanese Laid-Open Patent Publication 2005-264361

Patent publication 9: Japanese Laid-Open Patent Publication 2010-53467

SUMMARY OF THE INVENTION

Problems to be Solved by the Invention

However, since the oil agent composition described in patent publication 1 has high emulsifier content, it achieves high emulsion stability, but the bundling property of a precursor fiber bundle with the applied oil agent composition tends to decline. Thus, it is not suitable for manufacturing fiber bundles at high productivity. Also, one problem is that carbon-fiber bundles with excellent mechanical characteristics are hard to obtain.

Also, since the oil agent composition described in patent publication 2 uses bisphenol A-based aromatic esters as a heat-resistant resin, it has markedly high heat resistance but does not sufficiently prevent fused single fibers. Moreover, a problem is that carbon-fiber bundles with excellent mechanical characteristics are hard to obtain with consistency.

In addition, in oil agent compositions described in patent publications 3~5, carbon-fiber bundles with excellent mechanical characteristics are hard to produce with consistency.

Furthermore, regarding the oil agent composition described in patent publication 6, using only an ester compound having at least three ester groups in the molecule is not sufficient to maintain bundling property during stabilization. Thus, the addition of a silicone compound is inevitable, even though it creates problems caused by a silicon compound generated during the heating process.

Regarding the oil agent composition described in patent publication 7 containing a soluble amide compound, consistent operations and product quality cannot be maintained in a system containing practically no silicone.

Regarding the oil agent composition described in patent publication 8, adhesion of the oil agent is enhanced by increasing the viscosity of the oil agent composition at 100~145° C. However, after the oil treatment on precursor fiber bundles, the high viscosity is likely to cause problems such as fiber bundles winding around fiber transport rollers in the spinning process.

In addition, regarding the oil agent composition described in patent publication 9, although fusion is prevented during stabilization in which substrates of single fibers are bonded, agglomeration is likely to occur because the oil component existing in single fibers works as an adhesive. Also, since such agglomeration prevents oxygen from being spread into fiber bundles during the stabilization process, stabilization treatment does not show a homogeneous result, thus problems such as fuzzy fiber or yarn breakage may occur in the subsequent carbonization process.

As described, using oil agent compositions containing a reduced silicone content or oil agent compositions made only of non-silicone components, fusion preventability and bundling property of oil-treated precursor fiber bundles, and mechanical characteristics of subsequent carbon-fiber bundles are lower than those when silicone-based oil agents are used. Accordingly, it was difficult to consistently obtain high quality carbon-fiber bundles.

On the other hand, when a silicone-based oil agent is used, other problems may arise because operating efficiency was lowered due to high viscosity, or industrial productivity was lowered due to silicon compounds generated as described above.

Namely, problems such as lowered operating efficiency and lowered productivity caused by using silicone-based oil agents are closely related to problems such as lowered fusion preventability, lowered bundling property of precursor fiber bundles, and lowered mechanical characteristics of carbon-fiber bundles, caused by using an oil agent composition made of reduced silicone content or containing only non-silicone components. Problems on both sides are unlikely to be solved using conventional technology.

The objective of the present invention is to provide an oil agent for carbon-fiber precursor acrylic fiber, an oil agent composition for carbon-fiber precursor acrylic fiber, and a processed-oil solution for carbon-fiber precursor acrylic fiber to prevent lowered operating efficiency and fusion among single fibers during production process of carbon-fiber bundles so that a carbon-fiber precursor acrylic fiber bundle with excellent bundling property and a carbon-fiber bundle with excellent mechanical characteristics are achieved at high yield.

Also, another objective of the present invention is to provide a carbon-fiber precursor acrylic fiber bundle which exhibits excellent bundling property and operating efficiency, and is capable of preventing fusion effectively among single fibers, and from which a carbon-fiber bundle with excellent mechanical characteristics is produced at high yield.

Solutions to the Problems

After intensive studies, the inventors of the present invention have found that using an oil agent containing at least two compounds selected from a group of non-silicone components A, B, C, D, E and F described below, problems derived from silicone-based oil agents and problems derived from oil agent compositions with a reduced silicone content or those containing only non-silicone components are both solved.

Accordingly, the present invention is completed.

Embodiments of the present invention are as follows:

<1> an oil agent for carbon-fiber precursor acrylic fiber containing at least one type of compound selected from the group of A, B, C, D, E and F below.

A: compound A obtained through reactions of a hydroxybenzoic acid and a monohydric aliphatic alcohol having 8~20 carbon atoms;

B: compound B obtained through reactions of a cyclohexanedicarboxylic acid and a monohydric aliphatic alcohol having 8~22 carbon atoms;

C: compound C obtained through reactions of a cyclohexanedicarboxylic acid, a monohydric aliphatic alcohol having 8~22 carbon atoms, a polyhydric alcohol having 2~10 carbon atoms and/or a polyoxyalkylene glycol with an oxyalkylene group having 2~4 carbon atoms;

D: compound D obtained through reactions of a cyclohexanedimethanol and/or cyclohexanediol, and a fatty acid having 8~22 carbon atoms;

E: compound E obtained through reactions of a cyclohexanedimethanol and/or cyclohexanediol, fatty acid have 8~22 carbon atoms and a dimer acid; and F: compound F obtained through reaction of 3-isocyanatomethyl-3,5,5-trimethylcyclohexyl=isocyanate and at least one type of compound selected from a group of monohydric aliphatic alcohols having 8~22 carbon atoms and their polyoxyalkylene ether compounds.

<2> The oil agent for carbon-fiber precursor acrylic fiber described in <1>, in which compound A is represented by formula (1a) below.

formula 1

(1a)

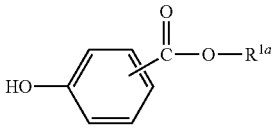

In formula (1a), $R^{1a}$ indicates a hydrocarbon group having 8~20 carbon atoms.

<3> The oil agent for carbon-fiber precursor acrylic fiber described in <1>, in which compound B is represented by formula (1b) below.

formula 2

(1b)

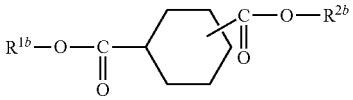

In formula (1b), $R^{1b}$ and $R^{2b}$ each independently indicate a hydrocarbon group having 8~22 carbon atoms.

<4> The oil agent for carbon-fiber precursor acrylic fiber described in <1>, in which compound C is represented by formula (2b) below.

formula 3

(2b)

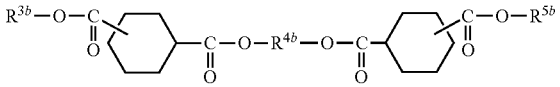

In formula (2b), $R^{3b}$ and $R^{5b}$ each independently indicate a hydrocarbon group having 8~22 carbon atoms, and $R^{4b}$ is a residue obtained by removing two hydroxyl groups from a hydrocarbon group having 2~10 carbon atoms or from a polyoxyalkyleneglycol with an oxyalkylene group having 2~4 carbon atoms.

<5> The oil agent for carbon-fiber precursor acrylic fiber described in <1>, in which compound D is represented by formula (1c) below.

formula 4

(1c)

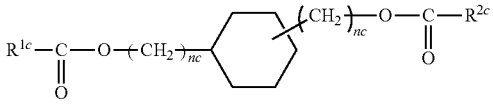

In formula (1c), $R^{1c}$ and $R^{2c}$ each independently indicate a hydrocarbon group having 7~21 carbon atoms, and "nc" independently represents 0 or 1.

<6> The oil agent for carbon-fiber precursor acrylic fiber described in <1>, in which compound E is represented by formula (2c) below.

formula 5

(2c)

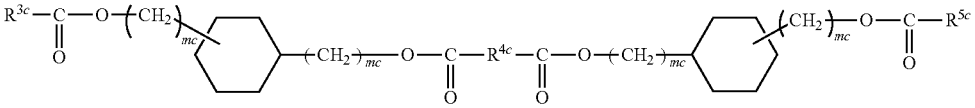

In formula (2c), $R^{3c}$ and $R^{5c}$ each independently indicate a hydrocarbon group having 7~21 carbon atoms, $R^{4c}$ indicates a hydrocarbon group having 30~38 carbon atoms, and "mc" independently represents 0 or 1.

<7> The oil agent for carbon-fiber precursor acrylic fiber described in <1>, in which compound F is represented by formula (1d) below.

formula 6

(1d)

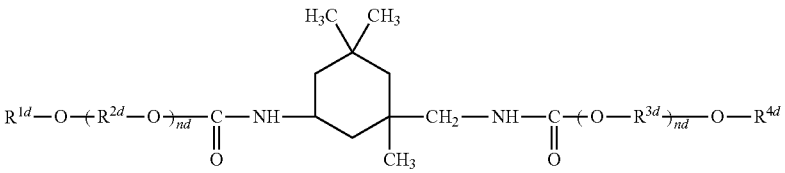

In formula (1d), $R^{1d}$ and $R^{4d}$ each independently indicate a hydrocarbon group having 8~22 carbon atoms, $R^{2d}$ and $R^{3d}$ each independently indicate a hydrocarbon group having 2~4 carbon atoms, and "nd" and "md" each independently mean the average number of added moles in numerals 0~5.

<8> The oil agent for carbon-fiber precursor acrylic fiber described in any of <1>~<7>, containing at least compound A and/or compound F.

<9> The oil agent for carbon-fiber precursor acrylic fiber described in any of <1>~<8>, further containing ester compound G containing 1 or 2 aromatic rings.

<10> The oil agent for carbon-fiber precursor acrylic fiber described in any of <1>~<8>, further containing amino modified silicone H.

<11> the oil agent for carbon-fiber precursor acrylic fiber described in <9>, in which ester compound G is ester compound G1 represented by formula (1e) below and/or ester compound G2 represented by formula (2e) below.

formula 7

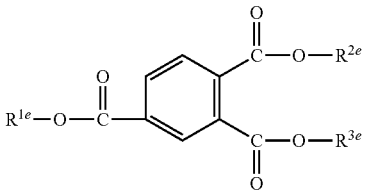

(1e)

In formula (1e), $R^{1e}$~$R^{3e}$ each independently indicate a hydrocarbon group having 8~16 carbon atoms.

formula 8

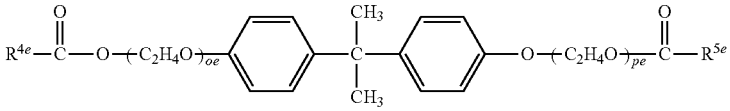

(2e)

In formula (2e), $R^{4e}$ and $R^{5e}$ each independently indicate a hydrocarbon group having 7~21 carbon atoms, and "oe" and "pe" each independently represent 1~5.

<12> The oil agent for carbon-fiber precursor acrylic fiber described in <10>, in which amino-modified silicone H is an amino-modified silicone represented by formula (3e) below, and whose kinetic viscosity at 25° C. is 50~500 $mm^2/s$, and whose amino equivalent is 2000~6000 g/mol.

formula 9

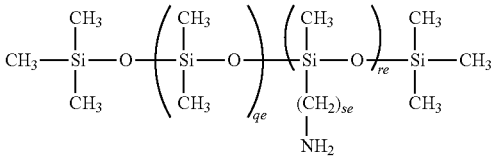

(3e)

In formula (3e), "qe" and "re" are any numeral greater than 1, and "se" is 1~5.

<13> An oil agent composition for carbon-fiber precursor acrylic fiber, containing the oil agent for carbon-fiber precursor acrylic fiber described in any of <1>~<12> along with a nonionic surfactant.

<14> The oil agent composition for carbon-fiber precursor acrylic fiber described in <13>, containing 20~150 parts by mass of the nonionic surfactant based on 100 parts by mass of the oil agent for carbon-fiber precursor acrylic fiber.

<15> The oil agent composition for carbon-fiber precursor acrylic fiber described in <13> or <14>, in which the nonionic surfactant is a polyether block copolymer represented by formula (4e) below and/or polyoxyethylene alkyl ether represented by formula (5e) below.

formula 10

$$R^{6e}-O-(C_2H_4O)_{xe}-(C_3H_6O)_{ye}-(C_2H_4O)_{ze}-R^{7e} \quad (4e)$$

In formula (4e), $R^{6e}$ and $R^{7e}$ each independently indicate a hydrogen atom or a hydrocarbon group having 1~24 carbon atoms, and "xe" "ye" and "ze" each independently represent 1~500.

formula 11

$$R^{8e}-O-(C_2H_4O)_{te}-H \quad (5e)$$

In formula (5e), $R^{8e}$ indicates a hydrocarbon group having 10~20 carbon atoms, and "te" represents 3~20.

<16> The oil agent composition for carbon-fiber precursor acrylic fiber described in any of <13>~<15>, containing 1~5 parts by mass of an antioxidant based on 100 parts by mass of the oil agent for carbon-fiber precursor acrylic fiber.

<17> A processed-oil solution for carbon-fiber precursor acrylic fiber, in which the oil agent composition for carbon-fiber precursor acrylic fiber described in any of <13>~<16> is dispersed in water.

<18> A carbon-fiber precursor acrylic fiber bundle to which the oil agent for carbon-fiber precursor acrylic fiber described in any of <1>~<12>, or the oil agent composition for carbon-fiber precursor acrylic fiber described in any of <13>~<16>, is adhered.

<19> A carbon-fiber precursor acrylic fiber bundle to which the oil agent for carbon-fiber precursor acrylic fiber described in any of <1>~<8> is adhered at 0.1~1.5 mass % of dry fiber mass.

<20> A carbon-fiber precursor acrylic fiber bundle to which the oil agent for carbon-fiber precursor acrylic fiber described in any of <1>~<8> is adhered at 0.1~1.5 mass % of dry fiber mass, and ester compound G having 1 or 2 aromatic rings or amino-modified silicone H is adhered at 0.01~1.2 mass % of dry fiber mass.

<21> The carbon-fiber precursor acrylic fiber bundle described in any of <18>~<20> to which a nonionic surfactant is further adhered at 0.05~1.0 mass % of dry fiber mass.

<22> The carbon-fiber precursor acrylic fiber bundle described in any of <18>~<21> to which an antioxidant is further adhered at 0.01~0.1 mass % of dry fiber mass.

<23> A method for manufacturing a carbon-fiber bundle, including heat treatment conducted on a carbon-fiber precursor acrylic fiber bundle described in any of <18>~<22> under 200~400° C. oxidizing atmosphere, followed by a heat treatment under 1000° C. or higher inert atmosphere.

Effects of the Invention

An oil agent for carbon-fiber precursor acrylic fiber, an oil agent composition for carbon-fiber precursor acrylic fiber and a processed-oil solution for carbon-fiber precursor acrylic fiber according to the present invention prevent lowered operating efficiency and fusion among single fibers during production process of carbon-fiber bundles so as to produce a carbon-fiber precursor acrylic fiber bundle with excellent bundling property and a carbon-fiber bundle with excellent mechanical characteristics at high yield.

Also, according to the present invention, a carbon-fiber precursor acrylic fiber bundle is provided, which exhibits excellent bundling propertye and operating efficiency while fusion among single fibers is effectively prevented. Such a carbon-fiber precursor acrylic fiber produces a carbon-fiber bundle with excellent mechanical characteristics at high yield.

MODE TO CARRY OUT THE INVENTION

The present invention is described in detail below.

<Oil Agent for Carbon-Fiber Precursor Acrylic Fiber>

The oil agent for carbon-fiber precursor acrylic fiber according to the present invention (hereinafter, may also be referred to simply as "oil agent") contains at least one type of compound selected from a group of A, B, C, D, E and F described below, which is applied onto a carbon-fiber precursor acrylic fiber bundle made of acrylic fiber prior to oil treatment. Here, "at least one type of compound" means that a compound is selected from one or more groups. Also, "at least two types of compounds" means compounds are selected from among two or more different groups. From one group, one compound may be selected, or two or more compounds may also be selected.

In the following, a carbon-fiber precursor acrylic fiber bundle prior to oil treatment is referred to as a "precursor fiber bundle."

(Group A)

Compound A included in group A is obtained through a condensation reaction of a hydroxybenzoic acid and a monohydric aliphatic alcohol having 8~20 carbon atoms (hereinafter, may also be referred to as "hydroxybenzoate").

Using a hydroxybenzoate, excellent heat resistance is shown during stabilization, excellent adhesion onto a precursor fiber bundle is achieved because of hydrogen bonds of the hydroxyl group, and smoothness coming from the alkyl chain is maintained between the fiber and transport rollers and bars so as to reduce damage on fiber bundles.

In addition, a hydroxybenzoate is stably dispersed in water through emulsification when a later-described nonionic surfactant is applied. Thus, it tends to be adhered homogeneously onto a precursor fiber bundle and is effective for producing a carbon-fiber precursor acrylic fiber bundle to obtain a carbon-fiber bundle with excellent mechanical characteristics.

As a hydroxybenzoic acid for raw material of hydroxybenzoates, 2-hydroxybenzoic acid (salicylic acid), 3-hydroxybenzoic acid, or 4-hydroxybenzoic acid may be used. From the viewpoints of heat resistance and smoothness between the fiber bundle and transport rollers or bars when applied onto a precursor fiber bundle, 4-hydroxybenzoic acid is preferred. In addition, the carboxyl group of a benzoic acid may be esters of a short-chain alcohol having 1~3 carbon atoms. Examples of short-chain alcohols having 1~3 carbon atoms are methanol, ethanol, n-propanol and isopropanol.

As alcohols for raw material of hydroxybenzoates, at least one type of alcohol selected among monohydric aliphatic alcohols is used.

The number of carbon atoms in monohydric aliphatic alcohols is 8~20. When there are eight or more carbon atoms, thermal stability of a hydroxybenzoate is maintained well, and excellent fusion preventability is obtained during stabilization. On the other hand, when the number of carbon atoms is 20 or fewer, the hydroxybenzoate does not become excessively viscous and is difficult to be solid. Accordingly, it is easier to prepare an emulsion of the oil agent composition containing the hydroxybenzoate as an oil agent, and such an oil agent homogeneously adheres to a precursor fiber bundle.

The number of carbon atoms in a monohydric aliphatic alcohol is preferred to be 11~20, more preferably 14~20.

Examples of monohydric aliphatic alcohols having 8~20 carbon atoms are: alkyl alcohols such as octanol, 2-ethylhexanol, nonanol, isononyl alcohol, decanol, isodecanol, isotridecanol, tetradecanol, hexadecanol, stearyl alcohol, isostearyl alcohol, and octyldodecanol; alkenyl alcohols such as octenyl alcohol, nonenyl alcohol, decenyl alcohol, 2-ethyldecenyl alcohol, undecenyl alcohol, dodecenyl alcohol, tetradecenyl alcohol, pentadecenyl alcohol, hexadecenyl alcohol, heptadecenyl alcohol, octadecenyl alcohol (oleyl alcohol), nonadecenyl alcohol, icocenyl alcohol; alkynyl alcohols such as octynyl alcohol, nonynyl alcohol, decynyl alcohol, undecynyl alcohol dodecynyl alcohol, tridecynyl alcohol, tetradecynyl alcohol, hexadecynyl alcohol, octadecynyl alcohol, nonadecynyl alcohol, and eicocynyl alcohol.

Especially, from the viewpoints of balancing ease of handling, processability and performance, octadecenyl alcohol (oleyl alcohol) is preferred since later-described processed-oil solutions are easier to prepare, problems seldom occur such as fibers winding around transport rollers when fibers are in contact with transport rollers in the spinning step, and desired heat resistance is achieved.

Such aliphatic alcohols may be used alone or in any combination thereof.

As for hydroxybenzoates, a compound with the structure represented by formula (1a) below is preferred.

formula 12

(1a)

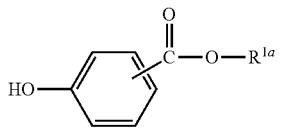

In formula (1a), $R^{1a}$ indicates a hydrocarbon group having 8~20 carbon atoms. When the number of carbon atoms in a hydrocarbon group is 8 or greater, thermal stability of the hydroxybenzoate is maintained well. Thus, excellent fusion preventability is achieved during stabilization. On the other hand, when the number of carbon atoms in a hydrocarbon group is less than 20, the hydroxybenzoate does not become excessively viscous, and it is unlikely to solidify. Accordingly, an emulsion of the oil agent composition containing the hydroxybenzoate as an oil agent is easier to prepare, and the oil agent homogeneously adheres onto a precursor fiber bundle. The number of carbon atoms in a hydrocarbon group is preferred to be 11~20.

The compound with the structure represented by above formula (1a) is a hydroxybenzoate obtained by condensation reactions of a hydroxybenzoic acid and a monohydric aliphatic alcohol having 8~20 carbon atoms.

Thus, $R^{1a}$ in formula (1a) is derived from a monohydric aliphatic alcohol having 8~20 carbon atoms. As for $R^{1a}$, it may be any of alkyl group, alkenyl group or alkynyl group having 8~20 carbon atoms, and it may be straight-chain or branch-chain. The number of carbon atoms in $R^{1a}$ is preferred to be 11~20, more preferably 14~20.

Examples of an alkyl group are n- and iso-octyl group, 2-ethylhexyl group, n- and iso-nonyl group, n- and iso-decyl group, n- and iso-undecyl group, n- and iso-dodecyl group, n- and iso-tridecyl group, n- and iso-tetradecyl group, n- and iso-hexadecyl group, n- and iso-heptadecyl group, octadecyl group, nonadecyl group, eicocyl group and the like.

Examples of an alkenyl group are octenyl group, nonenyl group, decenyl group, undecenyl group, dodecenyl group, tetradecenyl group, pentadecenyl group, hexadecenyl group, heptadecenyl group, octadecenyl group, nonadecenyl group, icocenyl group, and the like.

Examples of an alkynyl group are 1- and 2-octynyl group, 1- and 2-nonynyl group, 1- and 2-decynyl group, 1- and 2-undecynyl group, 1- and 2-dodecynyl group, 1- and 2-tridecynyl group, 1- and 2-tetradecynyl group, 1- and 2-hexadecynyl group, 1- and 2-octadecynyl group, 1- and 2-nonadecynyl group, 1- and 2-eicocynyl group, and the like.

A hydroxybenzoate is obtained by condensation reactions of a hydroxybenzoic acid and a monohydric aliphatic alcohol having 8~20 carbon atoms without a catalyst or in the presence of a well-known catalyst for esterification such as a tin compound and titanium compound. Condensation reactions are preferred to be conducted under inert gas atmosphere. Reaction temperature is preferred to be 160~250° C., more preferably 180~230° C.

The molar ratio of a hydroxybenzoic acid and an alcohol component supplied for condensation reactions is preferred to be 0.9~4.3 mol, more preferably 1.0~1.2 mol, of a monohydric aliphatic alcohol having 8~20 carbon atoms to 1 mol of a hydroxybenzoic acid. When a catalyst for esterification is used, from the viewpoint of CF tensile strength, the catalyst is preferred to be deactivated after condensation reactions and removed using an adsorbant.

(Groups B and C)

Compound B included in group B is a compound obtained through condensation reactions of a cyclohexanedicarboxylic acid as a carboxylic acid component and a monohydric aliphatic alcohol having 8~22 carbon atoms as an alcohol component (hereinafter may also be referred to as "cyclohexanedicarboxylate B").

Compound C included in group C is a compound obtained through condensation reactions of a cyclohexanedicarboxylic acid as a carboxylic acid component and a monohydric aliphatic alcohol having 8~22 carbon atoms and a polyhydric alcohol having 2~10 carbon atoms and/or a polyoxyalkylene glycol with an oxyalkylene group having 2~4 carbon atoms as alcohol components (hereinafter, may also be referred to as "cyclohexanedicarboxylate C").

In the following, a "cyclohexanedicarboxylate" may be used as a general term for compound B or compound C.

Cyclohexanedicarboxylate has sufficient heat resistance for a stabilization process. Also, since it does not have an aromatic ring, it thermally decomposes well into low molecules during a carbonization process. Thus, it is likely to be exhausted from the system together with the circulating gas in the furnace, and unlikely to cause processing problems or lower quality.

In addition, a cyclohexanedicarboxylate is stably dispersed in water through emulsification when a later-described nonionic surfactant is applied. Thus, it tends to be adhered homogeneously to a precursor fiber bundle and is effective for producing a carbon-fiber precursor acrylic fiber bundle so as to obtain a carbon-fiber bundle with excellent mechanical characteristics.

As for cyclohexanedicarboxylic acid, 1,2-cyclohexanedicarboxylic acid, 1,3-cyclohexanedicarboxylic acid, or 1,4-cyclohexanedicarboxylic acid may be used. Among those, 1,4-cyclohexanedicarboxylic acid is preferred from the viewpoints of the ease of synthesizing and heat resistance.

Cyclohexanedicarboxylic acid may be an acid anhydride, or an ester with a short-chain alcohol having 1~3 carbon atoms. Examples of a short-chain alcohol having 1~3 carbon atoms are methanol, ethanol, and n- or isopropanol.

As examples of an alcohol to be used as a raw material for cyclohexanedicarboxylate, one or more alcohols are selected from among monohydric aliphatic alcohols, polyhydric alcohols and polyoxyalkylene glycols.

The number of carbon atoms in a monohydric aliphatic alcohol is 8~22. When the number of carbon atoms is 8 or greater, the thermal stability of a cyclohexanedicarboxylate is maintained well. Thus, sufficient fusion preventability becomes evident during stabilization. On the other hand, when the number of carbon atoms is 22 or less, the cyclohexanedicarboxylate does not become excessively viscous, and is unlikely to solidify. Accordingly, an emulsion of the oil agent composition containing the cyclohexanedicarboxylate as an oil agent is easier to prepare, and the oil agent homogeneously adheres to a precursor fiber bundle.

From the viewpoint above, the number of carbon atoms in a monohydric aliphatic alcohol is preferred to be 12~22, more preferably 15~22.

Examples of a monohydric aliphatic alcohol having 8~22 carbon atoms are alkyl alcohols such as octanol, 2-ethylhexanol, nonanol, decanol, undecanol, dodecanol, tridecanol, tetradecanol, hexadecanol, heptadecanol, octadenanol, nonadenanol, eicosanol, heneicosanol and docosanol; alkenyl alcohols such as octenyl alcohol, nonenyl alcohol, decenyl alcohol, undecenyl alcohol, dodecenyl alcohol, tetradecenyl alcohol, pentadecenyl alcohol, hexadecenyl alcohol, heptadecenyl alcohol, octadecenyl alcohol, nonadecenyl alcohol, icocenyl alcohol, henicocenyl alcohol, dococenyl alcohol, oleyl alcohol, gadoleyl alcohol, and 2-ethyldecenyl alcohol; alkynyl alcohols such as octynyl alcohol, nonynyl alcohol, decynyl alcohol, undecynyl alcohol, dodecynyl alcohol, tridecynyl alcohol, tetradecynyl alcohol, hexadecynyl alcohol, stearynyl alcohol, nonadecynyl alcohol, eicocynyl alcohol, henicocynyl alcohol, and dococynyl alcohol.

Especially, from the viewpoints of balancing ease of handling, processability and performance, oleyl alcohol is preferred since later-described processed-oil solutions are easier to prepare, problems seldom occur such as fibers winding around transport rollers when fibers are in contact with transport rollers in the spinning step, and desired heat resistance is achieved. Such aliphatic alcohols may be used alone or in any combination thereof.

The number of carbon atoms of a polyhydric alcohol is 2~10. When there are 2 or more carbon atoms, thermal stability of the cyclohexanedicarboxylate is maintained well, and sufficient fusion preventability becomes evident during stabilization. On the other hand, when the number of carbon atoms is 10 or fewer, the cyclohexanedicarboxylate does not become excessively viscous and is unlikely to solidify. Accordingly, it is easier to prepare an emulsion of oil agent composition containing the cyclohexanedicarboxylate as an oil agent, and such an oil agent homogeneously adheres to a precursor fiber bundle.

From the viewpoints above, the number of carbon atoms of a polyhydric alcohol is preferred to be 5~10, more preferably 5~8.

A polyhydric alcohol having 2~10 carbon atoms may be an aliphatic alcohol, aromatic alcohol, saturated or unsaturated alcohol.

Examples of a polyhydric alcohol are divalent alcohols such as ethylene glycol, 1,3-propanediol, 1,4-butanediol, 1,5-pentanediol, 1,6-hexanediol, 1,7-heptanediol, 1,8-octanediol, 1,9-nonandiol, 1,10-decandiol, 2-methyl-1,3-propanediol, 3-methyl-1,5-pentanediol, 1,5-hexanediol, 2-methyl-1,8-octanediol, neopentyl glycol, 2-isopropyl-1,4-butanediol, 2-ethyl-1,6-hexanediol, 2,4-dimethyl-1,5-pentanediol, 2,4-diethyl-1,5-pentanediol, 1,3-butanediol, 2-ethyl-1,3-hexanediol, 2-butyl-2-ethyl-1,3-propanediol, 1,3-cyclohexanediol, 1,4-cyclohexanediol, and 1,4-cyclohexanedimethanol; and trivalent alcohols such as trimethylolethane, trimethylolpropane, hexanetriol, and glycerin. Among those, divalent alcohols are preferred, since low-viscosity oil agent compositions are obtained and oil agents are adhered homogeneously onto precursor fiber bundles.

Polyoxyalkylene glycols have a repeating unit of an oxyalkylene group having 2~4 carbon atoms, along with two hydroxyl groups. Hydroxyl groups are preferred to be positioned at both terminals.

When there are two or more carbon atoms in the oxyalkylene group, thermal stability of the cyclohexanedicarboxylate is maintained well, and sufficient fusion preventability is evident during stabilization. On the other hand, when the number of carbon atoms of the oxyalkylene group is four or fewer, the cyclohexanedicarboxylate does not become excessively viscous and is unlikely to solidify. Accordingly, it is easier to prepare an emulsion of the oil agent composition containing the cyclohexanedicarboxylate as an oil agent, and such an oil agent homogeneously adheres to a precursor fiber bundle.

Examples of a polyoxyalkylene glycol are polyoxyethylene glycol, polyoxypropylene glycol, polyoxytetramethylene glycol, polyoxybutylene glycol and the like. The average moles of an oxyalkylene group is preferred to be 1~15, more preferably 1~10, even more preferably 2~8, from the viewpoints of achieving low viscosity of the oil agent composition and capability of adhering the oil agent homogeneously onto fiber.

It is an option to use both a polyhydric alcohol having 2~10 carbon atoms and a polyoxyalkylene glycol with an oxyalkylene group having 2~4 carbon atoms, or to use either one.

As for cyclohexanedicarboxylate B, a compound with the structure represented by formula (1b) below is preferred, and as for cyclohexanedicarboxylate C, a compound represented by formula (2b) below is preferred.

formula 13

(1b)

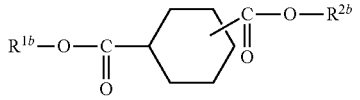

formula 14

(2b)

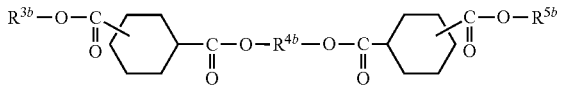

In formula (1b), $R^{1b}$ and $R^{2b}$ each independently indicate a hydrocarbon group having 8~22 carbon atoms. When the number of carbon atoms in the hydrocarbon group is eight or greater, thermal stability of cyclohexanedicarboxylate B is maintained well. Thus, sufficient fusion preventability is evident during stabilization. On the other hand, when the number of carbon atoms of the hydrocarbon group is 22 or fewer, cyclohexanedicarboxylate B does not become excessively viscous, and is unlikely to solidify. Accordingly, an emulsion of the oil agent composition containing cyclohexanedicarboxylate B as an oil agent is easier to prepare, thus a homogeneous result of such an oil agent adhered to a precursor fiber bundle is achieved. From such viewpoints, the number of carbon atoms of each hydrocarbon group is preferred to be 12~22, more preferably 15~22.

$R^{1b}$ and $R^{2b}$ may have the same structure, or may have different structures from each other.

A compound with the structure represented by formula (1b) is a cyclohexanedicarboxylate obtained through condensation reactions of a cyclohexanedicarboxylic acid and a monohydric aliphatic alcohol having 8~22 carbon atoms. Thus, $R^{1b}$ and $R^{2b}$ in formula (1b) are each derived from an aliphatic alcohol. $R^{1b}$ and $R^{2b}$ may be any of an alkyl group, alkenyl group or alkynyl group having 8~22 carbon atoms, and they may be straight-chain or branch-chain.

Examples of an alkyl group are n- and iso-octyl group, 2-ethylhexyl group, n- and iso-nonyl group, n- and iso-decyl group, n- and iso-undecyl group, n- and iso-dodecyl group, n- and iso-tridecyl group, n- and iso-tetradecyl group, n- and iso-hexadecyl group, n- and iso-heptadecyl group, octadecyl group, nonadecyl group, eicocyl group, heneicocyl group and dococyl group.

Examples of an alkenyl group are octenyl group, nonenyl group, decenyl group, undecenyl group, dodecenyl group, tetradecenyl group, pentadecenyl group, hexadecenyl group, heptadecenyl group, octadecenyl group, nonadecenyl group, icocenyl group, henicocenyl group, dococenyl group, oleyl group, gadoleyl group, and 2-ethyldecenyl group.

Examples of an alkynyl group are, 1- and 2-octynyl group, 1- and 2-nonynyl group, 1- and 2-decynyl group, 1- and 2-undecynyl group, 1- and 2-dodecynyl group, 1- and 2-tridecynyl group, 1- and 2-tetradecynyl group, 1- and 2-hexadecynyl group, 1- and 2-stearynyl group, 1- and 2-nonadecynyl group, and 1- and 2-eicocynyl group, 1- and 2-henicocynyl group, and 1-, and 2-dococynyl group.

A cyclohexanedicarboxylate B is obtained by condensation reactions of a cyclohexanedicarboxylic acid and a monohydric aliphatic alcohol having 8~22 carbon atoms without a catalyst or in the presence of a well-known catalyst for esterification such as a tin compound or titanium compound. Condensation reactions are preferred to be conducted under inert gas atmosphere.

Reaction temperature is preferred to be 160~250° C., more preferably 180~230° C.

The molar ratio of a carboxylic acid component and an alcohol component supplied for condensation reactions is preferred to be 1.8~2.2 mol, more preferably 1.9~2.1 mol, of a monohydric aliphatic alcohol having 8~22 carbon atoms to 1 mol of a cyclohexanedicarboxylic acid. When a catalyst for esterification is used, from the viewpoint of CF tensile strength, the catalyst is preferred to be deactivated after condensation reactions and removed using an adsorbant.

Meanwhile, in formula (2b), $R^{3b}$ and $R^{5b}$ each independently indicate a hydrocarbon group having 8~22 carbon atoms. $R^{4b}$ is a hydrocarbon group having 2~10 carbon atoms or a divalent residue obtained by removing two hydroxyl groups from a polyoxyalkylene glycol with an oxyalkylene group having 2~4 carbon atoms.

Regarding $R^{3b}$ and $R^{5b}$, when the number of carbon atoms of the hydrocarbon group is eight or greater, the thermal stability of cyclohexanedicarboxylate C is maintained well. Thus, sufficient fusion preventability is evident during stabilization. On the other hand, when the number of carbon atoms of the hydrocarbon group is 22 or fewer, cyclohexanedicarboxylate C does not become excessively viscous, and is unlikely to solidify. Accordingly, an emulsion of the oil agent composition containing the cyclohexanedicarboxylate C as an oil agent is easier to prepare, and the oil agent homogeneously adheres to a precursor fiber bundle. From such viewpoints, the number of carbon atoms in each hydrocarbon group in $R^{3b}$ and $R^{5b}$ is preferred to be 12~22, more preferably 15~22.

$R^{3b}$ and $R^{5b}$ may have the same structure or have independently different structures.

In addition, regarding $R^{4b}$, when the number of carbon atoms of a hydrocarbon group is at least two, or the number of carbon atoms in an oxyalkylene group is at least two, it will be esterified with a carboxylic acid adhered to a cyclohexane ring, thus cross-linking cyclohexane rings. Accordingly, high thermal stability is easier to achieve. On the other hand, when the number of carbon atoms of a hydrocarbon group is 10 or fewer, or the number of carbon atoms of an oxyalkylene group is four or fewer, cyclohexanedicarboxylate C does not become excessively viscous, and is unlikely to solidify. Accordingly, an emulsion of the oil agent composition containing the cyclohexanedicarboxylate C as an oil agent is easier to prepare, and the oil agent homogeneously adheres to a precursor fiber bundle.

When $R^{4b}$ is a hydrocarbon group, the number of carbon atoms is preferred to be 5~10, and when $R^{4b}$ is a residue obtained by removing two hydroxyl groups from a polyalkylene glycol, the number of carbon atoms of the oxyalkylene group is preferred to be four.

A compound with the structure represented by formula (2b) above is a cyclohexanedicarboxylate obtained through condensation reactions of a cyclohexanedicarboxylic acid, a monohydric aliphatic alcohol having 8~22 carbon atoms, and a polyhydric alcohol having 2~10 carbon atoms, or a cyclohexanedicarboxylate obtained through condensation reactions of a cyclohexanedicarboxylic acid, a monohydric aliphatic alcohol having 8~22 carbon atoms, and a polyoxyalkylene glycol with its oxyalkylene group having 2~4 carbon atoms. Thus, in formula (2b), $R^{3b}$ and $R^{5b}$ are derived from an aliphatic alcohol. As for $R^{3b}$ and $R^{5b}$, they may be an alkyl group, alkenyl group or alkynyl group, and they may be straight-chain or branch-chain. Such alkyl group, alkenyl group and alkynyl group are the same as the alkyl groups, alkenyl groups and alkynyl groups listed earlier in the description of $R^{1b}$ and $R^{2b}$ in formula (1b).

$R^{3b}$ and $R^{5b}$ may have the same structure or have independently different structures.

On the other hand, $R^{4b}$ is derived from a polyhydric alcohol having 2~10 carbon atoms, or a polyoxyalkylene glycol with the oxyalkylene group having 2~4 carbon atoms.

When $R^{4b}$ is derived from a polyhydric alcohol having 2~10 carbon atoms, $R^{4b}$ is preferred to be straight-chain or branch-chain and saturated or unsaturated divalent hydrocarbon group. Particularly preferred is a substituted group obtained by removing one hydrogen from any carbon atom in an alkyl group, alkenyl group or alkynyl group. The number of carbon atoms is preferred to be 5~10, more preferably 5~8.

Examples of an alkyl group are ethyl group, propyl group, butyl group, pentyl group, hexyl group, n- and iso-heptyl group, n- and iso-octyl group, 2-ethylhexyl group, n- and iso-nonyl group, n- and iso-decyl group and the like.

Examples of an alkenyl group are ethenyl group, propenyl group, butenyl group, pentenyl group, hexenyl group, heptenyl group, octenyl group, nonenyl group, decenyl group and the like.

Examples of an alkynyl group are ethynyl group, propynyl group, butynyl group, pentynyl group, hexynyl group, heptynyl group, octynyl group, nonynyl group, decynyl group and the like.

On the other hand, when $R^{4b}$ is derived from a polyoxyalkylene glycol, $R^{4b}$ is a divalent residue obtained by removing two hydroxyl groups from a polyoxyalkylene glycol, in particular, represented by $—(OA)_{pb-1}$-A- (here, "OA" indicates an oxyalkylene group having 2~4 carbon atoms, "A" indicates an alkylene group having 2~4 carbon atoms, and "pb" indicates an average number of moles.) For "pb," 1~15 is preferred, more preferably 1~10, even more preferably 2~8. Examples of an oxyalkylene group are oxyethylene group, oxypropylene group, oxytetramethylene group, oxybutylene group and the like.

Conditions for condensation reactions of cyclohexanedicarboxylate C are the same as those described above.

From the viewpoint of suppressing side reactions, the molar ratio of a carboxylic acid component and an alcohol component supplied for condensation reactions is preferred to be, based on 1 mol of a cyclohexanedicarboxylic acid, 0.8~4.6 mol of a monohydric aliphatic alcohol having 8~22 carbon atoms and 0.2~0.6 mol of a polyhydric alcohol having 2~10 carbon atoms and/or a polyoxyalkylene glycol; more preferably, 0.9~4.4 mol of a monohydric aliphatic alcohol having 8~22 carbon atoms and 0.3~0.55 mol of a polyhydric alcohol having 2~10 carbon atoms and/or a polyoxyalkylene glycol; even more preferably, 0.9~1.2 mol of a monohydric aliphatic alcohol having 8~22 carbon atoms, and 0.4~0.55 mol of a polyhydric alcohol having 2~10 carbon atoms and/or a polyoxyalkylene glycol.

In addition, regarding the molar ratio of the alcohol component to be supplied for condensation reactions, based on 1 mol of a monohydric aliphatic alcohol having 8~22 carbon atoms, the total moles of a polyhydric alcohol having 2~10 carbon atoms and a polyoxyalkylene glycol is preferred to be 0.1~0.6 mol, more preferably 0.2~0.6 mol, even more preferably 0.4~0.6 mol.

When a compound is selected from groups B and C, especially preferred is a cyclohexanedicarboxylate with the structure represented by formula (2b) above, because it does not scatter during stabilization and remains stably on the surface of a precursor fiber bundle.

Here, the number of cyclohexyl rings in one molecule is preferred to be 1 or 2 because such a molecule results in a low viscosity of the oil agent composition. Such an oil agent composition is easier to disperse in water and leads to an emulsion with excellent stability.

(Groups D and E)

Compound D included in group D is a compound obtained through condensation reactions of a cyclohexanedimethanol and/or a cyclohexanediol and a fatty acid having 8~22 carbon atoms, namely, a cyclohexanedimethanol ester or cyclohexanediol ester (hereinafter, may also be referred to as "ester (I)."

On the other hand, compound E included in group E is a compound obtained through condensation reactions of a cyclohexanedimethanol and/or a cyclohexanediol, a fatty acid having 8~22 carbon atoms, and a dimer acid, namely, a cyclohexanedimethanol ester or cyclohexanediol ester (hereinafter, may also be referred to as "ester (II)."

It is easy to disperse ester (I) and ester (II) in water by emulsification using a later-described nonionic surfactant. Thus, a homogeneous result on a precursor fiber bundle is easier to achieve, and it is effective to produce carbon-fiber precursor acrylic fiber bundles to obtain carbon-fiber bundles with excellent mechanical characteristics.

In addition, since esters (I) and (II) are aliphatic esters, they thermally decompose well. Thus, those esters tend to be low-molecular and are exhausted outside the system with a circular gas in the furnace during a carbonization process, and are unlikely to cause problems or low quality.

Ester (I) is obtained through condensation reactions of cyclohexanedimethanol and/or cyclohexanediol and a fatty acid having 8~22 carbon atoms.

A cyclohexanedimethanol may be any of 1,2-cyclohexanedimethanol, 1,3-cyclohexanedimethanol and 1,4-cyclohexanedimethanol, but 1,4-cyclohexanedimethanol is preferred when considering the ease of synthesizing and heat resistance.

A cyclohexanediol may be any of 1,2-cyclohexanediol, 1,3-cyclohexanediol and 1,4-cyclohexanediol, but 1,4-cyclohexanediol is preferred when considering the ease of synthesizing and heat resistance.

The number of carbon atoms in a fatty acid for the raw material for ester (I) is 8~22. Namely, the hydrocarbon group of the fatty acid has 7~21 carbon atoms.

When there are seven or more carbon atoms in the hydrocarbon group, the thermal stability of ester (I) is maintained well, and sufficient fusion preventability becomes evident during stabilization. On the other hand, when the number of carbon atoms in the hydrocarbon group is 21 or less, the ester (I) does not become excessively viscous. Accordingly, it is easier to prepare an emulsion of the oil agent composition containing ester (I) as an oil agent, and such an oil agent composition homogeneously adheres to a precursor fiber bundle.

From the viewpoints above, the number of carbon atoms of a hydrocarbon group is preferred to be 11~21, more preferably 15~21. Namely, a fatty acid having 12~22 carbon atoms, more preferably 16~22, is preferred.

A fatty acid having 8~22 carbon atoms may be esterified with a short-chain alcohol having 1~3 carbon atoms. Examples of a short-chain alcohol having 1~3 carbon atoms are methanol, ethanol, and n- or iso-propanol.

Examples of a fatty acid having 8~22 carbon atoms are caprylic acid, pelargonic acid, capric acid, lauric acid, myristic acid, pentadecylic acid, palmitic acid, palmitoleic acid, margaric acid, stearic acid, oleic acid, vaccenic acid, linoleic acid, linolenic acid, tuberculostearic stearic acid, arachidic acid, arachidonic acid and behenic acid.

Among those, from the viewpoints of balancing ease of handling, processability and performance, oleic acid is preferred since the oil agent becomes more easily dispersed in water when a later-described processed-oil solution is prepared, problems seldom occur such as fibers winding around transport rollers when fibers are in contact with transport rollers in the spinning step, and desired heat resistance is achieved. Such fatty acids may be used alone or in any combination thereof.

Ester (I) is preferred to be a compound with the structure represented by formula (1c) below.

formula 15

(1c)

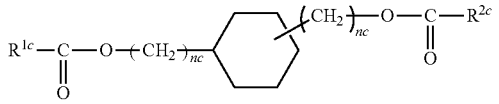

In formula (1c), $R^{1c}$ and $R^{2c}$ each independently indicate a hydrocarbon group having 7~21 carbon atoms. When there are seven or more carbon atoms in a hydrocarbon group, the thermal stability of ester (I) is maintained well, and sufficient fusion preventability becomes evident during stabilization. On the other hand, when the number of carbon atoms in a hydrocarbon group is 21 or less, the ester (I) does not become excessively viscous. Accordingly, it is easier to prepare an emulsion of the oil agent composition containing ester (I) as an oil agent, and such an oil agent homogeneously adheres to a precursor fiber bundle. From the viewpoints above, it is preferred for the number of carbon atoms in a hydrocarbon group in $R^{1c}$ and $R^{2c}$ to be independently 11~21, more preferably 15~21.

$R^{1c}$ and $R^{2c}$ may have the same structure or have different structures from each other.

$R^{1c}$ and $R^{2c}$ are each derived from the hydrocarbon group of a fatty acid, and may be any of an alkyl group, alkenyl group or alkynyl group. They may be straight-chain or branch-chain.

Examples of an alkyl group are n- and iso-heptyl group, n- and iso-octyl group, 2-ethylhexyl group, n- and iso-nonyl group, n- and iso-decyl group, n- and iso-undecyl group, n- and iso-dodecyl group, n- and iso-tridecyl group, n- and iso-tetradecyl group, n- and iso-hexadecyl group, n- and iso-heptadecyl group, stearyl group, nonadecyl group, eicocyl group, and heneicocyl group.

Examples of an alkenyl group are heptenyl group, octenyl group, nonenyl group, decenyl group, undecenyl group, dodecenyl group, tetradecenyl group, pentadecenyl group, hexadecenyl group, heptadecenyl group, octadecenyl group, nonadecenyl group, oleyl group, gadoleyl group, and 2-ethyldecenyl group.

Examples of an alkynyl group are, 1- and 2-dodecynyl group, 1- and 2-tridecynyl group, 1- and 2-tetradecynyl group, 1- and 2-hexadecynyl group, 1- and 2-stearynyl group, 1- and 2-nonadecynyl group, 1- and 2-eicocynyl group, and the like.

In formula (1c), each "nc" is independently 0 or 1.

When 1,4-cyclohexanedimethanol is used as the raw material for ester (I), "nc" is 1, whereas when 1,4-cyclohexanediol is used, "nc" is 0.

Ester (I) is obtained by condensation reactions of a cyclohexanedimethanol and/or cyclohexanediol and a fatty acid having 8~22 carbon atoms without a catalyst or in the presence of a well-known catalyst for esterification such as a tin compound or titanium compound. Condensation reactions are preferred to be conducted under inert gas atmosphere.

Reaction temperature is preferred to be 160~250° C., more preferably 180~230° C.

The molar ratio of a carboxylic acid component and an alcohol component supplied for condensation reactions is preferred to be 1.8~2.2 mol, more preferably 1.9~2.1 mol, of a fatty acid having 8~22 carbon atoms to the total 1 mol of a cyclohexanedimethanol and cyclohexanediol.

When a catalyst for esterification is used, from the viewpoint of CF tensile strength, the catalyst is preferred to be deactivated after condensation reactions and to be removed using an adsorbant.

On the other hand, ester (II) is obtained through condensation reactions of a cyclohexanedimethanol and/or cyclohexanediol, a fatty acid having 8~22 carbon atoms, and a dimer acid.

Examples of a cyclohexanedimethanol and a cyclohexanediol are those listed above in the description of ester (I).

A fatty acid for the raw material for ester (II) has 8~22 carbon atoms. Namely, the hydrocarbon group of the fatty acid has 7~21 carbon atoms.

When there are seven or more carbon atoms in a hydrocarbon group, the thermal stability of ester (II) is maintained well, and sufficient fusion preventability becomes evident during stabilization. On the other hand, when the number of carbon atoms in a hydrocarbon group is 21 or less, the ester (II) does not become excessively viscous. Accordingly, it is easier to prepare an emulsion of the oil agent composition containing ester (II) as an oil agent, and such an oil agent homogeneously adheres to a precursor fiber bundle.

From the viewpoints above, the number of carbon atoms of a hydrocarbon group is preferred to be 11~21, more preferably 15~21. Namely, a fatty acid having 12~22 carbon atoms, more preferably 16~22, is preferred.

Examples of a fatty acid having 8~22 carbon atoms are those listed above in the description of ester (I).

A dimer acid is obtained by dimerizing an unsaturated fatty acid.

A preferred dimer acid is a dicarboxylic acid having 32~40 carbon atoms (HOOC—$R^{4c'}$—COOH) obtained by dimerizing an unsaturated fatty acid having 16~20 carbon atoms.

By such a reaction, $R^{4c'}$ becomes a hydrocarbon group having 30~38 carbon atoms.

When a hydrocarbon group has 30 or more carbon atoms, the thermal stability of ester (II) is maintained well, and sufficient fusion preventability becomes evident during stabilization. On the other hand, when a hydrocarbon group has 38 or fewer carbon atoms, the ester (II) does not become excessively viscous. Accordingly, it is easier to prepare an emulsion of the oil agent composition containing ester (II) as an oil agent, and such an oil agent homogeneously adheres to a precursor fiber bundle.

From the viewpoints above, the number of carbon atoms of $R^{4c'}$ is preferred to be 30~38, more preferably 34. Namely, a dicarboxylic acid having 32~40 carbon atoms, more preferably 36, is preferred for a dimer acid.

A fatty acid having 8~22 carbon atoms and a dimer acid may be esterified with a short-chain alcohol having 1~3 carbon atoms as described above.

Examples of $R^{4c'}$ are divalent substituted groups obtained by removing two hydrogen atoms from any carbon atom in alkanes, alkenes or alkynes having 30~38 carbon atoms. Examples of such a divalent substituted group are those obtained by removing a hydrogen from any carbon atom in an alkyl group, alkenyl group or alkynyl group having 30~38 carbon atoms.

A compound with the structure represented by formula (2c) below is preferred as ester (II).

formula 16

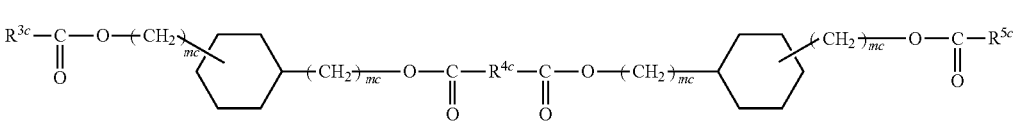

(2c)

In formula (2c), $R^{3c}$ and $R^{5c}$ are each independently a hydrocarbon group having 7~21 carbon atoms, and $R^{4c}$ is a hydrocarbon group having 30~38 carbon atoms.

When the number of carbon atoms in each hydrocarbon group of $R^{3c}$ and $R^{5c}$ is seven or greater, and that number of $R^{4c}$ is 30 or greater, the thermal stability of ester (II) is maintained well, and sufficient fusion preventability becomes evident during stabilization. On the other hand, when the number of carbon atoms of a hydrocarbon group in $R^{3c}$ and $R^{5c}$ is 21 or less, and that number in $R^{4c}$ is 38 or less, ester (II) does not become excessively viscous. Accordingly, it is easier to prepare an emulsion of the oil agent composition containing ester (II) as an oil agent, and such an oil agent homogeneously adheres to a precursor fiber bundle.

The number of carbon atoms of a hydrocarbon group in $R^{3c}$ and $R^{5c}$ is preferred to be independently 11~21, more preferably 15~21. The number of carbon atoms of a hydrocarbon group in $R^{4c}$ is preferred to be 34.

$R^{3c}$ and $R^{5c}$ are each derived from the hydrocarbon group of a fatty acid, and may be any of an alkyl group, alkenyl group and alkynyl group. They may be straight-chain or branch-chain. Examples of such alkyl, alkenyl and alkynyl groups are those listed above in the description of $R^{1c}$ and $R^{2c}$ represented by formula (1c).

$R^{3c}$ and $R^{5c}$ may have the same structure or have different structures from each other.

On the other hand, $R^{4c}$ is derived from the hydrocarbon group of a dimer acid and is a divalent substituted group obtained by removing two hydrogen atoms from any carbon atom in alkanes, alkenes or alkynes. $R^{4c}$ may be straight-chain or branch-chain.

Examples of $R^{4c}$ are the same divalent substituted groups as those listed for $R^{4c'}$ above in the description of a dimer acid.

In formula (2c), each "mc" is independently 0 or 1.

When 1,4-cyclohexanedimethanol is used as the raw material for ester (II), "mc" is 1, whereas when 1,4-cyclohexanediol is used, "mc" is 0.

Conditions of condensation reactions for ester (II) are the same as for ester (I). From the viewpoints of suppressing side reactions and obtaining low viscosity, the molar ratio of a carboxylic acid component and an alcohol component to be supplied to condensation reactions is preferred to be 0.8~1.6 mol of a fatty acid having 8~22 carbon atoms and 0.2~0.6 mol of a dimer acid to the total 1 mol of a cyclohexanedimethanol and a cyclohexanediol. The more preferred ratio is 0.9~4.4 mol of a fatty acid having 8~22 carbon atoms and 0.3~0.55 mol of a dimer acid, and an even more preferred ratio is 1.0~1.4 mol of a fatty acid having 8~22 carbon atoms and 0.3~0.5 mol of a dimer acid, to the total 1 mol of a cyclohexanedimethanol and a cyclohexanediol.

In addition, in the carboxylic acid component supplied to condensation reactions, the molar ratio of a fatty acid having 8~22 carbon atoms and a dimer acid is preferred to be 0.1~0.6 mol, more preferably 0.1~0.5 mol, even more preferably 0.2~0.4 mol, of a dimer acid to 1 mol of a fatty acid having 8~22 carbon atoms.

When a compound is selected from groups D and E, a cyclohexanedimethanol ester structured as represented by formula (2c) above is especially preferred since that makes it easier to obtain a carbon-fiber bundle with excellent mechanical characteristics.

(Group F)

Compound F included in group F is a compound obtained by reacting 3-isocyanatomethyl-3,5,5-trimethylcyclohexyl=isocyanate (isophorone diisocyanate) and at least one compound selected from a group of monohydric aliphatic alcohols having 8~22 carbon atoms and their polyoxyalkylene ether (hereinafter, may also be referred to as isophoronediisocyanate-aliphatic alcohol adduct).

An isophoronediisocyanate-aliphatic alcohol adduct shows sufficient heat resistance during stabilization. Also, since it does not have an aromatic ring, it thermally decomposes well into low molecules during carbonization. Thus, it is likely to be exhausted from the system together with the circulating gas in the furnace, and is unlikely to cause processing problems or to lower quality.

In addition, an isophoronediisocyanate-aliphatic alcohol adduct is stably dispersed in water through emulsification when a later-described nonionic surfactant is applied. Thus, it tends to adhere homogeneously to a precursor fiber bundle and is effective for producing a carbon-fiber precursor acrylic fiber bundle to obtain a carbon-fiber bundle with excellent mechanical characteristics.

As alcohols to be used as a raw material for an isophoronediisocyanate-aliphatic alcohol adduct, at least one type of monohydric aliphatic alcohol is used.

A monohydric aliphatic alcohol has 8~22 carbon atoms. When the number of carbon atoms is eight or greater, the thermal stability of an isophoronediisocyanate-aliphatic alcohol adduct is maintained well. Thus, sufficient fusion preventability becomes evident during stabilization. On the other hand, when the number of carbon atoms is 22 or less, the isophoronediisocyanate-aliphatic alcohol adduct does not become excessively viscous, and is unlikely to solidify. Accordingly, an emulsion of the oil agent composition containing an isophoronediisocyanate-aliphatic alcohol adduct as an oil agent is easier to prepare, and the oil agent homogeneously adheres to a precursor fiber bundle.

The number of carbon atoms in a monohydric aliphatic alcohol is preferred to be 11~22, more preferably 15~22.

Examples of monohydric aliphatic alcohols having 8~22 carbon atoms are alkyl alcohols such as octanol, 2-ethylhexanol, nonanol, decanol, undecanol, dodecanol, tridecanol, tetradecanol, hexadecanol, heptadecanol, octadecanol, nonadecanol, eicosanol, heneicosanol, and docosanol; alkenyl alcohols such as octenyl alcohol, nonenyl alcohol, decenyl alcohol, undecenyl alcohol, dodecenyl alcohol, tetradecenyl alcohol, pentadecenyl alcohol, hexadecenyl alcohol, heptadecenyl alcohol, octadecenyl alcohol (oleyl alcohol), nonadecenyl alcohol, icocenyl alcohol, henicocenyl alcohol, dococenyl alcohol, and 2-ethyldecenyl alcohol; alkynyl alcohols such as octynyl alcohol, nonynyl alcohol, decynyl alcohol, undecynyl alcohol, dodecynyl alcohol, tridecynyl alcohol, tetradecynyl alcohol, hexadecynyl alcohol, octadecynyl alcohol, nonadecynyl alcohol, eicocynyl alcohol, henicocynyl alcohol, and dococynyl alcohol.

Especially, from the viewpoints of balancing ease of handling, processability and performance, octadecenyl alcohol (oleyl alcohol) is preferred since later-described processed-oil solutions are easier to prepare, problems seldom occur such as fibers winding around transport rollers when fibers are in contact with transport rollers in the spinning step, and desired heat resistance is achieved.

Such aliphatic alcohols may be used alone or in any combination thereof.

An aliphatic alcohol to be used as a raw material for an isophoronediisocyanate-aliphatic alcohol adduct may be a polyoxyalkylene ether compound with alkylene oxide attached to a monohydric aliphatic alcohol having 8~22 carbon atoms listed above.

When the number of carbon atoms is eight or greater in a monohydric aliphatic alcohol, excellent thermal stability is maintained when an oil agent is formed as a final product. Thus, sufficient fusion preventability is achieved during stabilization. On the other hand, when the number of carbon atoms is 22 or less, the oil agent does not become excessively viscous, and is unlikely to solidify. Accordingly, an emulsion of the oil agent composition containing the oil agent is easier to prepare, and the oil agent homogeneously adheres to a precursor fiber bundle. The number of carbon atoms in an aliphatic alcohol is preferred to be 11~22, more preferably 15~22.

An alkylene oxide contributes to providing hydrophilic properties for an oil agent as well as affinity with fibers when applied onto precursor fiber bundles.

Examples of an alkylene oxide are ethylene oxides, propylene oxides, butylene oxides and the like. Among those, ethylene oxides and propylene oxides are preferred.

The average added number of moles of alkylene oxides is determined in relation to the number of carbon atoms of an aliphatic alcohol. When the number of carbon atoms of an aliphatic alcohol is within the preferred range as described above, the added number of moles of alkylene oxide is preferred to be 0~5 mol, more preferably 0~3 mol.

Examples of polyoxyalkylene ether are polyoxyalkylene ethers such as an adduct of octanol with 4 moles of polyoxyethylene (hereinafter referred to as "POE (4) octyl ether"), POE (3) dodecyl ether, an adduct of dodecanol with 3 moles of polyoxypropylene (hereinafter referred to as "POP (3) dodecyl ether"), POE (2) octadecyl ether, and POP (1) octadecyl ether; polyoxyalkylene alkenyl ethers such as POE (2) dodecenyl ether, POP (2) dodecenyl ether, POE (2) octadecenyl ether, and POP (1) octadecenyl ether; polyoxyalkynyl ethers such as POE (2) dodecynyl ether, POE (2)

octadecynyl ether, and POP (1) octadecynyl ether. The number shown in parentheses indicates the average number of added moles.

As for an isophoronediisocyanate-aliphatic alcohol adduct, a compound with the structure represented by formula (1d) below is preferred.

formula 17

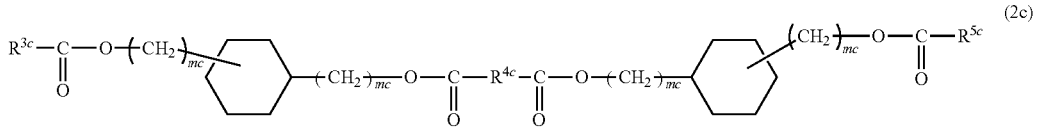

(2c)

In formula (1d), $R^{1d}$ and $R^{4d}$ are each independently a hydrocarbon having 8~22 carbon atoms. $R^{2d}$ and $R^{3d}$ are each independently a hydrocarbon group having 2~4 carbon atoms. In the formula, "nd" and "md" indicate an average number of attached moles and are each independently 0~5, preferably 0~3.

When the number of carbon atoms in $R^{1d}$ and $R^{4d}$ is eight or greater, the thermal stability of an isophoronediisocyanate-aliphatic alcohol adduct is maintained well. Thus, sufficient fusion preventability becomes evident during stabilization. On the other hand, when the number of carbon atoms in the hydrocarbon group is 22 or less, an isophoronediisocyanate-aliphatic alcohol adduct does not become excessively viscous, and is unlikely to solidify. Accordingly, an emulsion of the oil agent composition containing the isophoronediisocyanate-aliphatic alcohol adduct as an oil agent is easier to prepare, and the oil agent homogeneously adheres to a precursor fiber bundle.

The number of carbon atoms in a hydrocarbon group is preferred to be 11~22, more preferably 15~22.

A compound with the structure represented by formula (1d) above is an isophoronediisocyanate-alipatic alcohol adduct obtained by reactions of an isophoronediisocyanate and a monohydric aliphatic alcohol having 8~22 carbon atoms or its polyoxyalkylene ether.

Therefore, in formula (1d), $R^{1d}$ and $R^{4d}$ are derived from a monohydric aliphatic alcohol having 8~22 carbon atoms, and may be any of a straight-chain or branch-chain alkyl group, alkenyl group or alkynyl group having 8~22 carbon atoms.

Examples of alkyl groups are n- and iso-octyl group, 2-ethylhexyl group, n- and iso-nonyl group, n- and iso-decyl group, n- and iso-undecyl group, n- and iso-dodecyl group, n- and iso-tridecyl group, n- and iso-tetradecyl group, n- and iso-hexadecyl group, n- and iso-heptadecyl group, octadecyl group, nonadecyl group, eicodecyl group, heneicocyl group dococyl group, and the like.

Examples of alkenyl groups are octenyl group, nonenyl group, decenyl group, undecenyl group, dodecenyl group, tetradecenyl group, pentadecenyl group, hexadecenyl group, heptadecenyl group, octadecenyl group, nonadecenyl group, icocenyl group, henicocenyl group, dococenyl group, gadoleyl group, 2-ethyldecenyl group and the like.

Examples of alkynyl groups are 1- and 2-octynyl group, 1- and 2-nonynyl group, 1- and 2-decynyl group, 1- and 2-undecynyl group, 1- and 2-dodecynyl group, 1- and 2-tridecynyl group, 1- and 2-tetradecynyl group, 1- and 2-hexadecynyl group, 1- and 2-octadecynyl group, 1- and 2-nonadecynyl group, 1- and 2-eicocynyl group, 1- and 2-henicocynyl group, 1- and 2-dococynyl group, and the like $R^{1d}$ and $R^{4d}$ may have the same structure, or different structures from each other.

On the other hand, —$R^{2d}$O— and —$R^{3d}$O— in formula (1d) are derived from the alkylene oxide of polyoxyalkylene ether, and "nd" and "md" are derived from the number of attached moles of alkylene oxides.

$R^{2d}$ and $R^{3d}$ are each an alkylene group having 2~4 carbon atoms, in particular, an ethylene group, propylene group, or butylene group, preferably an ethylene group or propylene group. $R^{2d}$ and $R^{3d}$ may have the same structure or have different structures from each other.

In formula (1d), "nd" and "md" show the added amount of alkylene oxide as described above. The polyalkylene oxide structure is not always required, and it is an option for "nd" and "md" to be 0. When introducing alkylene oxides to enhance hydrophilic properties for an oil agent as well as affinity with fibers, "nd" and "md" may each be up to 5.

An isophoronediisocyanate-aliphatic alcohol adduct is obtained by reacting, without using a catalyst or in the presence of a well-known catalyst for urethane linkage, 3-isocyanatomethyl-3,5,5-trimethylcyclohexyl=isocyanate (isophorone diisocyanate) and at least one compound selected from a group of monohydric aliphatic alcohols having 8~22 carbon atoms and their polyoxyalkylene ether compounds. Reactions are preferred to be conducted under inert gas atmosphere, and reaction temperature is preferred to be 70~150° C., more preferably 80~130° C.

The molar ratio of isophoronediisocyanate and at least one type of compound selected from a group of monohydric aliphatic alcohols having 8~22 carbon atoms and their polyoxyalkylene ether compound is preferred to be 1.8~2.2 mol, more preferably 1.9~2.1 mol of the compound to 1 mol of isophoronediisocyanate.

(Combination)

The oil agent related to the present invention is preferred to contain at least one type, more preferably at least two types, of compounds selected from among groups A, B, C, D, E and F. Especially preferred is to contain compound A selected from group A and/or compound F selected from group F, from the viewpoint of the CF tensile strength of the obtained carbon-fiber bundle. When an oil agent according to the present invention contains at least two types of compounds selected from groups A, B, C, D, E and F, preferred combinations are compound A and compound B, compound A and compound C, compound A and compound E, compound A and compound F, compound F and compound B, compound F and compound C, compound F and compound D, compound F and compound E, compound B and compound C, and compound D and compound E. From the viewpoint of the CF tensile strength of the obtained carbon-fiber bundle, even more preferred combinations are compound A and compound B, compound A and compound C, compound A and compound E, compound A and compound F, compound F and compound B, compound F and compound C, compound F and compound D, and compound F and compound E.

The oil agent according to the present invention is preferred to contain group C because such an oil agent tends not to scatter and to remain steadily on the surface of a precursor fiber bundle during stabilization. Also, the oil agent is preferred to contain group E because a carbon-fiber bundle with excellent mechanical characteristics tends to be obtained.

From the viewpoints above, when the oil agent of the present invention contains two or more types of compounds, it is preferred to contain at least two types of compounds selected from among groups A, C, E and F. In such a case as well, compounds are selected from two or more different groups.

When the oil agent of the present invention contains two or more types of compounds, the mass ratio of the selected two or more types of compounds is preferred to be 1 to 3~3 to 1, more preferably 1 to 2~2 to 1, from the viewpoint of the CF tensile strength of the obtained carbon-fiber bundle.

Also, when the oil agent of the present invention contains two or more types of compounds, it is preferred to contain two to four types, more preferably two to three types, of compounds.

(Other Oil Components)

The oil agent according to the present invention may further contain ester compound G having two aromatic rings or amino-modified silicone H. Especially, when the oil agent of the present invention contains one type of compound selected from among groups A, B, C, D, E and F above, or when the oil agent contains two types of compounds in combination of compound B and compound C or compound D and compound E, it is preferred to further contain ester compound G or amino-modified silicone H. Furthermore, when the oil agent contains any of compound A, compound B and/or compound C, or compound F, it is preferred to further contain ester compound G; and when the oil agent contains compound D and/or compound E, it is further preferred to contain amino-modified silicone H.

Except when the oil agent contains compound D and/or compound E, silicone-based oil agents such as amino-modified silicone H are preferred not to be used from the viewpoint of suppressing silicon compounds to be produced.

When the oil agent contains compound A and ester compound G, compound A and ester compound G tend to adhere to a precursor fiber because ester compound G has compatibility with compound A. Moreover, since ester compound G exhibits sufficient heat resistance during stabilization, convergence of a carbon-fiber precursor acrylic fiber bundle improves during the process. Thus, excellent operational stability is achieved.

The above-described compound A and ester compound G are non-silicone-based oil agents. The ratio of compound A and ester compound G in the oil agent is preferred to be 10~99 parts by mass of compound A and 1~90 parts by mass of ester compound G, more preferably 20~60 parts by mass of compound A and 40~80 parts by mass of ester compound G, based on 100 parts by mass of the total of compound A and ester compound G.

When the amount of compound A is at least 10 parts by mass, adhesiveness to a precursor fiber bundle and smoothness between fiber and transport rollers and bars are maintained while damage to the fiber bundle is reduced. On the other hand, when the amount of compound A exceeds 99 parts by mass, that does not cause problems in industrial production, but if oil agent contains at least 1 part by mass of ester compound G, a homogeneous carbon-fiber bundle is easier to obtain in the heating process.

In addition, when the ratio of ester compound G is within the above range, the bundling property of a carbon-fiber precursor acrylic fiber bundle during stabilization is easier to maintain. Also, the effect of compound A is fully expressed.

When the oil agent contains compound G and/or compound C as well as ester compound G the mechanical characteristics (especially strength) of a carbon-fiber bundle obtained by heating the precursor fiber bundle with the oil agent adhered thereon improve.

When the oil agent contains compound D and/or compound E as well as amino-modified silicone H, the mechanical characteristics (especially strength) of a carbon-fiber bundle obtained by heating the precursor fiber bundle with the oil agent adhered thereon improve.

When the oil agent contains compound F and ester compound G, since ester compound G shows sufficient heat resistance during stabilization, the bundling property of a carbon-fiber precursor acrylic fiber bundle improves, while excellent operational stability is maintained. Also, ester compound G works effectively to apply compound F homogeneously onto fiber surfaces.

The above-described compound F and ester compound G are non-silicone-based oil agents. The ratio of compound F and ester compound G in the oil agent is preferred to be 10~99 parts by mass of compound F and 1~90 parts by mass of ester compound G, more preferably 20~60 parts by mass of compound F and 40~80 parts by mass of ester compound G, based on 100 parts by mass of the total of compound F and ester compound G.

When the amount of compound F is at least 10 parts by mass, adhesiveness to a precursor fiber bundle and smoothness between fiber and transport rollers and bars are maintained while damage to the fiber bundle is reduced. On the other hand, when the amount of compound F in the oil agent exceeds 99 parts by mass, that does not cause problems in industrial production, but containing at least 1 part by mass of ester compound G makes it easier to result in a homogeneous carbon-fiber bundle in the heating process.

In addition, when the ratio of ester compound F is within the above range, the bundling property of a carbon-fiber precursor acrylic fiber bundle during stabilization is easier to maintain. Also, the effect of compound G is fully expressed.

Examples of ester compound G are ester compounds having one aromatic ring in the structure such as phthalic acid ester, isophthalic acid ester, terephthalic acid ester, hemimellitic acid ester, trimellitic acid ester, trimesic acid ester, prehnitic acid ester, mellophanic acid ester, pyromellitic acid ester, mellitic acid ester, toluic acid ester, xylyl acid ester, hemellitic acid ester, mesitylene acid ester, prehnitylic acid ester, durylic acid ester, cumin acid ester, uvitic acid ester, toluic acid ester, hydratropic acid ester, atropic acid ester, hydroxycinnamic acid ester, cinnamic acid ester, o-pyrocatechuic acid ester, β-resorcylic acid ester, gentisic acid ester, protocatechuic acid ester, vanillic acid ester, veratric acid ester, gallic acid ester, and hydro-caffeic acid ester; and ester compounds containing two aromatic rings in the structure such as diphenic acid ester, benzyl ester, naphthoic acid ester, hydroxy naphthoic acid ester, polyoxyethylene bisphenol A carboxylic acid ester, and an aliphatic hydrocarbon diol acid ester.

Among those, ester compound G is preferred to be trimellitic acid esters (hereinafter referred to as "ester compound G1") represented by formula (1e) below, or polyoxyethylene bisphenol A dialkylate (hereinafter referred to as "ester compound G2") represented by formula (2e) below. They may be used alone or in combination thereof.

formula 18

(1e)

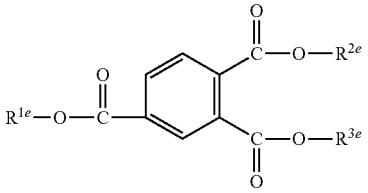

formula 19

(2 e)

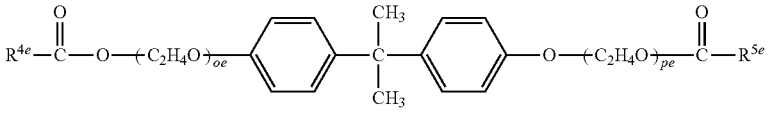

In formula (1e), $R^{1c}$~$R^{3e}$ are each independently a hydrocarbon group having 8~16 carbon atoms. When the number of carbon atoms in a hydrocarbon group is at least eight, excellent heat resistance is maintained in ester compound G1, and sufficient fusion preventability is exhibited during stabilization. On the other hand, when the number of carbon atoms of the hydrocarbon group is 16 or less, an emulsion of the oil agent composition containing ester compound G1 is easier to prepare, and the oil agent composition adheres homogeneously to a precursor fiber bundle. As a result, the ability to prevent fusion is evident during stabilization while the bundling property of a carbon-fiber precursor acrylic fiber bundle improves. When considering the ease of preparing a homogeneous emulsion of an oil agent composition, $R^{1e}$~$R^{3e}$ are preferred to be saturated hydrocarbon groups having 8~12 carbon atoms. From the viewpoint of excellent heat resistance in the presence of steam, saturated hydrocarbon groups having 10~14 carbon atoms are preferred.

$R^{1e}$~$R^{3e}$ may have the same structure or may be different from each other.

As a hydrocarbon group, saturated hydrocarbon groups such as saturated chain hydrocarbon groups or saturated cyclic hydrocarbon groups are preferred. Examples are alkyl groups such as octyl groups, nonyl groups, decyl groups, undecyl groups, lauryl groups, (dodecyl groups), tridecyl groups, tetradecyl groups, pentadecyl groups and hexadecyl groups.

On the other hand, $R^{4e}$ and $R^{5e}$ in formula (2e) are each independently a hydrocarbon group having 7~21 carbon atoms. When the number of carbon atoms in a hydrocarbon group is at least seven, excellent heat resistance is maintained in ester compound G2, and sufficient fusion preventability is exhibited during stabilization. On the other hand, when the number of carbon atoms is 21 or less, an emulsion of the oil agent composition containing ester compound G2 is easier to prepare, and the oil agent composition adheres homogeneously to a precursor fiber bundle. As a result, the ability to prevent fusion is evident during stabilization while the bundling property of a carbon-fiber precursor acrylic fiber bundle improves. The number of carbon atoms in those hydrocarbon groups is preferred to be 9~15.

$R^{4e}$ and $R^{5e}$ may have the same structure or may be different from each other.

As a hydrocarbon group, saturated hydrocarbon groups, especially saturated chain hydrocarbon groups, are preferred. Examples are alkyl groups such as heptyl groups, octyl groups, nonyl groups, decyl groups, undecyl groups, lauryl groups, (dodecyl groups), tridecyl groups, tetradecyl groups, pentadecyl groups, hexadecyl groups, heptadecyl groups, octadecyl groups, nonadecyl groups, icosyl groups (eicosyl groups), henicosyl groups (heneicosyl groups) and the like.

Also, as for hydrocarbon groups, those derived from monovalent saturated aliphatic carboxylic acids are preferred. More preferred are those derived from acyclic higher aliphatic carboxylic acids. Examples are laurylic acid, myristic acid, palmitic acid, stearic acid and the like.

In formula (2e), "oe" and "pe" indicate the average number of added moles of ethyleneoxide (EO), and are independently 1~5. When "oe" and "pe" are 5 or less, the heat resistance of ester compound G2 is maintained well, and thus adhesion among single fibers during a drying and densification process is suppressed. In addition, fusion among single fibers during stabilization is well prevented.

Ester compound G2 represented by formula (2e) may be a mixture of multiple compounds. Thus, "oe" and "pe" may not be an integral number. In addition, a hydrocarbon group that forms $R^{4e}$ and $R^{5e}$ may be one type or may be a mixture of multiple types.

Ester compound G1 tends to decompose by heat or to scatter during stabilization, and is unlikely to remain on the surface of a fiber bundle. Therefore, using ester compound G1 leads to excellent mechanical characteristics of a carbon-fiber bundle. However, since heat resistance of ester compound G1 is slightly low, using only ester compound G1 may not be sufficient to obtain excellent bundling property of carbon-fiber precursor acrylic fiber bundles during stabilization.

On the other hand, ester compound G2 shows high heat resistance, is effective to maintain bundling property of carbon-fiber precursor acrylic fiber bundle until stabilization is finished, and works to improve operating efficiency. However, since it remains in a fiber bundle all the way through the carbonization process, it may lower the mechanical characteristics of the carbon-fiber bundle.

Therefore, both ester compound G1 and ester compound G2 are preferred to be used when using ester compound G.

Commercially available products may be used for ester compound G. For example, "Trimex T-10" made by Kao Corporation as ester compound G1, and "Exceparl BP-DL" made by Kao Corporation as ester compound G2, are preferably used.

Amino-modified silicone H is preferred to be a primary lateral-chain amino-modified silicone H1 that has a kinetic viscosity at 25° C. of 50~500 $mm^2/s$, amino equivalent of 2000~6000 g/mol, and is represented by formula (3e) below.

formula 20

(3e)

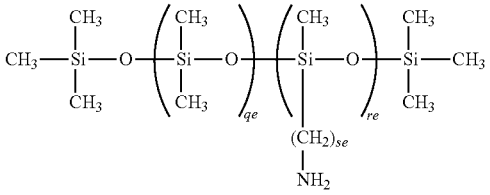

Amino-modified silicone H1 is effective for an oil agent composition to improve heat-resistance properties and affinity to a precursor fiber bundle.

Amino-modified silicone H1 is preferred to have a kinetic viscosity at 25° C. of 50~500 $mm^2/s$, preferably 100~300 $mm^2/s$. When the kinetic viscosity is lower than 50 $mm^2/s$, it is likely to be separated from compound D or compound E, resulting in uneven adhesion of the oil agent composition on the surface of a precursor fiber bundle. Thus, it is difficult to prevent fusion among single fibers during stabilization. On the other hand, when the kinetic viscosity exceeds 500 $mm^2/s$, it is hard to prepare an emulsion of the oil agent composition. Also, the emulsion of the oil agent composition shows low stability, and even adhesion on precursor fiber bundles is hard to achieve.

The kinetic viscosity of amino-modified silicone H1 is measured according to "Methods for Viscosity Measurement of Liquid" regulated in JIS-Z-8803, or based on ASTM D 445-46T. For example, the viscosity is measured using Ubbelohde viscosimeter.

The amino equivalent of amino-modified silicone H1 is 2000~6000 g/mol, more preferably 4000~6000 g/mol. When the amino equivalent is less than 2000 g/mol, the number of amino groups in the silicone molecule becomes excessive, lowering the thermal stability of amino-modified silicone H1 and causing processing failure. On the other hand, when the amino equivalent exceeds 6000 g/mol, the number of amino groups in the silicone molecule becomes too small, lowering affinity with a precursor fiber bundle and resulting in uneven adhesion of the oil agent composition. When the amino equivalent is in the above range, affinity with a precursor fiber bundle and thermal stability of silicone are both achieved.

Amino-modified silicone H1 has the structure represented by formula (3e) above. In formula (3e), "qe" and "re" are any number greater than 1, and "se" is 1~5.

Amino-modified silicone H1 is preferred to have a structure where the amino-modified portion in formula (3e) is an aminopropyl group ($—C_3H_6NH_2$), namely, "se" is 3, "qe" is 10~300, preferably 50~200, and "re" is 2~10, preferably 2~5, in the amino-modified portions of formula (3e).

When "qe" and "re" in formula (3e) are beyond the above range, quality is hard to express and heat resistance is lowered in a carbon-fiber bundle. Especially, when "qe" is less than 10, heat resistance tends to be low and fusion among single fibers is hard to prevent. Also, if "qe" exceeds 300, dispersion of the oil agent composition in water becomes significantly difficult, and an emulsion is hard to prepare. In addition, the stability of the emulsion is low and the oil agent is hard to adhere evenly to precursor fiber bundles.

Meanwhile, if "qe" is lower than 2, the affinity with a precursor fiber bundle is lowered, and it is hard to prevent fusion among single fibers. In addition, if "re" exceeds 10, the heat resistance of the oil agent composition itself decreases, and it is also hard to prevent fusion among single fibers.

Amino-modified silicone H1 represented by formula (3e) may be a mixture of multiple compounds. Thus, "qe," "re" and "se" may not be an integral number.

Approximate values of "qe" and "re" in formula (3e) may be assumed from the kinetic viscosity and amino equivalent of amino-modified silicone H1. On the other hand, "se" is determined from the material used for synthesis.

The values of "qe" and "re" are obtained as follows: first, the kinetic viscosity of amino-modified silicone H1 is measured; from the obtained value of kinetic viscosity, the molar weight is calculated using the A. J. Barry formula ($\log \eta = 1.00 + 0.0123\ M^{0.5}$, ($\eta$: kinetic viscosity at 25° C., M: molar weight); next, from the molar weight and amino equivalent, an average amino base number "re" per mole is determined; and when molar weight "re" and "se" are determined, value "qe" is obtained.

Commercially available products may be used for amino-modified silicone H1. For example, "AMS-132" made by Gelest, Inc., "KF-868," "KF-8008" made by Shin-Etsu Chemical or the like is preferred.

(Form of Oil Agent)

The oil agent according to the present invention is preferred to be mixed with a surfactant or the like to make an oil agent composition, which is then dispersed in water and applied to a precursor fiber bundle. By so preparing, the oil agent is adhered to a precursor fiber bundle with the result being an even homogeneous application.

<Oil Agent Composition for Carbon-Fiber Precursor Acrylic Fiber>

The oil agent composition for carbon-fiber precursor acrylic fiber according to the present invention (hereinafter referred to as simply "oil agent composition") contains the above-described oil agent according to the present invention and a nonionic surfactant (nonionic emulsifier).

The amount of a nonionic surfactant is preferred to be 20~150 parts by mass, more preferably 20~100 parts by mass, to 100 parts by mass of the oil agent. When the amount of a nonionic surfactant is at least 20 parts by mass, the oil agent tends to be emulsified, and the emulsion shows excellent stability. On the other hand, when the amount of the nonionic surfactant is 150 parts by mass or less, the bundling property of a precursor fiber bundle with the adhered oil agent composition is unlikely to be lowered. In addition, mechanical characteristics of the carbon-fiber bundle obtained by heating the precursor fiber bundle are unlikely to decrease.

Especially, when the oil agent of the present invention contains compound B and/or compound C and ester compound G, the amount of a nonionic surfactant is preferred to be 5~40 mass % relative to 100 mass % of the oil agent composition. When the amount of a nonionic surfactant is less than 5 mass %, the oil agent is hard to emulsify, and the emulsion tends to have low stability. On the other hand, when the amount of a nonionic surfactant exceeds 40 mass %, the bundling property of a precursor fiber bundle with the oil agent composition applied thereon is lowered, and mechanical characteristics of a carbon-fiber bundle obtained by heating the precursor fiber bundle tend to be lowered as well.

When the oil agent of the present invention contains compound D and/or compound E and ester compound G, the amount of a nonionic surfactant is preferred to be 10~40 mass %, more preferably 10~30 mass %, relative to 100 mass % of the oil agent composition. When the amount of a nonionic surfactant is less than 10 mass %, the oil agent is hard to emulsify, and the emulsion tends to have low stability. On the other hand, when the amount of a nonionic surfactant exceeds 40 mass %, the bundling property of a precursor fiber bundle with the oil agent composition applied thereon is lowered, and mechanical characteristics of a carbon-fiber bundle obtained by heating the precursor fiber bundle tends to be lowered as well.

Various well-known substances are used as nonionic surfactants. Examples of nonionic polyethylene glycol-based surfactants are those such as ethylene oxide adduct of higher alcohol, ethylene oxide adduct of alkyl phenol, fatty ethylene oxide adduct, ethylene oxide adduct of polyhydric alcohol fatty ester, ethylene oxide adduct of higher alkyl amine, ethylene oxide adduct of aliphatic amide, ethylene oxide adduct of oil, and ethylene oxide adduct of polypropylene glycol; polyhydric alcohol-based nonionic surfactants such as aliphatic esters of glycerol, aliphatic esters of pentaerythritol, aliphatic esters of sorbitol, aliphatic esters of sorbitan, aliphatic esters of sucrose, alkyl ethers of polyhydric alcohols, aliphatic amides of alkanol amines, etc. Those nonionic surfactants may be used alone or in any combination thereof.

Preferred nonionic surfactants are polyether block copolymers made up of a propylene oxide (PO) unit and an ethylene oxide (EO) unit as shown in formula (4e) below and/or polyoxyethylene alkyl ether made up of an EO unit as shown in formula (5e) below.

formula 21

$$R^{6e}-O-(C_2H_4O)_{xe}(C_3H_6O)_{ye}(C_2H_4O)_{ze}-R^{7e} \quad (4e)$$

formula 22

$$R^{8e}-O-(C_2H_4O)_{te}-H \quad (5e)$$

In formula (4e), $R^{6e}$ and $R^{7e}$ are each independently a hydrogen atom, or a hydrocarbon group having 1~24 carbon atoms. Hydrocarbon groups may be straight-chain or branch-chain.

$R^{6e}$ and $R^{7e}$ are each determined in consideration of balancing EO, PO and other components of the oil agent composition; a hydrogen atom or a straight-chain or branch-chain alkyl group having 1~5 carbon atoms, preferably a hydrogen atom, is preferred.

In formula (4e), "xe" and "ze" indicate an average number of added moles of EO, and "ye" indicates an average number of added moles of PO.

The numbers of "xe," "ye," and "ze" are each independently 1~500, preferably 20~300.

Also, the ratio of the sum of "xe" and "ze" to "ye" ((x+z):y) is preferred to be 90:10~60:40.

Polyether block copolymers are preferred to have a number average molar weight of 3000~20000. When the number average molar weight is within such a range, thermal stability and dispersibility in water required for an oil agent composition are both obtained.

Moreover, the kinetic viscosity of a polyether block copolymer at 100° C. is preferred to be 300~15000 $mm^2/s$. When the kinetic viscosity is within such a range, the oil agent composition is prevented from excessive penetration into the fiber, while the oil agent composition seldom causes problems caused by high viscosity such as single fibers being wound around transport rollers or the like during a drying process after the oil agent composition is applied to a precursor fiber bundle.

The kinetic viscosity of a polyether block copolymer is measured according to "Methods for Viscosity Measurement of Liquid" regulated in JIS-Z-8803, or based on ASTM D 445~46T. For example, the viscosity is measured using an Ubbelohde viscosimeter.

In formula (5e), $R^{8e}$ is a hydrocarbon group having 10~20 carbon atoms. When the number of carbon atoms is less than 10, thermal stability of the oil agent composition tends to be lowered, and appropriate lipophilicity is hard to express. On the other hand, when the number of carbon atoms exceeds 20, the viscosity of the oil agent composition tends to increase, or to solidify, causing lower operating efficiency. Also, the balance with a hydrophilic group decreases, and its emulsification capability may be lowered.

Hydrocarbon groups for $R^{8e}$ are preferred to be saturated hydrocarbon groups such as saturated chain hydrocarbon groups and saturated cyclic hydrocarbon groups. Specific examples are decyl groups, undecyl groups, dodecyl groups, tridecyl groups, tetradecyl groups, pentadecyl groups, hexadecyl groups, heptadecyl groups, octadecyl groups, nonadecyl groups, icocyl groups and the like.

Among those, dodecyl groups are especially preferred since dodecyl groups are appropriately lipophilic with other components of the oil agent composition so as to emulsify the oil agent composition efficiently.

In formula (5e), "te" indicates an average number of added moles of EO, and is 3~20, preferably 5~15, more preferably 5~10. If "te" is less than 3, the oil agent composition is hard to show affinity with water and emulsification is difficult. On the other hand, if "te" exceeds 20, the viscosity increases. Accordingly, when such a surfactant is used in the oil agent composition, a precursor fiber bundle with the oil agent composition applied thereon is hard to divide.

Here, $R^{8e}$ is a component related to the lipophilicity of the oil agent composition, and "te" is a component related to hydrophilicity. Therefore, the value of "te" is appropriately determined from the viewpoint of achieving balance with $R^{8e}$.

Commercially available products may be used for a nonionic surfactant. For example, nonionic surfactants represented by formula (4e) above include "Newpol PE-128" and "Newpol PE-68" made by Sanyo Chemical Industries, "Pluronic PE6800" made by BASF Japan, "Adeka Pluronic L-44" and "Adeka Pluronic P-75" made by Adeka Corporation; as nonionic surfactants represented by formula (5e) above, "Emulgen 109P" made by Kao Corporation, "Nikkol BL-9EX" made by Nikko Chemicals Co., Ltd., "Emalex 707" made by Nihon Emulsion Co., Ltd., and so on.

The oil agent according to the present invention is preferred to further contain an antioxidant.

The amount of an antioxidant is preferred to be 1~5 parts by mass, preferably 1~3 parts by mass, based on 100 parts by mass of the oil agent. When the amount of an antioxidant is at least 1 part by mass, sufficient antioxidation effects are obtained. When the amount of an antioxidant is 5 parts by mass or less, the antioxidant is easier to be homogeneously dispersed in the oil agent composition.

Especially, when the oil agent of the present invention contains compound B and/or compound C and ester compound G, the amount of an antioxidant is preferred to be 1~5 mass %, preferably 1~3 mass %, in 100 mass % of the oil agent composition. If the amount of an antioxidant is less than 1 mass %, sufficient antioxidant effects are hard to obtain. If the amount of an antioxidant exceeds 5 mass %, the antioxidant is hard to be homogeneously dispersed in the oil agent composition.

When the oil agent of the present invention contains compound D and/or compound E and ester compound G, the amount of an antioxidant is preferred to be 18~5 mass %, preferably 1~3 mass %, in 100 mass % of the oil agent composition. If the amount of an antioxidant is less than 1 mass %, sufficient antioxidant effects are hard to obtain. Thus, if the oil agent composition contains a silicone-based compound, the silicone-based compound adhered to a precursor fiber bundle may be converted to resin by the heat from a hot roller or the like. When a silicone-based compound is converted to resin, the resin tends to be deposited on the roller surface or the like. As a result, in the manufacturing process of carbon-fiber precursor acrylic fiber bundles and carbon-fiber bundles, such fiber bundles tend to wind around rollers or to be snagged by rollers, causing processing problems and decreasing operating efficiency. On the other hand, if the amount of an antioxidant exceeds 5 mass %, the antioxidant is hard to be homogeneously dispersed in the oil agent composition.

Various well-known substances are used for antioxidants, but phenol-based or sulfur-based antioxidants are preferred.

Examples of phenol-based antioxidants are 2,6-di-t-butyl-p-cresol, 4,4'-butylidene-bis-(6-t-butyl-3-methylphenol), 2,2'-methylenebis-(4-methyl-6-t-butylphenol), 2,2'-methylenebis-(4-ethyl-6-t-butylphenol), 2,6-di-t-butyl-4-ethylphenol, 1,1,3-tris(2-methyl-4-hydroxy-5-t-butylphenyl)butane, n-octadecyl-3-(3,5-di-t-butyl-4-hydroxyphenyl)propionate, tetrakis[methylene-3-(3,5-di-t-butyl-4-hydroxyphenyl)propionate]methane, triethylene glycol bis[3-(3-t-butyl-4-hydroxy-5-methylphenyl)propionate], tris(3,5-di-t-butyl-4-hydroxybenzyl)isocyanurate, and the like.

Examples of sulfur-based antioxidants are dilauryl thiodipropionate, distearyl thiodipropionate, dimyristyl thiodipropionate, ditridecyl thiodipropionate, and the like. Those antioxidants may be used alone or in combination thereof.

Moreover, as for antioxidants, amino-modified silicone is preferred, especially those that affect amino-modified silicone H1 represented by formula (3e) above. Among the antioxidants listed above, tetrakis[methylene-3-(3,5-di-t-butyl-4-hydroxyphenyl)propionate]methane and triethylene glycol bis[3-(3-t-butyl-4-hydroxy-5-methylphenyl)propionate] are preferred.

Furthermore, the oil agent composition according to the present invention may contain an antistatic additive to improve its properties.

Well-known substances may be used for an antistatic additive. Roughly speaking, there are ionic antistatic additives and nonionic antistatic additives. Ionic antistatic additives include anion-based, cation-based, or amphoteric ionic antistatic additives, whereas nonionic antistatic additives include polyethylene glycol types and polyhydric alcohol types. In view of preventing static, ionic types are preferred, especially preferred are aliphatic sulfonates, higher alcohol sulfates, ethylene oxide adducts of higher alcohol sulfates, higher alcohol phosphates, ethylene oxide adducts of higher alcohol phosphates, quaternary ammonium salt cationic surfactants, betaine-type amphoteric surfactants, ethylene oxide adducts of polyethylene glycol fatty acid esters, polyhydric alcohol fatty acid esters, and the like. Those antistatic additives may be used alone or in combination thereof.

Moreover, depending on the usage environment or facility for the oil agent composition to be adhered to precursor fiber bundles, the oil agent composition according to the present invention may include additives such as defoaming agents, preservatives, antimicrobial agents and osmotic agents so as to improve the stability of the oil agent composition and of the manufacturing process, and to enhance the adhesiveness of the oil agent composition.

The oil agent composition of the present invention may contain a well-known oil agent (for example, aliphatic esters) other than the oil agent of the present invention within a range that does not damage the effects of the present invention.

Of the entire oil agent, the amount of the oil agent of the present invention is preferred to be 60 mass %, more preferably 80 mass %, even more preferably 90 mass %. Especially preferred is substantially 100 mass %.

When the oil agent according to the present invention contains compound B and/or compound C and ester compound G, the amount of cyclohexane dicarboxylate is preferred to be 30~80 mass % in 100 mass % of the oil agent composition. If the amount of cyclohexane dicarboxylate is at least 30 mass %, the above-described effects of cyclohexane dicarboxylate are sufficiently obtained. On the other hand, if the amount of cyclohexane dicarboxylate is 80 mass % or less, a sufficient amount of surfactant is included. Thus, it is easier to emulsify the oil agent composition, and an emulsion with excellent stability is prepared. More preferably, the amount of cyclohexane dicarboxylate is 30~50 mass %.

To sufficiently enhance the strength of a carbon-fiber bundle, ester compound G is preferred to be contained at 10 mass % or greater in 100 mass % of the oil agent composition. However, if an excessive amount of ester compound G is contained, the ester compound G adhered to a precursor fiber bundle decomposes during the heating process, and the modified substance derived from the de agent composition may be deposited in the heating facility to cause processing problems. Thus, the upper limit of the amount of ester compound G is preferred to be 40 mass % or less. The amount of ester compound G is more preferably at 20~30 mass %.

When the oil agent contains compound D and/or compound E and amino-modified silicone H, the total amount of compound D and/or compound E is preferred to be 40~80 mass % in 100 mass % of the oil agent composition. When the amount of compound D and/or compound E is at least 40 mass %, and when a silicone-based compound (especially amino-modified silicone H) is added to the oil agent composition, the balance with the silicone-based compound is well maintained, and homogeneous adhesion is easier to achieve when the oil agent composition is applied on a precursor fiber bundle. As a result, a carbon-fiber bundle obtained by heating the precursor fiber bundle with the oil agent composition applied thereon tends to express stable physical properties.

As described later in detail, the oil agent composition is dispersed in water (emulsion) and applied to a precursor fiber bundle. If the amount of compound D and/or compound E is 80 mass % or less, even if a silicone-based compound is added to the oil agent composition, the oil agent composition is easily dispersed in water. Thus, a stable emulsion is obtained, which is easier to adhere homogeneously to a precursor fiber bundle. As a result, a carbon-fiber bundle obtained by heating the precursor fiber bundle with the oil agent composition applied thereon tends to express stable physical properties.

On the other hand, to sufficiently achieve the effect of enhanced strength of a carbon-fiber bundle, the amount of amino-modified silicone H is preferred to be at least 5 mass % in 100 mass % of the oil agent composition. However, an excessive amount of amino-modified silicone H may cause a decrease in productivity or in the quality of produced carbon-fiber bundles, because silicon compounds may be produced from the amino-modified silicone H adhered to a precursor fiber bundle and may scatter during the heating process. Thus, the upper limit of the amount of amino-modified silicone H is preferred to be 40 mass % or less.

The oil agent composition according to the present invention contains the oil agent according to the present invention which includes at least one type selected from among specific hydroxybenzoate (compound A), specific cyclohexane dicarboxylate (compounds B, C), specific cyclohexane dimethanol ester and/or cyclohexane diol ester (compounds D, E), and specific isophoronediisocyanate-aliphatic alcohol adduct (compound F). Accordingly, the oil agent composition is capable of effectively preventing fusion among single fibers while maintaining bundling property during stabilization. In addition, since the generation of silicon compound and the scattering of decomposed silicone are prevented, operating efficiency and processability of fibers are significantly improved, and industrial productivity is well maintained. As a result, carbon-fiber bundles with excellent mechanical characteristics are achieved through stable continuous operations.

As described, the oil agent and oil agent composition according to the present invention solve problems in conventional oil agent compositions mainly containing silicone as well as problems in oil agent compositions containing a low silicone content or containing only non-silicone components.

The oil agent composition according to the present invention is preferred to be dispersed in water and applied to a precursor fiber bundle.

<Carbon-Fiber Precursor Acrylic Fiber Bundle>

A carbon-fiber precursor acrylic fiber bundle according to the present invention is a fiber bundle obtained by applying the oil agent or the oil agent composition to a precursor fiber bundle through oil treatment.

The following is a description of a method for producing a carbon-fiber precursor acrylic fiber bundle by conducting oil treatment on a precursor fiber bundle using the oil agent composition of the present invention.

(Method for Producing Carbon-Fiber Precursor Acrylic Fiber Bundle)

A carbon-fiber precursor acrylic fiber bundle is obtained by applying, for example, the oil agent composition of the present invention (oil treatment) to a precursor fiber bundle swollen by water, and by conducting a drying and densification process on the oil-treated precursor fiber bundle.

An acrylic carbon fiber obtained by a well-known spinning method is used for a precursor fiber bundle of the present invention. Specific examples are acrylic fiber bundles obtained by spinning acrylonitrile-based polymers.

Acrylonitrile-based polymers are obtained by polymerizing acrylonitrile as the main monomer. Acrylonitrile-based polymers may be a homopolymer made only of acrylonitrile, or an acrylonitrile-based copolymer containing acrylonitrile as the main component and other additional monomers.

The amount of acrylonitrile units in an acrylonitrile-based polymer is preferred to be 96.0~98.5 mass % when considering ability to prevent fiber fusion during the heating process, heat resistance of a copolymer, stability of the spinning dope solution, and quality of the subsequent carbon fiber. The amount of the acrylonitrile unit is preferred to be 96 mass % or greater, since thermal fiber fusion is prevented during the heating process to convert a precursor fiber bundle into carbon fiber, and excellent quality and properties of carbon fibers are maintained. In addition, the heat resistance of a copolymer does not decrease, and adhesion among single fibers is prevented in a precursor fiber bundle spinning process, a process of drying fibers, or a drawing process using hot rollers or pressurized steam. Moreover, the amount of acrylonitrile unit is preferred to be 98.5 mass % or less, since its ability to dissolve in a solvent does not decrease, and the stability of a spinning dope solution is maintained, while coagulation of the precipitated copolymer does not increase and stable production of a precursor fiber bundle is achieved.

Monomers other than acrylonitrile for a copolymer may be selected from vinyl-based monomers copolymerizable with acrylonitrile. To enhance stabilized properties, it is preferred to select from monomers capable of facilitating stabilized reactions, such as the following monomers: acrylic acid, methacrylic acid and itaconic acid, their alkali metal salts or ammonium salts, and acrylamide or the like.

Vinyl-based monomers copolymerizable with acrylonitrile are preferred to be vinyl-based monomers containing a carboxylic group such as acrylic acid, methacrylic acid, itaconic acid or the like. The amount of a vinyl-based monomer unit containing a carboxylic group in an acrylonitrile-based copolymer is preferred to be 0.5~2.0 mass %.

Those vinyl-based monomers may be used alone or in combination thereof.

For a spinning process, the acrylonitrile polymer is dissolved in a solvent to prepare a spinning dope solution. Such a solvent may be selected from well-known solvents such as follows: organic solvents such as dimethylacetamide, dimethylsulfoxide and dimethylformamide, and solutions of inorganic compounds such as zinc chloride, sodium thiocyanate and the like. Among those, from the viewpoint of productivity, dimethylacetamide, dimethylsulfoxide, and dimethylformamide are preferred because of their fast coagulation capability. Dimethylacetamide is more preferred.

In addition, to obtain densely coagulated yarn, a spinning dope solution is preferred to be prepared so as to have a certain polymer concentration. Specifically, the polymer concentration of a spinning dope solution is preferred to be at least 17 mass %, more preferably 19 mass %.

Since a spinning dope solution needs to have appropriate viscosity and fluidity, the polymer concentration is preferred to be set within 25 mass %.

A method for the above spinning dope solution may be any of well-known methods such as a wet jet to spin out the solution directly into a coagulation bath, a dry jet wet spinning method to coagulate in air, and a dry-wet method to spin out in air and coagulate in a bath. To obtain high-quality carbon-fiber bundles, a wet jet spinning method or a dry-wet spinning method is preferred.

When a wet or dry-wet spinning method is employed, spinning formation is performed by discharging a spinning dope solution into a coagulation bath using a nozzle with holes in a circular cross-sectional shape. As for a coagulation bath, it is preferred to use a solution containing a solvent used for a spinning dope solution when considering the ease of collecting the solvent.

When a solution containing a solvent is used as a coagulation bath, the solvent content in the solution is preferred to be 50~85 mass % and the temperature of the coagulation bath is preferred to be 10~60° C., because under such conditions, high-quality carbon-fiber bundles having a dense structure are obtained without causing voids, and fibers are easier to draw without failure, thus excellent productivity is achieved.

When a polymer or a copolymer is dissolved in a solvent to make a spinning dope solution, and coagulated yarn is obtained by discharging the spinning dope solution into a coagulation bath, a bath drawing process is performed on such coagulated yarn in a coagulation bath or drawing bath. Alternatively, after the yarn is partially drawn in air, it is then drawn in a bath. Then, by washing with water before and after drawing or simultaneously with drawing, a water-swollen precursor fiber bundle is obtained.

Bath drawing is generally conducted in a water bath at 50~98° C. once or in multiple procedures of twice or more. When considering characteristics of the obtained carbon-fiber bundle, it is preferred to draw coagulated yarn to be 2~10 times as long after both air drawing and bath drawing procedures are done.

To apply an oil agent to a precursor fiber bundle, it is preferred to use a processed-oil solution for carbon-fiber precursor acrylic fiber prepared by dispersing an oil agent composition containing the oil agent of the present invention in water (hereinafter, simply referred to as a "processed-oil solution"). The average particle diameter of emulsified particles (micelles) when dispersed is preferred to be 0.01~0.3 μm.

If the average particle diameter of the emulsified particles is within the above range, the oil agent is applied more homogeneously on the surface of a precursor fiber bundle.

The average particle diameter of the emulsified particles in a processed-oil solution is measured using a laser diffraction/particle-size distribution analyzer (LA-910, made by Horiba Ltd.)

A processed-oil solution is prepared as follows, for example.

The oil agent according to the present invention and a nonionic surfactant or the like are mixed to make an oil agent composition, and water is added to the agent composition while the mixture is being stirred. Accordingly, an emulsion (water-based emulsion) in which the oil agent composition is dispersed in water is obtained.

If an antioxidant is added, the antioxidant is preferred to be dissolved in advance in the oil agent.

Mixing or dispersing each component in water is performed using a propeller agitator, homo mixer, homogenizer or the like. Especially when a water-based emulsion (water-based emulsified solution) is prepared using a highly viscous oil agent composition, it is preferred to use a super-pressure homogenizer capable of pressurizing at 150 MPa or higher.

The concentration of the oil agent composition in a water-based emulsion is preferred to be 2~40 mass %, more preferably 10~30 mass %, even more preferably 20~30 mass %. If the concentration of the oil agent composition is set at 2 mass % or higher, it is easier to apply a necessary amount of the oil agent on a water-swollen precursor fiber bundle. On the other hand, if the concentration is 40 mass % or less, the emulsion has excellent stability.

As for a processed-oil solution, it is an option for the obtained emulsion to be used as is, but the emulsion is preferred to be further diluted to a certain concentration level and used as a processed-oil solution.

Here, a "certain concentration level" is prepared depending on the condition of a precursor fiber bundle during the oil processing.

The oil agent is applied to a precursor fiber bundle by applying the processed-oil solution to a water-swollen precursor fiber bundle that has been drawn in a bath.

When a bundle is washed after the drawing-bath process, the processed-oil solution may also be applied to the water-swollen fiber bundle after the drawing-bath and washing process.

For applying a processed-oil solution to a water-swollen precursor fiber bundle, well-known methods such as follows may be used: a roller application method in which the lower portion of a roller is immersed in a processed-oil solution and a precursor fiber bundle is brought into contact with the upper portion of the roller; a guide application method in which a predetermined amount of a processed-oil solution is discharged from a guide using a pump and a precursor fiber bundle is brought into contact with the guide surface; a spraying method in which a predetermined amount of a processed-oil solution is jet-sprayed from a nozzle onto a precursor fiber bundle; and a dipping method in which a precursor fiber bundle is dipped in a processed-oil solution and squeezed using a roller or the like so that an excess oil solution is removed.

Among those, a dipping method is preferred when considering homogeneous application, since a processed-oil solution is infiltrated well into a precursor fiber bundle and an excess amount of the solution is squeezed out. For even better homogeneous application, it is effective to conduct the oil processing multiple times so as to apply the solution repeatedly.

After the oil application, the precursor fiber bundle is subjected to a drying and densification process in a drying step.

Although the temperature for drying and densification needs to be higher than the glass transition temperature of the fiber, such a temperature may actually differ depending on how wet or dry the fiber conditions are. For example, a drying and densification process is preferred to be conducted by a hot roller at approximately 100~200° C. The number of hot rollers may be one or more.

The precursor fiber bundle after drying and densification is preferred to be subjected to a pressurized steam drawing process using a hot roller. The density and orientation of the obtained carbon-fiber precursor acrylic fiber bundle are further enhanced.

Here, pressurized steam drawing is a method for drawing fiber under a pressurized steam atmosphere. Since a high drawing rate is achieved from pressurized steam drawing, stable spinning is conducted at a higher speed while the resultant fiber density and orientation are improved.

In pressurized steam drawing processing, the temperature of the hot roller positioned directly before the pressurized steam drawing apparatus is preferred to be set at 120~190° C., and the fluctuation rate of steam pressure during pressurized steam drawing is preferred to be 0.5% or lower. By controlling the temperature of a hot roller and the fluctuation rate of steam pressure, fluctuation in draw rates of fiber bundles and the resultant tow fineness are controlled. If the temperature of a hot roller is lower than 120° C., the temperature of a precursor fiber bundle does not rise enough to cause lowered stretchability.

The steam pressure in pressurized steam drawing is preferred to be 200 kPa·g or higher (gauge pressure, the same as in the reference below) so that drawing by a hot roller is controlled and characteristics of the pressurized steam drawing are expressed clearly. The steam pressure is preferred to be adjusted properly depending on the processing duration. Since the amount of steam leakage may increase under high pressure, 600 kPa·g or lower is preferred for industrial production.

A carbon-fiber precursor acrylic fiber bundle obtained after drying and densification and a secondary drawing by a hot roller is cooled to room temperature by passing it over a room-temperature roller and then is wound on a bobbin by using a winder or is housed in a can.

The amount of oil agent composition adhered to such a carbon-fiber precursor acrylic fiber bundle obtained as above is preferred to be 0.1~2.0 mass %, more preferably 0.3~1.8 mass %, of the dry fiber mass. To sufficiently express the original functions of an oil agent composition, the amount of adhered oil agent composition is preferred to be at least 0.1 mass %, but no greater than 2.0 mass %, to suppress the extra adhered oil agent composition from being polymerized during the heating process and causing adhesion among single fibers.

Here, "dry fiber mass" means the dry fiber mass of a precursor fiber bundle after a drying and densification process.

Furthermore, when the oil agent according to the present invention contains at least two types selected from among groups A, B, C, D, E and F, the amount of adhered oil agent is preferred to be 0.1~1.5 mass %, more preferably 0.3~1.3 mass % of the dry fiber mass. To sufficiently express the original functions of an oil agent, the amount of adhered oil agent is preferred to be at least 0.1 mass %, but no greater than 1.5 mass %, to suppress the extra adhered oil agent composition from being polymerized during the heating process and causing adhesion among single fibers.

When the oil agent according to the present invention contains a compound selected from among groups A, B, C, D, E and F as well as ester compound G or amino-modified silicone H, the amount of adhered compound selected from among groups A, B, C, D, E and F is preferred to be 0.1~1.5 mass % of the dry fiber mass, and more preferably, 0.2~1.3 mass % when considering the mechanical characteristics of the fiber. When the amount of adhered compound is within such a range, the thermal stability of the compound is effectively used to achieve excellent processability and enhanced characteristics of the resultant carbon fiber.

On the other hand, the amount of adhered ester compound G or amino-modified silicone H is preferred to be 0.01~1.2 mass % of the dry fiber mass, more preferably 0.02~1.1 mass %, considering mechanical characteristics. If the adhered amount is set within such a range, ester compound G or amino-modified silicone H is compatible with compound A-F, and thus the oil agent is applied homogeneously on the surface of a fiber bundle. Accordingly, their fusion preventability during stabilization is high, enhancing the mechanical characteristics of the resultant carbon fiber.

Especially, amino-modified silicone H is preferred to be 0.5 mass % of the dry fiber mass from the viewpoint of operating efficiency.

When an oil agent composition contains a nonionic surfactant, the amount of nonionic surfactant adhered to a carbon-fiber precursor acrylic fiber bundle is preferred to be 0.05~1.0 mass %, more preferably 0.05~0 5 mass %, of the dry fiber mass. If the amount of adhered nonionic surfactant is within such a range, it is easier to prepare an emulsion of the oil agent composition, and lowered bundling property of fiber bundles and foaming in the oil processing tank caused by an excess surfactant are suppressed.

When an oil agent composition contains an antioxidant, the amount of antioxidant adhered to a carbon-fiber precursor acrylic fiber bundle is preferred to be 0.01~0.1 mass %, more preferably 0.01~0.05 mass %, of the dry fiber mass. If the amount of adhered antioxidant is within such a range, sufficient antioxidant effects are achieved. Thus, compounds A-F and ester compound G adhered to a precursor fiber bundle in a process of manufacturing precursor fiber bundles will not be oxidized by heat from hot rolls or the like. In addition, an antioxidant added in such a range causes hardly any trouble when an emulsion of the oil agent composition is prepared.

Especially, when the oil agent of the present invention contains compound A, the amount of adhered oil agent composition is preferred be 0.1~2.0 mass %, more preferably 0.1~1.0 mass % of the dry fiber mass. To sufficiently express the original functions of an oil agent composition, the amount of adhered oil agent composition is preferred to be at least 0.1 mass %, but no greater than 2.0 mass %, to suppress the extra adhered oil agent composition from being polymerized during the heating process and causing adhesion among single fibers.

When the oil agent of the present invention contains compound A and ester compound G, the amount of adhered oil agent composition is preferred to be 0.1~2.0 mass %, preferably 0.1~1.0 mass %, of the dry fiber mass. If the amount of adhered oil agent composition is less than 0.1 mass %, expressing original functions of the oil agent composition may be difficult. On the other hand, if the amount of adhered oil agent composition exceeds 2.0 mass %, the extra adhered oil agent composition is polymerized during the heating process and may cause adhesion among single fibers.

In addition, the amount of compound A adhered to a carbon-fiber precursor acrylic fiber bundle is preferred to be 0.1~0.6 mass %, more preferably 0.2~0.5 mass %, of dry fiber mass, from the viewpoint of mechanical characteristics. When the amount of adhered compound A is within such a range, the thermal stability of compound A is effectively used to achieve excellent processability and enhanced characteristics of the resultant carbon fiber.

Further, the amount of ester compound G adhered to a carbon-fiber precursor acrylic fiber bundle is preferred to be 0.01~1.2 mass %, more preferably 0.02~0.5 mass %, of dry fiber mass, from the viewpoint of mechanical characteristics. When the amount of adhered ester compound G is within such a range, ester compound G is compatible with compound A, and thus the oil agent composition is applied homogeneously on the surface of a fiber bundle. Accordingly, its fusion preventability during stabilization is high, enhancing the mechanical characteristics of the resultant carbon fiber.

When the oil agent composition contains a nonionic surfactant, the amount of nonionic surfactant adhered to a carbon-fiber precursor acrylic fiber bundle is preferred to be 0.1~1.0 mass % of the dry fiber mass. If the amount of adhered nonionic surfactant is within such a range, it is easier to prepare an emulsion of the oil agent composition, and lowered bundling property of fiber bundles and foaming in the oil processing tank caused by an excess surfactant are suppressed.

In addition, the amount of adhered nonionic surfactant per dry fiber mass is preferred to be 20~150 parts by mass based on 100 total combined parts by mass of compound A and ester compound G per dry fiber mass. If the amount of adhered nonionic surfactant is within such a range, it is easier to prepare an emulsion of the oil agent composition, and lowered bundling property of fiber bundles and foaming in the oil processing tank caused by an excess surfactant are suppressed.

Furthermore, when an oil agent composition contains an antioxidant, the amount of the antioxidant adhered to a carbon-fiber precursor acrylic fiber bundle is preferred to be 0.01~0.1 mass % of the dry fiber mass. If the amount of adhered the antioxidant is within such a range, antioxidant effects are sufficiently obtained, and compound F and ester compound G adhered to a precursor fiber bundle will not be oxidized by the heat from hot rolls or the like in a process of manufacturing precursor fiber bundles. In addition, an antioxidant added in such a range causes hardly any trouble when an emulsion of the oil agent composition is prepared.

When the oil agent according to the present invention contains compound B and/or compound C, the amount of adhered oil agent composition is preferred to be 0.3~2.0 mass %, more preferably 0.6~1.5 mass %, of the dry fiber mass. To sufficiently express the original functions of an oil agent composition, the amount of adhered oil agent composition is preferred to be at least 0.3 mass %, but no greater than 2.0 mass %, to suppress the extra adhered oil agent composition from being polymerized during the heating process and causing adhesion among single fibers.

When the oil agent according to the present invention contains compound B and/or compound C and ester compound G, the amount of adhered oil agent composition is preferred to be 0.5~2.0 mass %, more preferably 0.7~1.5 mass %, of the dry fiber mass. If the amount of adhered oil agent composition is less than 0.5 mass %, expressing original functions of the oil agent composition may be difficult. On the other hand, if the amount of adhered oil agent composition exceeds 2.0 mass %, the extra adhered oil agent composition is polymerized during the baking process and may cause adhesion among single fibers.

In addition, the amount of adhered cyclohexanedicarboxylate is preferred to be 0.4~1.0 mass % of the dry fiber mass, and the amount of adhered ester compound G is preferred to be 0.1~0.6 mass % of the dry fiber mass. If the amount of adhered cyclohexanedicarboxylate is within such a range, the thermal stability of cyclohexanedicarboxylate is effectively utilized to contribute to excellent processability and enhanced characteristics of the subsequent carbon fiber. If the amount of adhered ester compound G is within the above range, the ester compound G and cyclohexanedicarboxylate are mixed well with each other and the oil agent composition is homogeneously applied on surfaces of fiber bundles, fusion preventability during stabilization is high, and mechanical characteristics of the subsequent carbon fibers are enhanced.

When the oil agent composition contains a nonionic surfactant and antioxidant, the nonionic surfactant is preferred to be adhered to a carbon-fiber precursor acrylic fiber bundle at 0.05~0.5 mass % of the dry fiber mass, and the antioxidant is preferred to be adhered at 0.01~0.05 mass % of the dry fiber mass. If the amount of adhered nonionic surfactant is within such a range, it is easier to prepare an emulsion of the oil agent composition, and lowered bundling property of fiber bundles and foaming in the oil processing tank caused by an excess surfactant are suppressed.

If the amount of the adhered antioxidant is within such a range, antioxidant effects are sufficiently obtained, and cyclohexanedicarboxylate and ester compound G adhered to a precursor fiber bundle will not be oxidized by heat from hot rollers or the like in a process of manufacturing precursor fiber bundles. In addition, an antioxidant added in such a range causes hardly any trouble when an emulsion of the oil agent composition is prepared.

When the oil agent of the present invention contains compound D and/or compound E, the amount of the adhered oil agent composition is preferred to be 0.1~2.0 mass %, more preferably 0.5~1.5 mass %, of the dry fiber mass. To sufficiently express the original functions of an oil agent composition, the amount of adhered oil agent composition is preferred to be at least 0.1 mass %, but no greater than 2.0 mass %, to suppress the extra adhered oil agent composition from being polymerized during the heating process and causing adhesion among single fibers.

When the oil agent of the present invention contains compound D and/or compound E and amino-modified silicone H, the amount of adhered oil agent composition is preferred to be 0.41~2.0 mass %, more preferably 0.5~1.5 mass %, of the dry fiber mass. If the amount of adhered oil agent composition is less than 0.41 mass %, expressing original functions of the oil agent composition may be difficult. On the other hand, if the amount of adhered oil agent composition exceeds 2.0 mass %, the extra adhered oil agent composition is polymerized during the heating process and may cause adhesion among single fibers.

The amount of adhered compound D and/or compound E is preferred to be 0.4~1.5 mass %, more preferably 0.5~1.5 mass %, of the dry fiber mass. If the amount of adhered compound D and/or compound E is at least 0.4 mass %, the original functions of the oil agent composition are easier to express. On the other hand, if the amount of adhered compound D and/or compound E is 1.5 mass % or less, it is easier to prevent the extra adhered oil agent composition from being polymerized during the heating process and causing adhesion among single fibers.

In addition, the amount of adhered amino-modified silicone H is preferred to be 0.01~0.5 mass %, more preferably 0.3~0.5 mass %, of the dry fiber mass. If the amount of adhered amino-modified silicone H is at least 0.01 mass %, sufficient fusion preventability in a stabilization process is easier to obtain, making it easier to obtain excellent mechanical characteristics. On the other hand, if the amount of adhered amino-modified silicone H is 0.5 mass % or less, such a range reduces the amount of silicon compounds which are produced from the amino-modified silicone H applied to a precursor fiber bundle and which may scatter in the heating process. Accordingly, the lowering of industrial productivity and a decrease in the quality of carbon-fiber bundles are likely to be suppressed.

When the oil agent composition contains a nonionic surfactant and antioxidant, the amount of adhered nonionic surfactant is preferred to be 0.1~0.3 mass % of the dry fiber mass, and the amount of adhered antioxidant is preferred to be 0.01~0.1 mass % of the dry fiber mass. If the amount of adhered nonionic surfactant is within such a range, it is easier to prepare an emulsion of the oil agent composition, and lowered bundling property of fiber bundles and foaming in the oil processing tank caused by an excess surfactant are suppressed.

If the amount of the adhered antioxidant is within such a range, antioxidant effects are sufficiently obtained, and compound D and/or compound E adhered to a precursor fiber bundle will not be oxidized by the heat from hot rollers or the like in a process of manufacturing precursor fiber bundles. In addition, an antioxidant added in such a range causes hardly any trouble when an emulsion of the oil agent composition is prepared.

When the oil agent of the present invention contains compound F, the amount of adhered oil agent composition is preferred to be 0.3~2.0 mass %, more preferably 0.6~1.5 mass %, of the dry fiber mass. To sufficiently express the original functions of an oil agent composition, the amount of adhered oil agent composition is preferred to be at least 0.3 mass %, but no greater than 2.0 mass %, to suppress the extra adhered oil agent composition from being polymerized during the heating process and causing adhesion among single fibers.

When the oil agent of the present invention contains compound F and ester compound G, the amount of adhered oil agent composition is preferred to be 0.1~2.0 mass %, more preferably 0.1~1.0 mass %, of the dry fiber mass. If the amount of adhered oil agent composition is less than 0.1 mass %, expressing original functions of the oil agent composition may be difficult. On the other hand, if the amount of adhered oil agent composition exceeds 2.0 mass %, the extra adhered oil agent composition is polymerized during the heating process and may cause adhesion among single fibers.

In addition, the amount of compound F adhered to a carbon-fiber precursor acrylic fiber bundle is preferred to be 0.1~0.5 mass % of the dry fiber mass, more preferably 0.25~0.45 mass % when considering mechanical characteristics. If the amount of adhered compound F is within such a range, the thermal stability of compound F is effectively utilized, thus resulting in excellent processability and enhanced characteristics of carbon fibers.

The amount of ester compound G adhered to a carbon-fiber precursor acrylic fiber bundle is preferred to be 0.01~1.0 mass % of the dry fiber mass, more preferably 0.2~0.5 mass % when considering mechanical characteristics. If the amount of adhered ester compound G is within the above range, the ester compound G and compound F are mixed well with each other and the oil agent composition is homogeneously applied on surfaces of fiber bundles, fusion preventability during stabilization is high, and mechanical characteristics of the resultant carbon fibers are enhanced.

When the oil agent composition contains a nonionic surfactant, the amount of nonionic surfactant adhered to a carbon-fiber precursor acrylic fiber bundle is preferred to be 0.1~0.3 mass % of the dry fiber mass. If the amount of adhered nonionic surfactant is within such a range, it is easier to prepare an emulsion of the oil agent composition, and lowered bundling property of fiber bundles and foaming in the oil processing tank caused by an excess surfactant are suppressed.

In addition, the amount of adhered nonionic surfactant per dry fiber mass is preferred to be 20~150 parts by mass based on 100 total combined parts by mass of adhered compound F and ester compound G per dry fiber mass. If the amount of adhered nonionic surfactant is within such a range, it is easier to prepare an emulsion of the oil agent composition, and lowered bundling property of fiber bundles and foaming in the oil processing tank caused by an excess surfactant are suppressed.

Furthermore, when an oil agent composition contains an antioxidant, the amount of the antioxidant adhered to a carbon-fiber precursor acrylic fiber bundle is preferred to be 0.01~0.1 mass % of the dry fiber mass. If the amount of adhered antioxidant is within such a range, antioxidant effects are sufficiently obtained, and compound F and ester compound G adhered to a precursor fiber bundle will not be oxidized by the heat from hot rollers or the like in a process of manufacturing precursor fiber bundles. In addition, an antioxidant added in such a range causes hardly any trouble when an emulsion of the oil agent composition is prepared.

The amount of adhered oil agent composition is obtained by the following.

Based on a Soxhlet extraction method using methyl ethyl ketone, methyl ethyl ketone heated at 90° C. to be vaporized is refluxed and is brought into contact with a carbon-fiber precursor acrylic fiber bundle for eight hours to extract the oil agent composition. Then, mass ($W_1$) of the carbon-fiber precursor acrylic fiber bundle dried at 105° C. for two hours prior to the extraction, and mass ($W_2$) of the carbon-fiber precursor acrylic fiber bundle dried at 105° C. for two hours after the extraction are each measured to obtain the amount of adhered oil agent composition using the following formula (i).

$$\text{adhered amount (mass \%) of oil agent composition} = (W_1 - W_2)/W_1 \times 100 \quad \text{(i)}$$

The amount of each component adhered to the carbon-fiber precursor acrylic fiber bundle is calculated from the amount of adhered oil agent composition and the component makeup of the oil agent composition.

The component makeup of the oil agent composition adhered to a carbon-fiber precursor acrylic fiber bundle is preferred to be the same as that of the prepared oil composition from the viewpoint of balancing the used amount and remaining amount of the oil agent composition in the oil processing tank.

The number of filaments of a carbon-fiber precursor acrylic fiber bundle is preferred to be 1000~300000, more preferably 3000~200000, even more preferably 12000~100000. If the number of filaments is fewer than 1000, production efficiency tends to decrease, and if the number of filaments is more than 300000, a homogeneous carbon-fiber precursor acrylic fiber bundle is hard to produce.

The greater the fineness of a single fiber in a carbon-fiber precursor acrylic fiber bundle, the greater the fiber diameter is in the obtained carbon-fiber bundle, and buckling distortion under compression stress is suppressed when the carbon-fiber bundle is used as reinforcing fiber of a composite material. From the viewpoint of improving compression strength, the greater the single fiber fineness, the better it is. However, if the single fiber fineness is greater, heating of the carbon-fiber precursor acrylic fiber bundle in a later-described stabilization process may produce uneven results. Thus, it is not preferable from the viewpoint of achieving homogeneous fiber. Considering those features, the single fiber fineness of a carbon-fiber precursor acrylic fiber bundle is preferred to be 0.6~3 dTex, more preferably 0.7~2.5 dTex, even more preferably 0.8~2.0 dTex.

A carbon-fiber precursor acrylic fiber bundle proceeds through the heating process, stabilization process, carbonization process, and graphitization and surface treatment if necessary, to become a carbon-fiber bundle.

In a stabilization process, the carbon-fiber precursor acrylic fiber bundle is heated under oxidization atmosphere to be converted to a stabilized fiber bundle.

Conditions for stabilization are to heat the bundle under tension at 200~400° C. in an oxidization atmosphere until the density becomes 1.28~1.42 g/cm$^3$, more preferably 1.29~1.40 g/cm$^3$. If the density is lower than 1.28 g/cm$^3$, single fiber fusion tends to occur in the subsequent carbonization process, causing yarn breakage during the carbonization process. Density greater than 1.42 g/cm$^3$ is not economically preferable since the duration of the stabilization process lengthens. Well-known oxidizing atmosphere such as air, oxygen and nitrogen dioxide are employed, but air is preferable for the sake of economy.

Examples of a stabilization apparatus are not limited to any specific type. Well-known methods using a hot air oven, bringing fiber bundles into contact with a heated solid surface, and the like may be employed. In a stabilization furnace (hot air oven), a carbon-fiber precursor acrylic fiber bundle introduced into the stabilization furnace is brought out of the furnace and U-turned by a U-turn roll disposed outside the furnace so that the fiber bundle passes through the furnace repeatedly. Alternatively, a fiber bundle makes contact intermittently in a method for bringing the bundle into contact with a heated solid surface.

The stabilized fiber bundle proceeds to the carbonization process.

The stabilized fiber bundle is carbonized under inert atmosphere to obtain a carbon fiber bundle. Carbonization is performed under inert atmosphere with the highest temperature set at 1000° C. or higher. To form an inert atmosphere, any inert gases such as nitrogen, argon and helium may be used, but nitrogen is preferred for the sake of economy.

At an initial phase of carbonization, namely, in a processing temperature range of 400~500° C., cleavage and cross-linking reactions occur in a polyacrylonitrile copolymer as a component of the fiber. To enhance the mechanical characteristics of a carbon-fiber bundle obtained in the final stage, the fiber temperature is preferred to be raised gradually at a programmed rate of no more than 300° C./min in such a temperature range.

In a processing temperature range of 500~900° C., thermal decomposition occurs in the polyacrylonitrile copolymer, and carbon structures are gradually formed. In such a phase of constructing carbon structures, the fiber bundle is preferred to be processed while it is drawn under tension because orientation rules of carbon structures are facilitated. Therefore, to control the programmed rate and drawing strength (tensile force) under 900° C., it is preferred to set a precarbonization process separate from the final carbonization process.

In a temperature range of 900° C. or higher, remaining nitrogen atoms are deleted and the carbon structure will grow, thus contracting the fiber as a whole. To express excellent mechanical characteristics in the final carbon fiber, heat treatment in a high temperature range is preferred to be performed under tension.

A graphitization process may be added if necessary to the carbon-fiber bundle obtained above. Graphitization enhances modulus of the carbon-fiber bundle.

Graphitization is preferred to be conducted while the fiber is drawn at a rate of 3~15% under inert atmosphere with the highest temperature set at 2000° C. or higher. If the stretching rate is lower than 3%, a highly high modulus carbon-fiber bundle (graphitized fiber bundle) with sufficient mechanical characteristics is hard to obtain. That is because the lower the stretching rate, the higher is the processing temperature required to obtain a carbon-fiber bundle with a predetermined modulus. On the other hand, if the stretching rate exceeds 15%, effects of stretching to facilitate the growth of carbon structures are different on the fiber surface and inside the fiber, causing irregular carbon fiber bundles to be formed with lowered physical properties.

Surface treatment for final purposes is preferred to be performed on the carbon-fiber bundles after the above heating process.

Surface treatment is not limited to any specific method, but electrolytic oxidation in an electrolyte solution is preferred. Surface improvement treatment through electrolytic oxidization is performed by generating oxygen on surfaces of carbon-fiber bundles to introduce functional groups containing oxygen atoms.

As for electrolytes, acids such as sulfuric acid, hydrochloric acid and nitric acid and their salts may be used.

Conditions for electrolytic oxidation are preferred to be an electrolyte temperature at room temperature or lower, an electrolyte concentration of 1~15 mass %, and amount of electricity of 100 coulomb/g or less.

As described so far, since the oil agent or oil agent composition according to the present invention is adhered to carbon-fiber precursor acrylic fiber bundles, the carbon-fiber precursor acrylic fiber bundles of the present invention show an excellent bundling property. Application of such oil agent or oil agent composition prevents fusion among single fibers during the heating process, and silicon compounds are suppressed from being produced while decomposed silicon is suppressed from scattering. Thus, operating efficiency and processability are significantly improved, and industrial productivity is maintained. Accordingly, carbon-fiber bundles with excellent mechanical characteristics are obtained at a high yield. Using carbon-fiber precursor acrylic fiber bundles of the present invention solves both problems caused by conventional silicone-based oil agents and problems caused by conventional oil agent compositions that contain a low silicone content or contain only non-silicone components.

Carbon-fiber bundles obtained by heating carbon-fiber precursor acrylic fiber bundles are high quality with excellent mechanical properties, and are suitable for reinforcing fiber to be used in fiber-reinforced resin composite material for various structural applications.

EXAMPLES

In the following, examples of the present invention are described in detail. However, the present invention is not limited to those examples.

Components, measuring methods, and evaluation methods used for examples are shown below.

<Components>

(Hydroxybenzoate)

A-1: ester compound of 4-hydroxybenzoate and oleyl alcohol (molar ratio of 1.0:1.0) (ester compound structured as in formula (1a) above, in which $R^{1a}$ is an octadecenyl group (oleyl group)).

Method for Synthesizing A-1

Using a 1 L four-neck flask, 207 grams (1.5 mol) of 4-hydroxybenzoate, 486 grams (1.8 mol) of oleyl alcohol and 0.69 grams (0.1 mass %) of stannous octylic acid as a catalyst were measured into the flask, and esterification reactions were carried out at 200° C. for six hours and further at 220° C. for five hours under nitrogen flow.

Then, excess alcohol was removed under conditions of 230° C. at reduced pressure of 666.61 Pa while steam was blown in. Then, the mixture was cooled to 70~80° C., to which 0.43 grams of 85 mass % phosphoric acid was added. The mixture was stirred for 30 minutes and then filtered to obtain A-1.

<Cyclohexanedicarboxylate>

B-1: ester compound of 1,4-cyclohexane dicarboxylic acid and oleyl alcohol (molar ratio of 1.0:2.0) (ester compound structured as in formula (1b) above, in which $R^{1b}$ and $R^{2b}$ are each an oleyl group).

C-1: ester compound of 1,4-cyclohexane dicarboxylic acid, oleyl alcohol and 3-methyl-1,5-pentadiol (molar ratio of 2.0:2.0:1.0) (ester compound structured as in formula (2b)

above, in which $R^{3b}$ and $R^{5b}$ are each an oleyl group, and $R^{4b}$ is —$CH_2CH_2CHCH_3CH_2CH_2$—).

C-2: ester compound of 1,4-cyclohexane dicarboxylic acid, oleyl alcohol and polyoxytetramethylene glycol (mean molecular weight of 250) (molar ratio of 2.0:2.0:1.0) (ester compound structured as in formula (2b) above, in which $R^{3b}$ and $R^{5b}$ are each an oleyl group, and $R^{4b}$ is —$(CH_2CH_2CH_2CH_2O)_{nb}$—, and "nb" is 3.5).

Method for Synthesizing B-1

Using a 1 L four-neck flask, 180 grams (0.9 mol) of 1,4-methylcyclohexanedicarboxylate (Kokura Synthetic Industries, Ltd.), 486 grams (1.8 mol) of oleyl alcohol (brand name Rikacol 90B, New Japan Chemical Co., Ltd.) and 0.33 grams of dibutyl tin oxide as a catalyst (Wako Pure Chemical Industries, Ltd.) were measured into the flask, and demethanol reactions were carried out at 200~205° C. under nitrogen flow. The amount of distilled methanol was 57 grams.

Then, the mixture was cooled to 70~80° C., to which 0.34 grams of 85 mass % phosphoric acid (Wako Pure Chemical Industries, Ltd.) was added. The mixture was stirred for 30 minutes until the reaction system was confirmed clouded. Then, 1.1 grams of an adsorbant (brand name: Kyoward 600S, Kyowa Chemical Industry, Ltd.) was added and the mixture was stirred for 30 minutes and filtered to obtain B-1.

Method for Synthesizing C-1

Using a 1 L four-neck flask, 240 grams (1.2 mol) of 1,4-methyl cyclohexanedicarboxylate (Kokura Synthetic Industries, Ltd.), 324 grams (1.2 mol) of oleyl alcohol (brand name Rikacol 90B, New Japan Chemical Co., Ltd.), 70.8 grams (0.6 mol) of 3-methyl-1,5-pentadiol (Wako Pure Chemical Industries, Ltd.), and 0.32 grams of dibutyl tin oxide as a catalyst (Wako Pure Chemical Industries, Ltd.) were measured into the flask, and demethanol reactions were carried out at 200~205° C. under nitrogen flow. The amount of distilled methanol was 76 grams.

Then, the mixture was cooled to 70~80° C., to which 0.33 grams of 85 mass % phosphoric acid (Wako Pure Chemical Industries, Ltd.) was added. The mixture was stirred for 30 minutes until the reaction system was confirmed clouded. Then, 1.1 grams of an adsorbant (brand name: Kyoward 600S, Kyowa Chemical Industry, Ltd.) was added and the mixture was stirred for 30 minutes and filtered to obtain C-1.

Method for Synthesizing C-2

Using a 1 L four-neck flask, 240 grams (1.2 mol) of 1,4-methyl cyclohexanedicarboxylate (Kokura Synthetic Industries, Ltd.), 324 grams (1.2 mol) of oleyl alcohol (brand name Rikacol 90B, New Japan Chemical Co., Ltd.), 150 grams (0.6 mol) of polyoxytetramethylene glycol (mean molecular weight of 250, BASF), and 0.36 grams of dibutyl tin oxide as a catalyst (Wako Pure Chemical Industries, Ltd.) were measured into the flask, and demethanol reactions were carried out at 200~205° C. under nitrogen flow. The amount of distilled methanol was 76 grams.

Then, the mixture was cooled to 70~80° C., to which 0.37 grams of 85 mass % phosphoric acid (Wako Pure Chemical Industries, Ltd.) was added. The mixture was stirred for 30 minutes until the reaction system was confirmed clouded. Then, 1.3 grams of an adsorbant (brand name: Kyoward 600S, Kyowa Chemical Industry, Ltd.) was added and the mixture was stirred for 30 minutes and filtered to obtain C-2.

Ester compounds B-1, C-1 and C-2 above were synthesized through demethanol reactions by a transesterification method. However, they are also prepared by esterification reactions of 1,4-cyclohexanedicarboxylic acid and alcohol.

<Cyclohexanedimethanol Ester/Cyclohexanediol Ester>

D-1: ester compound of 1,4-cyclohexanedimethanol and oleic acid (molar ratio of 1.0:2.0) (ester compound structured as in formula (1c) above, in which $R^{1c}$ and $R^{2c}$ are each an alkenyl group having 17 carbon atoms (heptadecenyl group) and "nc" is 1).

E-1: ester compound of 1,4-cyclohexanedimethanol, oleic acid and dimer acid obtained by dimerizing oleic acid (molar ratio of 1.0:1.25:0.375) (ester compound structured as in formula (2c) above, in which $R^{3c}$ and $R^{5c}$ are each an alkenyl group having 17 carbon atoms (heptadecenyl group), $R^{4c}$ is a substituted group obtained by removing a hydrogen atom from the carbon atom in an alkenyl group having 34 carbon atoms (tetratriacontane group and "mc" is 1).

D-2: ester compound of 1,4-cyclohexanedimethanol, oleic acid and caprylic acid (molar ratio of 1.0:0.5:1.5) (ester compound structured as in formula (1c) above, in which $R^{1c}$ is a mixture of an alkenyl group having 17 carbon atoms (heptadecenyl group) and an alkyl group having seven carbon atoms (n-heptyl group), $R^{2c}$ is a mixture of a heptadecenyl group and an n-heptyl group, and "nc" is 1).

D-3: ester compound of 1,4-cyclohexanediol and oleic acid (molar ratio of 1.0:2.0).

E-2: ester compound of 1,4-cyclohexanediol, oleic acid and dimer acid obtained by dimerizing oleic acid (molar ratio of 1.0:1.25:0.375)

Method for Synthesizing D-1

Using a 1 L four-neck flask, 144 grams (1.0 mol) of 1,4-cyclohexanedimethanol (Wako Pure Chemical Industries, Ltd.), 580 grams (2.0 mol) of oleic acid (brand name: Lunac O-A, Kao Corporation), and 0.35 grams of dibutyl tin oxide (Wako Pure Chemical Industries) as a catalyst were measured into the flask, and esterification reactions were carried out at 220~230° C. under nitrogen flow. The reactions were continued until the acid value of the reaction system became 10 mg KOH/g or lower.

Next, the mixture was cooled to 70~80° C., to which 0.36 grams of 85 mass % phosphoric acid (Wako Pure Chemical Industries, Ltd.) was added. The mixture was stirred for 30 minutes until the reaction system was confirmed clouded. Then, 1.3 grams of an adsorbant (brand name: Kyoward 600S, Kyowa Chemical Industry, Ltd.) was added, and the mixture was stirred for 30 minutes and filtered to obtain D-1.

Method for Synthesizing D-2

Using a 1 L four-neck flask, 144 grams (1.0 mol) of 1,4-cyclohexanedimethanol (Wako Pure Chemical Industries, Ltd.), 145 grams (0.5 mol) of oleic acid (brand name: Lunac O-A, Kao Corporation), 216 grams (1.5 mol) of acrylic acid (brand name: Octanoic Acid, Wako Pure Chemical Industries, Ltd.) and 0.35 grams of dibutyl tin oxide (Wako Pure Chemical Industries) as a catalyst were measured into the flask. Under the same conditions as for D-1 under nitrogen flow, D-2 was obtained.

Method for Synthesizing D-3

Using a 1 L four-neck flask, 116 grams (1.0 mol) of 1,4-cyclohexanediol (Wako Pure Chemical Industries, Ltd.), 560 grams (2.0 mol) of oleic acid (brand name: Lunac O-A, Kao Corporation), and 0.34 grams of dibutyl tin oxide (Wako Pure Chemical Industries) as a catalyst were measured into the flask, and esterification reactions were carried out at 220~230° C. under nitrogen flow. The reactions were continued until the acid value of the reaction system became 10 mg KOH/g or lower.

Next, the mixture was cooled to 70~80° C., to which 0.35 grams of 85 mass % phosphoric acid (Wako Pure Chemical Industries, Ltd.) was added. The mixture was stirred for 30 minutes until the reaction system was confirmed clouded. Then, 1.3 grams of an adsorbant (brand name: Kyoward 600S, Kyowa Chemical Industry, Ltd.) was added and the mixture was stirred for 30 minutes and filtered to obtain ester compound D-3.

Method for Synthesizing E-1

Using a 1 L four-neck flask, 144 grams (1.0 mol) of 1,4-cyclohexanedimethanol (Wako Pure Chemical Industries, Ltd.), 350 grams (1.25 mol) of oleic acid (brand name: Lunac O-A, Kao Corporation), 213.8 grams (0.375 mol) of dimer acid (Sigma-Aldrich Japan K.K.), and 0.35 grams of dibutyl tin oxide (Wako Pure Chemical Industries) as a catalyst were measured into the flask. Under the same conditions as for D-1 under nitrogen flow, E-1 was obtained.

Method for Synthesizing E-2

Using a 1 L four-neck flask, 116 grams (1.0 mol) of 1,4-cyclohexanediol (Wako Pure Chemical Industries, Ltd.), 350 grams (1.25 mol) of oleic acid (brand name: Lunac O-A, Kao Corporation), 213.8 grams (0.375 mol) of dimer acid (Sigma-Aldrich Japan K.K.), and 0.34 grams of dibutyl tin oxide (Wako Pure Chemical Industries) as a catalyst were measured into the flask. Under the same conditions as for ester compound D-3 under nitrogen flow, ester compound E-2 was obtained.

<Isophoronendiisocyanate-Aliphatic Alcohol Adduct>

F-1: a compound of 3-isocyanatomethyl-3,5,5-trimethylcyclohexyl=isocyanate and oleyl alcohol (molar ratio of 1.0:2.0) (compound structured as in formula (1d) above, in which $R^{1d}$ and $R^{4d}$ are each an octadecenyl group (oleyl group), and "nd" and "md" are each zero).

Method for Synthesizing F-1

Using a 3 L four-neck flask, 1970 grams (7.2 mol) of oleyl alcohol was measured into the flask. At room temperature under nitrogen flow, 800 grams (3.6 mol) of 3-isocyanatomethyl-3,5,5-trimethylcyclohexyl=isocyanate was dropped using a dropping funnel while the mixture was stirred. Then, the mixture was reacted at 100° C. for 10 hours to obtain F-1.

(Ester Compound (Aromatic Ester) G Having One or Two Aromatic Rings)

G-1: tri-isodecyl trimellitate (brand name: Trimex T-10, Kao Corporation) (compound structured as in formula (1e) above, in which $R^{1e}$~$R^{3e}$ are each an isodecyl group).

G-2: polyoxyethylene bisphenol A lauric acid ester (brand name: Exceparl BP-DL, Kao Corporation) (compound structured as in formula (2e) above, in which $R^{4e}$ and $R^{5e}$ are each a dodecyl group (lauryl group), and "oe" and "pe" are each approximately 1).

G-3: dioctyl phthalate (product code: D201154, Sigma-Aldrich Japan K.K.).

(Amino-Modified Silicone H)

H-1: amino-modified silicone structured as in formula (3e) above, having a viscosity of 90 $mm^2/s$ at 25° C. and the amino equivalent of 2500 g/mol (brand name: AMS-132, Gelest, Inc.)

H-2: dual-end amino-modified silicone (brand name: DMS-A21, Gelest, Inc.)

H-3: amino-modified silicone structured as in formula (3e) above, having a viscosity of 110 $mm^2/s$ at 25° C. and the amino equivalent of 5000 g/mol (brand name: KF-868, Shin-Etsu Chemical Co., Ltd.).

H-4: amino-modified silicone structured as in formula (3e) above, having a viscosity of 450 $mm^2/s$ at 25° C. and the amino equivalent of 5700 g/mol (brand name: KF-8008, Shin-Etsu Chemical Co., Ltd.).

H-5: amino-modified silicone with primary and primary/secondary side-chain amines, having a viscosity of 10000 $mm^2/s$ at 25° C. and the amino equivalent of 7000 g/mol (brand name: TSF 4707, Momentive Performance Materials Japan LLC)

H-6: primary side-chain amino-modified silicone (brand name: KF-865, Shin-Etsu Chemical Co., Ltd.)

H-7: amino-modified silicone having a viscosity of 90 $mm^2/s$ at 25° C. and the amino equivalent of 2200 g/mol (brand name: KF-8012, Shin-Etsu Chemical Co., Ltd.).

H-8: amino-modified silicone having a viscosity of 90 $mm^2/s$ at 25° C. and the amino equivalent of 4400 g/mol (product code: 480304, Sigma-Aldrich Japan K.K.).

(Aliphatic Esters (Chain Aliphatic Esters))

J-1: triisooctadecan acid trimethylolpropane (Wako Pure Chemical Industries, Ltd.)

J-2: pentaerythritol tetrastearate (product code: P0739, Tokyo Chemical Industry Co., Ltd.)

J-3: polyethylene glycol diacrylate (brand name: BLEMMER ADE-150, NOF Corporation)

J-4: pentaerythritol tetrastearate (brand name: UNISTER H-476, NOF Corporation)

(Nonionic Surfactant (Nonionic Emulsifier))

K-1: PO/EO polyether block copolymer structured as in formula (4e) above, in which "xe"≈75, "ye"≈30, "ze"≈75, and $R^{6e}$ and $R^{7e}$ are each a hydrogen atom (brand name: Newpol PE-68, Sanyo Chemical Industries).

K-2: polyoxyethylene lauryl ether structured as in formula (5e) above, in which "te"≈9, and $R^{8e}$ is a lauryl group (brand name: NIKKOL BL-9EX, Wako Pure Chemical Industries Ltd.).

K-3: polyoxyethylene lauryl ether structured as in formula (5e) above, in which "te"≈7, and $R^{8e}$ is a lauryl group (brand name: EMALEX 707, Nihon-Emulsion Co., Ltd.).

K-4: polyoxyethylene (9) lauryl ether structured as in formula (5e) above, in which "te"=9, and $R^{8e}$ is a dodecyl group (brand name: Emulgen 109P, Kao Corporation).

K-5: PO/EO polyether block copolymer structured as in formula (4e) above, in which "xe"=10, "ye"=20, "ze"=10, and $R^{6e}$ and $R^{7e}$ are each a hydrogen atom (brand name: Adeka Pluronic L-44, Adeka Corporation).

K-6: PO/EO polyether block copolymer structured as in formula (4e) above, in which "xe"=75, "ye"=30, "ze"=75, and $R^{6e}$ and $R^{7e}$ are each a hydrogen atom (brand name: Pluronic PE 6800, BASF Japan).

K-7: nonaethylene glycol dodecyl ether structured as in formula (4e) above, in which "te"=9, and $R^{8e}$ is a dodecyl group (brand name: NIKKOL BL-9EX, Nikko Chemicals).

K-8: PO/EO polyether block copolymer structured as in formula (4e) above, in which "xe"=180, "ye"=70, "ze"=180, and $R^{6e}$ and $R^{7e}$ are each a hydrogen atom (brand name: Newpol PE-128, Sanyo Chemical Industries).

K-9: PO/EO polyether block copolymer structured as in formula (4e) above, in which "xe"=25, "ye"=35, "ze"=25, and $R^{6e}$ and $R^{7e}$ are each a hydrogen atom (brand name: Adeka Pluronic P-75, Adeka Corporation).

(Antioxidant)

L-1: n-octadecyl-3-(3,5-di-t-butyl-4-hydroxyphenyl)propionate (brand name: Tominox SS, API Corporation)

L-2: tetrakis[methylene-3-(3,5-di-t-butyl-4-hydroxyphenyl) propionate]methane (brand name: Tominox TT, API Corporation)

(Antistatic Agent)

M-1: dialkylethylmethyl ammonium ethosulfate (brand name: Arquad 2HT-50ES, Lion Akzo Co., Ltd.)

M-2: lauryl trimethyl ammonium chloride (brand name: QUARTAMIN 24P, Kao Corporation)

M-3: N-methyl N,N-dimethyl-9-octadecene-1-aminium-(ethyl sulfate)anion (Hangzou Sage Chemical Co., Ltd.)

<Measurement/Evaluation>

(Measurement of the Amount of Adhered Oil Agent)

After a carbon-fiber precursor acrylic fiber bundle is dried at 105° C. for two hours, based on a Soxhlet extraction method using methyl ethyl ketone, methyl ethyl ketone heated at 90° C. to be vaporized is refluxed and is brought into contact with a carbon-fiber precursor acrylic fiber bundle for eight hours to extract the oil agent composition into a solvent. The amount of methyl ethyl ketone is determined to be sufficient to extract the oil agent composition adhered to the carbon-fiber precursor acrylic fiber bundle.

Mass ($W_1$) of the carbon-fiber precursor acrylic fiber bundle dried at 105° C. for two hours prior to the extraction, and mass ($W_2$) of the carbon-fiber precursor acrylic fiber bundle dried at 105° C. for two hours after the extraction are each measured to obtain the amount of adhered oil agent composition using the formula (1) above. The amount of the adhered oil agent is measured to confirm that the oil agent composition is adhered to a precursor fiber bundle in a range appropriate to express the effect of applied oil agent composition.

(Evaluation of Bundling Property)

Visual inspection was conducted on carbon-fiber precursor acrylic fiber bundles on a final roller in the production process of carbon-fiber precursor acrylic fiber bundles, namely on the roller directly before the fiber bundles are wound on a bobbin. The fiber bundling property was evaluated using the following evaluation criteria. Bundling Property evaluation is done to determine the quality of carbon-fiber precursor acrylic fiber bundles in consideration of the productivity of carbon-fiber precursor acrylic fiber bundles and the ease of handling in the subsequent carbonization process.

A: converged, the tow width is constant and adjacent fiber bundles are not in contact with each other.

B: converged, but the tow width is not constant, or the tow width is wider.

C: not converged, space is observed in a fiber bundle.

(Evaluation of Operating Efficiency)

Operating efficiency was evaluated by how often single fibers are wound around transport rollers and are removed when carbon-fiber precursor acrylic fiber bundles are produced continuously for 24 hours. The evaluation criteria were as follows. Evaluated operating efficiency is used as an index of production stability of carbon-fiber precursor acrylic fiber bundles.

A: the number of times removed (times/24 hours) is one or fewer.

B: the number of times removed (times/24 hours) is two to five.

C: the number of times removed (times/24 hours) is six or greater.

(Measuring the Number of Fusions)

A carbon-fiber bundle was cut into 3-mm lengths, and dispersed in acetone, which was stirred for 10 minutes. Then, the total number of single fibers and the number of fusions (fused number) were counted to determine the number of fused fibers per 100 single fibers. Evaluation was based on the following criteria. Measuring the number of fused single fibers is done to evaluate the quality of carbon-fiber bundles.

A: the number of fused fibers (per 100 single fibers) is 1 or fewer.

C: the number of fused fibers (per 100 single fibers) is greater than 1.

(Measuring CF Tensile Strength)

After production of carbon-fiber bundles has started, and when the production is stable and constant, carbon-fiber bundles are picked out for sampling. The CF tensile strength of the sample was measured according to epoxy resin-impregnated strand testing specified in JIS-R-7608. The test was repeated 10 times and the average value was used for evaluation.

(Measurement of Scattered Amount of Si)

Using an ICP optical emission spectrometer, the amount of silicon compound derived from silicone scattered during stabilization is measured from the silicon (Si) content in a carbon-fiber precursor acrylic fiber bundle and in the stabilized fiber bundle after stabilization was conducted. The amount of silicon scattered during the stabilization process is determined by calculating the difference in the silicon content. The scattered amount of Si was used as an evaluation index.

In particular, a carbon-fiber precursor acrylic fiber bundle and a stabilized fiber bundle were each finely ground with scissors to make samples, 50 mg each of the samples was weighed in a sealed crucible, and 0.25 grams each of powdered NaOH and KOH was added to the samples, which were then heated for thermal decomposition in a muffle furnace at 210° C. for 150 minutes. Then, the decomposed fibers were dissolved in distilled water to make 100 mL each of measurement samples. The Si content of each sample was obtained using ICP emission spectrometry, and the scattered amount of Si was calculated by the formula (ii) below.

For the ICP optical emission spectrometer, "Iris Advantage AP" made by Thermo Electron Corporation was used.

$$\text{Scattered amount of Si (mg/kg)} = \text{Si content in carbon-fiber precursor acrylic fiber bundle} - \text{Si content in stabilized fiber bundle} \quad \text{(ii)}$$

(Measuring Amount of Remaining Oil Agent)

A stabilized fiber bundle was dried at 105° C. for two hours to measure the mass ($W_3$) of the fiber bundle.

Next, the dried stabilized fiber bundle was subjected to a reflux of a mixture of chloroform and methanol (volume ratio of 1:1) for eight hours in a Soxhlet extractor. Then, the stabilized fiber bundle was washed with methanol and immersed in 98% concentrated sulfuric acid for 12 hours at room temperature (25° C.) to remove the oil agent composition and its derivative remaining in the stabilized fiber bundle. After that, the fiber bundle was washed again thoroughly with methanol and dried at 105° C. for an hour. The mass ($W_4$) of the fiber bundle was measured and the amounts of oil agent and its derivative remaining in the stabilized fiber bundle (remaining amount of oil agent) were determined by formula (iii) below. The purpose of measuring the remaining amount of oil agent is to evaluate whether or not the effect of the oil agent composition to prevent fusion among single fibers is maintained until the completion of the stabilization process.

$$\text{remaining amount of oil agent(mass \%)} = (1 - W_4/W_3) \times 100 \quad \text{(iii)}$$

Example 1-1

(Preparing Oil Agent Composition and Processed-Oil Solution)

Ester compound (A-1) and ester compound (B-1) were mixed and stirred to prepare an oil agent. Nonionic surfactants (K-1, K-3) were added to the mixture and stirred to prepare an oil agent composition.

After the oil agent composition was thoroughly stirred, ion-exchange water was further added to set the concentration of the oil agent composition at 30 mass %, and the mixture was emulsified by a homo-mixer. The mean particle diameter of the micelles at that time was measured by a laser diffraction/scattering particle-size distribution analyzer (brand name: LA-910, Horiba Ltd.) and found to be approximately 3.0 μm.

Next, using a high-pressure homogenizer, the oil agent composition was dispersed until the mean particle diameter of the micelles became 0.3 μm or smaller, and an emulsion of the oil agent composition was obtained. The emulsion was further diluted with ion-exchange water to prepare a processed-oil solution with an oil agent composition concentration of 1.3 mass %.

Types and amounts (mass %) of components in the oil agent composition are shown in Table 1.

(Producing Carbon-Fiber Precursor Acrylic Fiber Bundle)

A precursor fiber bundle to apply the oil agent was prepared as follows. An acrylonitrile-based copolymer (composition ratio: acrylonitrile/acrylamide/methacrylic acid=96.5/2.7/0.8 (mass ratio)) was dispersed in dimethylacetamide at a rate of 21 mass % and dissolved by heating to prepare a spinning dope solution. In a 38° C. coagulation bath filled with a dimethylacetamide solution with a concentration of 67 mass %, the spinning dope solution was discharged from a spinning nozzle having 50000 holes with a hole diameter (diameter) of 50 μm to make coagulated fibers. The coagulated fibers were washed in a water tank to remove the solvent and were drawn to be three times as long to obtain a water-swollen precursor fiber bundle.

The water-swollen precursor fiber bundle was introduced into the oil-treatment tank filled with the processed-oil solution prepared as above to apply the oil agent onto the precursor fiber bundle.

The precursor fiber bundle with the applied oil agent was subjected to dry and densification using a roller with a surface temperature of 150° C., and steam drawing was performed under 0.3 MPa pressure to make the bundle five times as long. Accordingly, a carbon-fiber precursor acrylic fiber bundle was obtained. The number of filaments in the carbon-fiber precursor acrylic fiber bundle was 50000, and the single fiber fineness was 1.3 dTex.

Bundling property and operating efficiency during the production process were evaluated, and the amount of oil agent on the carbon-fiber precursor acrylic fiber bundle was measured. The results are shown in Table 1.

(Producing Carbon-Fiber Bundle)

The carbon-fiber precursor acrylic fiber bundle was subjected to heating in a stabilization furnace with a temperature gradient of 220~260° C. for 40 minutes to produce a stabilized fiber bundle.

Next, the stabilized fiber bundle was baked under a nitrogen atmosphere for three minutes while passing through a carbonization furnace with a temperature gradient of 400~1400° C. Accordingly, a carbon-fiber bundle was obtained.

The amount of Si scattered during stabilization was measured. Also, the number of fusions in the carbon-fiber bundle and the CF tensile strength were measured. The results are shown in Table 1.

Examples 1-2~1-7

Oil agent compositions and processed-oil solutions were prepared, and carbon-fiber precursor acrylic fiber bundles and carbon-fiber bundles were produced the same as in example 1-1 except that the types and amounts of components in each oil agent composition were changed as shown in Table 1. Then, the fiber bundles were each measured and evaluated. The results are shown in Table 1.

When an antistatic agent was added, the antistatic was emulsified to have a predetermined fine particle size before being added.

TABLE 1

| | | | example | | | | | | |
|---|---|---|---|---|---|---|---|---|---|
| | | | 1-1 | 1-2 | 1-3 | 1-4 | 1-5 | 1-6 | 1-7 |
| oil agent composition [mass %] | ester compound | A-1 | 10 | 20 | 30 | 45 | 25 | 25 | 25 |
| | | B-1 | 50 | 40 | — | — | 25 | 25 | — |
| | | C-1 | — | — | 30 | 10 | 25 | — | 25 |
| | nonionic surfactant | K-1 | 20 | 20 | — | — | — | — | — |
| | | K-2 | — | 20 | 20 | 20 | 24 | 20 | 45 |
| | | K-3 | 20 | — | 20 | 25 | — | 20 | — |
| | antistatic agent | M-1 | — | — | — | — | 1 | — | — |
| | | M-2 | — | — | — | — | — | 10 | — |
| | | M-3 | — | — | — | — | — | — | 5 |
| amount of adhered oil agent [mass %] | | | 1.0 | 0.9 | 0.8 | 1.1 | 1.0 | 0.9 | 0.8 |
| adhered amount of each component [mass %] | ester compound | A-1 | 0.1 | 0.18 | 0.24 | 0.5 | 0.25 | 0.23 | 0.2 |
| | | B-1 | 0.5 | 0.36 | — | — | 0.25 | 0.23 | — |
| | | C-1 | — | — | 0.24 | 0.11 | 0.25 | — | 0.2 |
| | nonionic surfactant | K-1 | 0.2 | 0.18 | — | — | — | — | — |
| | | K-2 | — | 0.18 | 0.16 | 0.22 | 0.24 | 0.18 | 0.36 |
| | | K-3 | 0.2 | — | 0.16 | 0.28 | — | 0.18 | — |
| | antistatic agent | M-1 | — | — | — | — | 0.01 | — | — |
| | | M-2 | — | — | — | — | — | 0.09 | — |
| | | M-3 | — | — | — | — | — | — | 0.04 |
| evaluation | bundling property | | A | A | A | A | A | A | A |
| | operating efficiency | | A | A | A | A | A | A | A |
| | number of fusions | | A | A | A | A | A | A | A |
| | CF tensile strength [GPa] | | 5.1 | 5.2 | 5.3 | 5.1 | 5.2 | 5.3 | 5.4 |
| | amount of scattered Si [mg/kg] | | 0 | 0 | 0 | 0 | 0 | 0 | 0 |

As clearly shown in Table 1, the amount of adhered oil agent was appropriate in each example. The bundling property of carbon-fiber precursor acrylic fiber bundles and operating efficiency in the production process were excellent. In all the examples, no operational issues were identified that would affect the continuous production of carbon-fiber bundles.

Also, substantially no fused fiber was found among single fibers in the carbon-fiber bundles produced in each example, the CF tensile strength was high, and mechanical characteristics were excellent. In addition, since no silicone was contained, the amount of Si scattered in the heating process was substantially zero. Thus, the process load in the heating process was low.

Differences were observed in the CF tensile strength of a carbon-fiber bundle depending on the component types and amounts in each oil agent composition. The CF tensile strength of carbon fibers was especially high in example 1-3 containing 30 mass % each of ester compounds (A-1) and (C-1), example 1-6 containing 25 mass % each of ester compounds (A-1) and (B-1), and example 1-7 containing 25 mass % each of ester compounds (A-1) and (C-1).

Example 1-8

(Preparing Oil Agent Composition and Processed-Oil Solution)

Ester compound (A-1) and ester compound (D-1) were mixed and stirred to prepare an oil agent. Nonionic surfactants (K-1, K-3) were added to the mixture and stirred to prepare an oil agent composition.

After the oil agent composition was thoroughly stirred, ion-exchange water was further added to set the concentration of the oil agent composition at 30 mass %, and the mixture was emulsified by a homo-mixer. The mean particle diameter of the micelles at that time was measured by a laser diffraction/scattering particle-size distribution analyzer (brand name: LA-910, Horiba Ltd.) and found to be approximately 3.0 μm.

Next, using a high-pressure homogenizer, the oil agent composition was dispersed until the mean particle diameter of the micelles became 0.3 μm or smaller, and an emulsion of the oil agent composition was obtained. The emulsion was further diluted with ion-exchange water to prepare a processed-oil solution with an oil agent composition concentration of 1.3 mass %.

Types and amounts (mass %) of components in the oil agent composition are shown in Table 2.

A carbon-fiber precursor acrylic fiber bundle and a carbon-fiber bundle were produced the same as in example 1-1 except that the obtained processed-oil solution was used. Measurements and evaluations were conducted. The results are shown in Table 2.

Examples 1-9~1-15

Oil agent compositions and processed-oil solutions were prepared the same as in example 1-8 except that component types and amounts in each oil agent composition were changed as shown in Table 2, and carbon-fiber precursor acrylic fiber bundles and carbon-fiber bundles were produced. The results are shown in Table 2.

When an antistatic agent was added, the antistatic agent was emulsified to have a predetermined fine particle size before being added.

TABLE 2

| | | | example | | | | | | | |
|---|---|---|---|---|---|---|---|---|---|---|
| | | | 1-8 | 1-9 | 1-10 | 1-11 | 1-12 | 1-13 | 1-14 | 1-15 |
| oil agent composition [mass %] | ester compound | A-1 | 10 | 20 | 30 | 50 | 25 | 25 | 25 | 25 |
| | | D-1 | 50 | 40 | — | — | 25 | 25 | — | — |
| | | E-1 | — | — | 30 | — | 25 | — | 25 | — |
| | | D-2 | — | — | — | 10 | — | — | — | 25 |
| | nonionic surfactant | K-1 | 20 | 20 | — | — | — | — | — | — |
| | | K-2 | — | 20 | 20 | 20 | 24 | 20 | 45 | 45 |
| | | K-3 | 20 | X | 20 | 20 | — | 20 | — | — |
| | antistatic agent | M-1 | — | — | — | — | 1 | — | — | — |
| | | M-2 | — | — | — | — | — | 10 | — | — |
| | | M-3 | — | — | — | — | — | — | 5 | 5 |
| amount of adhered oil agent [mass %] | | | 1.0 | 1.1 | 0.9 | 1.0 | 1.0 | 0.9 | 0.9 | 1.1 |
| adhered amount of each component [mass %] | ester compound | A-1 | 0.1 | 0.22 | 0.27 | 0.5 | 0.25 | 0.23 | 0.23 | 0.28 |
| | | D-1 | 0.5 | 0.44 | | — | 0.25 | 0.23 | — | — |
| | | E-1 | — | — | 0.27 | — | 0.25 | — | 0.23 | — |
| | | D-2 | — | — | — | 0.1 | — | — | — | 0.28 |
| | nonionic surfactant | K-1 | 0.2 | 0.22 | — | — | — | — | — | — |
| | | K-2 | — | 0.22 | 0.18 | 0.2 | 0.24 | 0.18 | 0.41 | 0.5 |
| | | K-3 | 0.2 | — | 0.18 | 0.2 | — | 0.18 | — | — |
| | antistatic agent | M-1 | — | — | — | — | 0.01 | — | — | — |
| | | M-2 | — | — | — | — | — | 0.09 | — | — |
| | | M-3 | — | — | — | — | — | — | 0.05 | 0.06 |
| evaluation | bundling property | | A | A | A | A | A | A | A | A |
| | operating efficiency | | A | A | A | A | A | A | A | A |
| | number of fusions | | A | A | A | A | A | A | A | A |
| | CF tensile strength [GPa] | | 5.2 | 5.1 | 5.3 | 5.2 | 5.1 | 5.3 | 5.4 | 5.3 |
| | amount of scattered Si [mg/kg] | | 0 | 0 | 0 | 0 | 0 | 0 | 0 | 0 |

As clearly shown in Table 2, the amount of adhered oil agent was appropriate in each example. The bundling property of carbon-fiber precursor acrylic fiber bundles and operating efficiency in the production process were excellent. In all the examples, no operational issues were identified that would affect the continuous production of carbon-fiber bundles.

Also, substantially no fusion was found among single fibers in the carbon-fiber bundles produced in each example, the CF tensile strength was high, and mechanical characteristics were excellent. In addition, since no silicone was contained, the amount of Si scattered in the heating process was substantially zero. Thus, the process load in the heating process was low.

Differences were observed in the CF tensile strength of a carbon-fiber bundle depending on component types and amounts in each oil agent composition. The CF tensile strength of carbon fibers was especially high in example 1-10 containing 30 mass % each of ester compounds (A-1) and (D-1), example 1-13 containing 25 mass % each of ester compounds (A-1) and (D-1), and example 1-14 containing 25 mass % each of ester compounds (A-1) and (E-1), and example 1-15 containing 25 mass % each of ester compounds (A-1) and (D-2).

Example 1-16

(Preparing Oil Agent Composition and Processed-Oil Solution)

Ester compound (A-1), ester compound (B-1) and isophoronediisocyanate-aliphatic alcohol adduct (F-1) were mixed and stirred to prepare an oil agent. Nonionic surfactants (K-1, K-3) were added to the mixture and stirred to prepare an oil agent composition.

After the oil agent composition was thoroughly stirred, ion-exchange water was further added to set the concentration of the oil agent composition at 30 mass %, and the mixture was emulsified by a homo-mixer. The mean particle diameter of the micelles at that time was measured by a laser diffraction/scattering particle-size distribution analyzer (brand name: LA-910, Horiba Ltd.) and found to be approximately 3.0 μm.

Next, using a high-pressure homogenizer, the oil agent composition was dispersed until the mean particle diameter of the micelles became 0.3 μm or smaller, and an emulsion of the oil agent composition was obtained. The emulsion was further diluted with ion-exchange water to prepare a processed-oil solution with an oil agent composition concentration of 1.3 mass %.

Types and amounts (mass %) of components in the oil agent composition are shown in Table 3.

Except that the obtained processed-oil solution was used, carbon-fiber precursor acrylic fiber bundles and carbon-fiber bundles were produced the same as in example 1-1, and were measured and evaluated. The results are shown in Table 3.

Examples 1-17~22

Oil agent compositions and processed-oil solutions were prepared the same as in example 1-16 except that component types and amounts in each oil agent composition were changed as shown in Table 3, and carbon-fiber precursor acrylic fiber bundles and carbon-fiber bundles were produced. Then, the fiber bundles were each measured and evaluated. The results are shown in Table 3.

When an antistatic agent was added, the antistatic agent was emulsified to have a predetermined fine particle size before being added.

TABLE 3

| | | | example | | | | | | |
|---|---|---|---|---|---|---|---|---|---|
| | | | 1-16 | 1-17 | 1-18 | 1-19 | 1-20 | 1-21 | 1-22 |
| oil agent composition [mass %] | ester compound | A-1 | 10 | 10 | 29 | 15 | 20 | 20 | 20 |
| | | F-1 | 10 | 25 | 11 | 15 | 20 | 20 | 20 |
| | ester compound | B-1 | 40 | — | — | 15 | — | 20 | — |
| | | C-1 | — | 20 | 20 | 15 | 20 | — | 30 |
| | nonionic surfactant | K-1 | 20 | 20 | — | — | — | — | — |
| | | K-2 | — | 15 | 20 | 20 | 35 | 20 | 29 |
| | | K-3 | 20 | 10 | 20 | 20 | — | 10 | — |
| | antistatic agent | M-1 | — | — | — | — | — | — | 1 |
| | | M-2 | — | — | — | — | — | 10 | — |
| | | M-3 | — | — | — | — | 5 | — | — |
| amount of adhered oil agent [mass %] | | | 1.0 | 1.1 | 0.9 | 1.2 | 1.0 | 0.8 | 1.0 |
| adhered amount of each component [mass %] | ester compound | A-1 | 0.1 | 0.11 | 0.26 | 0.18 | 0.2 | 0.16 | 0.2 |
| | | F-1 | 0.1 | 0.28 | 0.1 | 0.18 | 0.2 | 0.16 | 0.2 |
| | ester compound | B-1 | 0.4 | — | — | 0.18 | — | 0.16 | — |
| | | C-1 | — | 0.22 | 0.18 | 0.18 | 0.2 | — | 0.3 |
| | nonionic surfactant | K-1 | 0.2 | 0.22 | — | — | — | — | — |
| | | K-2 | — | 0.17 | 0.18 | 0.24 | 0.35 | 0.16 | 0.29 |
| | | K-3 | 0.2 | 0.11 | 0.18 | 0.24 | — | 0.08 | — |
| | antistatic agent | M-1 | — | — | — | — | — | — | 0.01 |
| | | M-2 | — | — | — | — | — | 0.08 | — |
| | | M-3 | — | — | — | — | 0.05 | — | — |
| evaluation | bundling property | | A | A | A | A | A | A | A |
| | operating efficiency | | A | A | A | A | A | A | A |
| | number of fusions | | A | A | A | A | A | A | A |
| | CF tensile strength [GPa] | | 5.2 | 5.1 | 5.2 | 5.3 | 5.4 | 5.3 | 5.3 |
| | amount of scattered Si [mg/kg] | | 0 | 0 | 0 | 0 | 0 | 0 | 0 |

As clearly shown in Table 3, the amount of adhered oil agent was appropriate in each example. The bundling property of carbon-fiber precursor acrylic fiber bundles and operating efficiency in the production process were excellent. In all the examples, no operational issues were identified that would affect the continuous production of carbon-fiber bundles.

Also, substantially no fusion was found among single fibers in the carbon-fiber bundles produced in each example, the CF tensile strength was high, and mechanical characteristics were excellent. In addition, since no silicone was contained, the amount of Si scattered in the heating process was substantially zero. Thus, the process load in the heating process was low.

Differences were observed in the CF tensile strength of a carbon-fiber bundle depending on component types and amounts of the oil agent composition. The CF tensile strength of the carbon-fiber bundles was high in example 1-19~1-22 containing the same amount of ester compound (A-1) and isophoronediisocyanate-aliphatic alcohol adduct (F-1). Among those examples, the CF tensile strength was especially high in example 1-20 containing 5 mass % of antistatic agent (M-3).

Example 1-23

(Preparing Oil Agent Composition and Processed-Oil Solution)

Ester compounds (A-1) and (D-1), and isophoronediisocyanate-aliphatic alcohol adduct (F-1) were mixed and stirred to prepare an oil agent. Nonionic surfactants (K-1, K-3) were added to the mixture and stirred to prepare an oil agent composition.

After the oil agent composition was thoroughly stirred, ion-exchange water was further added to set the concentration of the oil agent composition at 30 mass %, and the mixture was emulsified by a homo-mixer. The mean particle diameter of the micelles at that time was measured by a laser diffraction/scattering particle-size distribution analyzer (brand name: LA-910, Horiba Ltd.) and found to be approximately 5.0 μm.

Next, using a high-pressure homogenizer, the oil agent composition was dispersed until the mean particle diameter of the micelles became 0.3 μm or smaller, and an emulsion of the oil agent composition was obtained. The emulsion was further diluted with ion-exchange water to prepare a processed-oil solution with an oil agent composition concentration of 1.3 mass %.

Types and amounts (mass %) of components in the oil agent composition are shown in Table 4.

Except that the obtained processed-oil solution was used, a carbon-fiber precursor acrylic fiber bundle and a carbon-fiber bundle were produced the same as in example 1-1, and were measured and evaluated. The results are shown in Table 4.

Examples 1-24~1-29

Oil agent compositions and processed-oil solutions were prepared the same as in example 1-23 except that component types and amounts in each oil agent composition were changed as shown in Table 4, and carbon-fiber precursor acrylic fiber bundles and carbon-fiber bundles were produced. Then, the fiber bundles were each measured and evaluated. The results are shown in Table 4.

When an antistatic agent was added, the antistatic agent was emulsified to have a predetermined fine particle size before being added.

TABLE 4

| | | | example | | | | | | |
|---|---|---|---|---|---|---|---|---|---|
| | | | 1-23 | 1-24 | 1-25 | 1-26 | 1-27 | 1-28 | 1-29 |
| oil agent composition [mass %] | ester compound | A-1 | 10 | 30 | 10 | 20 | 15 | 15 | 20 |
| | isophoronediisocyanate-aliphatic alcohol adduct | F-1 | 25 | 15 | 10 | 20 | 15 | 15 | 20 |
| | ester compound | D-1 | 20 | — | — | — | — | 20 | 20 |
| | | D-2 | — | 15 | — | — | — | — | — |
| | | E-1 | — | — | 30 | 20 | 20 | — | — |
| | nonionic surfactant | K-1 | 20 | 20 | — | — | — | — | — |
| | | K-2 | — | 20 | 25 | 20 | 45 | 20 | 39 |
| | | K-3 | 25 | — | 25 | 20 | — | 20 | — |
| | antistatic agent | M-1 | — | — | — | — | — | — | 1 |
| | | M-2 | — | — | — | — | — | 10 | — |
| | | M-3 | — | — | — | — | 5 | — | — |
| amount of adhered oil agent [mass %] | | | 1.1 | 0.9 | 1.0 | 1.1 | 0.8 | 1.0 | 1.1 |
| adhered amount of each component [mass %] | ester compound | A-1 | 0.11 | 0.27 | 0.1 | 0.22 | 0.12 | 0.15 | 0.22 |
| | isoholondiisocyanate-aliphatic alcohol adduct | F-1 | 0.28 | 0.14 | 0.1 | 0.22 | 0.12 | 0.15 | 0.22 |
| | ester compound | D-1 | 0.22 | — | — | — | — | 0.2 | 0.22 |
| | | D-2 | — | 0.14 | — | — | — | — | — |
| | | E-1 | — | — | 0.3 | 0.22 | 0.16 | — | — |
| | nonionic surfactant | K-1 | 0.22 | 0.18 | — | — | — | — | — |
| | | K-2 | — | 0.18 | 0.25 | 0.22 | 0.36 | 0.2 | 0.43 |
| | | K-3 | 0.28 | — | 0.25 | 0.22 | — | 0.2 | — |
| | antistatic agent | M-1 | — | — | — | — | — | — | 0.01 |
| | | M-2 | — | — | — | — | — | 0.1 | — |
| | | M-3 | — | — | — | — | 0.04 | — | — |
| evaluation | bundling property | | A | A | A | A | A | A | A |
| | operating efficiency | | A | A | A | A | A | A | A |
| | number of fusions | | A | A | A | A | A | A | A |
| | CF tensile strength [GPa] | | 5.1 | 5.2 | 5.3 | 5.3 | 5.4 | 5.3 | 5.3 |
| | amount of scattered Si [mg/kg] | | 0 | 0 | 0 | 0 | 0 | 0 | 0 |

As clearly shown in Table 4, the amount of adhered oil agent was appropriate in each example. The bundling property of carbon-fiber precursor acrylic fiber bundles and operating efficiency in the production process were excellent. In all the examples, no operational issues were identified that would affect the continuous production of carbon-fiber bundles.

Also, substantially no fusion was found among single fibers in the carbon-fiber bundles produced in each example, the CF tensile strength was high, and mechanical characteristics were excellent. In addition, since no silicone was contained, the amount of Si scattered in the heating process was substantially zero. Thus, the process load in the heating process was low.

Differences were observed in the CF tensile strength of a carbon-fiber bundle depending on component types and amounts in each oil agent composition. The CF tensile strength of carbon fibers was high in examples 1-25~1-29, in which the amount of ester compound (A-1) was the same as that of isophoronediisocyanate-aliphatic alcohol adduct (F-1), and the amount of ester compound (D-1), ester compound (E-1) or ester compound (D-2) was the same as or greater than that of ester compound (A-1) or isophorone-diisocyanate-aliphatic alcohol adduct (F-1). The sCF tensile strength was especially high in example 1-27, containing more nonionic surfactant and 5 mass % of antistatic agent (M-3).

Example 1-30

(Preparing Oil Agent Composition and Processed-Oil Solution)

Isophoronediisocyanate-aliphatic alcohol adduct (F-1) and ester compound (B-1) were mixed and stirred to prepare an oil agent. Nonionic surfactants (K-1, K-3) were added to the mixture and stirred to prepare an oil agent composition.

After the oil agent composition was thoroughly stirred, ion-exchange water was further added to set the concentration of the oil agent composition at 30 mass %, and the mixture was emulsified by a homo-mixer. The mean particle diameter of the micelles at that time was measured by a laser diffraction/scattering particle-size distribution analyzer (brand name: LA-910, Horiba Ltd.) and found to be approximately 5.0 μm.

Next, using a high-pressure homogenizer, the oil agent composition was dispersed until the mean particle diameter of the micelles became 0.3 μm or smaller, and an emulsion of the oil agent composition was obtained. The emulsion was further diluted with ion-exchange water to prepare a processed-oil solution with an oil agent composition concentration of 1.3 mass %.

Types and amounts (mass %) of components in the oil agent composition are shown in Table 5.

Except that the obtained processed-oil solution was used, a carbon-fiber precursor acrylic fiber bundle and a carbon-fiber bundle were produced the same as in example 1-1, and were measured and evaluated. The results are shown in Table 5.

Examples 1-31~1-36

Oil agent compositions and processed-oil solutions were prepared the same as in example 1-30 except that component types and amounts in each oil agent composition were changed as shown in Table 5, and carbon-fiber precursor acrylic fiber bundles and carbon-fiber bundles were produced. Then, the fiber bundles were each measured and evaluated. The results are shown in Table 5.

When an antistatic agent was added, the antistatic agent was emulsified to have a predetermined fine particle size before being added.

TABLE 5

| | | | example | | | | | | |
|---|---|---|---|---|---|---|---|---|---|
| | | | 1-30 | 1-31 | 1-32 | 1-33 | 1-34 | 1-35 | 1-36 |
| oil agent composition [mass %] | isophoronediisocyanate-aliphatic alcohol adduct | F-1 | 15 | 20 | 30 | 50 | 25 | 25 | 25 |
| | ester compound | B-1 | 45 | 40 | — | — | 25 | 25 | — |
| | | C-1 | — | — | 30 | 10 | 25 | — | 25 |
| | nonionic surfactant | K-1 | 20 | 20 | — | — | — | — | — |
| | | K-2 | — | 20 | 20 | 20 | 24 | 25 | 40 |
| | | K-3 | 20 | — | 20 | 20 | — | 20 | — |
| | antistatic agent | M-1 | — | — | — | — | 1 | — | — |
| | | M-2 | — | — | — | — | — | 5 | — |
| | | M-3 | — | — | — | — | — | — | 10 |
| amount of adhered oil agent [mass %] | | | 0.9 | 1.1 | 0.8 | 1.0 | 1.0 | 1.1 | 0.8 |
| adhered amount of each component [mass %] | isoholondiisocyanate-aliphatic alcohol adduct | F-1 | 0.14 | 0.22 | 0.24 | 0.5 | 0.25 | 0.28 | 0.2 |
| | ester compound | B-1 | 0.41 | 0.44 | — | — | 0.25 | 0.28 | — |
| | | C-1 | — | — | 0.24 | 0.1 | 0.25 | — | 0.2 |
| | nonionic surfactant | K-1 | 0.18 | 0.22 | — | — | — | — | — |
| | | K-2 | — | 0.22 | 0.16 | 0.2 | 0.24 | 0.28 | 0.32 |
| | | K-3 | 0.18 | — | 0.16 | 0.2 | — | 0.22 | — |
| | antistatic agent | M-1 | — | — | — | — | 0.01 | — | — |
| | | M-2 | — | — | — | — | — | 0.06 | — |
| | | M-3 | — | — | — | — | — | — | 0.08 |
| evaluation | convergence | | A | A | A | A | A | A | A |
| | operating efficiency | | A | A | A | A | A | A | A |
| | number of fusions | | A | A | A | A | A | A | A |
| | CF tensile strength [GPa] | | 5.1 | 5.2 | 5.3 | 5.1 | 5.2 | 5.4 | 5.3 |
| | amount of scattered Si [mg/kg] | | 0 | 0 | 0 | 0 | 0 | 0 | 0 |

As clearly shown in Table 5, the amount of adhered oil agent was appropriate in each example. The bundling property of carbon-fiber precursor acrylic fiber bundles and operating efficiency in the production process were excellent. In all the examples, no operational issues were identified that would affect the continuous production of carbon-fiber bundles.

Also, substantially no fusion was found among single fibers in the carbon-fiber bundles produced in each example, the CF tensile strength was high, and mechanical characteristics were excellent. In addition, since no silicone was contained, the amount of Si scattered in the heating process was substantially zero. Thus, the process load in the heating process was low.

Differences were observed in the CF tensile strength of a carbon-fiber bundle depending on component types and amounts in each oil composition. The CF tensile strength of carbon fiber bundles was especially high in example 1-32 containing 30 mass % each of isophoronediisocyanate-aliphatic alcohol adduct (F-1) and ester compound (C-1), example 1-35 containing 25 mass % each of isophoronediisocyanate-aliphatic alcohol adduct (F-1) and ester compound (B-1), and example 1~36 containing 25 mass % each of isophoronediisocyanate-aliphatic alcohol adduct (F-1) and ester compound (C-1).

Example 1-37

<Preparing Oil Agent Composition and Processed-Oil Solution>

Isophoronediisocyanate-aliphatic alcohol adduct (F-1) and ester compound (D-1) were mixed and stirred to prepare an oil agent. Nonionic surfactants (K-1, K-3) were added to the mixture and stirred to prepare an oil agent composition.

After the oil agent composition was thoroughly stirred, ion-exchange water was further added to set the concentration of the oil agent composition at 30 mass %, and the mixture was emulsified by a homo-mixer. The mean particle diameter of the micelles at that time was measured by a laser diffraction/scattering particle-size distribution analyzer (brand name: LA-910, Horiba Ltd.) and found to be approximately 5.0 μm.

Next, using a high-pressure homogenizer, the oil agent composition was dispersed until the mean particle diameter of the micelles became 0.3 μm or smaller, and an emulsion of the oil agent composition was obtained. The emulsion was further diluted with ion-exchange water to prepare a processed-oil solution with an oil agent composition concentration of 1.3 mass %.

Types and amounts (mass %) of components in the oil agent composition are shown in Table 6.

Except that the obtained processed-oil solution was used, a carbon-fiber precursor acrylic fiber bundle and a carbon-fiber bundle were produced the same as in example 1-1, and were measured and evaluated. The results are shown in Table 6.

Examples 1-38~1-44

Oil agent compositions and processed-oil solutions were prepared the same as in example 1-37 except that component types and amounts in each oil agent composition were changed as shown in Table 6, and carbon-fiber precursor acrylic fiber bundles and carbon-fiber bundles were produced. Then, the fiber bundles were each measured and evaluated. The results are shown in Table 6.

When an antistatic agent was added, the antistatic agent was emulsified to have a predetermined fine particle size before being added.

TABLE 6

| | | | example | | | | | | | |
|---|---|---|---|---|---|---|---|---|---|---|
| | | | 1-37 | 1-38 | 1-39 | 1-40 | 1-41 | 1-42 | 1-43 | 1-44 |
| oil agent composition [mass %] | isophoronediisocyanate-aliphatic alcohol adduct | F-1 | 10 | 20 | 30 | 50 | 25 | 25 | 25 | 25 |
| | ester compound | D-1 | 50 | 40 | — | — | 25 | 25 | — | — |
| | | E-1 | — | — | 30 | — | 25 | — | 25 | — |
| | | D-2 | — | — | — | 10 | — | — | — | 25 |
| | nonionic surfactant | K-1 | 20 | 20 | — | — | — | — | — | — |
| | | K-2 | — | 20 | 20 | 20 | 24 | 20 | 45 | 45 |
| | | K-3 | 20 | — | 20 | 20 | — | 20 | — | — |
| | antistatic agent | M-1 | — | — | — | — | 1 | — | — | — |
| | | M-2 | — | — | — | — | — | 10 | — | — |
| | | M-3 | — | — | — | — | — | — | 5 | 5 |
| amount of adhered oil agent [mass %] | | | 1.0 | 1.1 | 0.9 | 1.0 | 0.9 | 1.0 | 0.8 | 1.0 |
| adhered amount of each component [mass %] | isoholondiisocyanate-aliphatic alcohol adduct | F-1 | 0.1 | 0.22 | 0.27 | 0.5 | 0.23 | 0.25 | 0.2 | 0.25 |
| | ester compound | D-1 | 0.5 | 0.44 | — | — | 0.23 | 0.25 | — | — |
| | | E-1 | — | — | 0.27 | — | 0.23 | — | 0.2 | — |
| | | D-2 | — | — | — | 0.1 | — | — | — | 0.25 |
| | nonionic surfactant | K-1 | 0.2 | 0.22 | — | — | — | — | — | — |
| | | K-2 | — | 0.22 | 0.18 | 0.2 | 0.22 | 0.2 | 0.36 | 0.45 |
| | | K-3 | 0.2 | — | 0.18 | 0.2 | — | 0.2 | — | — |
| | antistatic agent | M-1 | — | — | — | — | 0.01 | — | — | — |
| | | M-2 | — | — | — | — | — | 0.1 | — | — |
| | | M-3 | — | — | — | — | — | — | 0.04 | 0.05 |
| evaluation | bundling property | | A | A | A | A | A | A | A | A |
| | operating efficiency | | A | A | A | A | A | A | A | A |
| | number of fusions | | A | A | A | A | A | A | A | A |
| | CF tensile strength [GPa] | | 5.1 | 5.2 | 5.4 | 5.1 | 5.1 | 5.2 | 5.3 | 5.3 |
| | amount of scattered Si [mg/kg] | | 0 | 0 | 0 | 0 | 0 | 0 | 0 | 0 |

As clearly shown in Table 6, the amount of adhered oil agent was appropriate in each example. The bundling property of carbon-fiber precursor acrylic fiber bundles and operating efficiency in the production process were excellent. In all the examples, no operational issues were identified that would affect the continuous production of carbon-fiber bundles.

Also, substantially no fusion was found among single fibers in the carbon-fiber bundles produced in each example, the CF tensile strength was high, and mechanical characteristics were excellent. In addition, since no silicone was contained, the amount of Si scattered during the heating process was substantially zero. Thus, the process load in the heating process was low.

modified silicone and stirred, to which ion-exchange water was added.

Except that the obtained processed-oil solution prepared as above was used, carbon-fiber precursor acrylic fiber bundles and carbon-fiber bundles were produced the same as in example 1-1, and were measured and evaluated. The results are shown in Table 7.

TABLE 7

| | | | comparative example | | | | | | | |
|---|---|---|---|---|---|---|---|---|---|---|
| | | | 1-1 | 1-2 | 1-3 | 1-4 | 1-5 | 1-6 | 1-7 | 1-8 |
| oil agent composition [mass %] | ester compound | G-1 | 20 | 30 | 60 | — | — | 20 | — | — |
| | | G-2 | 20 | 30 | — | 60 | — | 20 | — | — |
| | | J-2 | 30 | — | — | — | 60 | — | — | — |
| | nonionic surfactant | K-1 | 20 | 20 | 10 | 10 | 10 | 20 | — | 10 |
| | | K-2 | 10 | 10 | 10 | 10 | — | — | 10 | 10 |
| | | K-3 | — | — | — | — | 10 | 20 | — | — |
| | amino-modified silicone | H-6 | — | — | 20 | — | — | 15 | 90 | — |
| | | H-7 | — | — | — | 19 | 20 | — | — | 80 |
| | antistatic agent | M-1 | — | — | — | 1 | — | — | — | — |
| | | M-2 | — | 10 | — | — | — | — | — | — |
| | | M-3 | — | — | — | — | — | 5 | — | — |
| amount of adhered oil agent [mass %] | | | 1.0 | 0.9 | 1.1 | 1.0 | 0.9 | 0.8 | 1.0 | 1.1 |
| adhered amount of each component [mass %] | ester compound | G-1 | 0.2 | 0.27 | 0.66 | — | — | 0.16 | — | — |
| | | G-2 | 0.2 | 0.27 | — | 0.6 | — | 0.16 | — | — |
| | | J-2 | 0.3 | — | — | — | 0.54 | — | — | — |
| | nonionic surfactant | K-1 | 0.2 | 0.18 | 0.11 | 0.1 | 0.09 | 0.16 | — | 0.11 |
| | | K-2 | 0.1 | 0.09 | 0.11 | 0.1 | — | — | 0.1 | 0.11 |
| | | K-3 | — | — | — | — | 0.09 | 0.16 | — | — |
| | amino-modified silicone | H-6 | — | — | 0.22 | — | — | 0.12 | 0.9 | — |
| | | H-7 | — | — | — | 0.19 | 0.18 | — | — | 0.88 |
| | antistatic agent | M-1 | — | — | — | 0.01 | — | — | — | — |
| | | M-2 | — | 0.09 | — | — | — | — | — | — |
| | | M-3 | — | — | — | — | — | 0.04 | — | — |
| evaluation | bundling property | | C | B | B | B | C | B | A | A |
| | operating efficiency | | B | A | B | C | C | C | A | A |
| | number of fusions | | C | C | A | A | A | A | A | A |
| | CF tensile strength [GPa] | | 3.9 | 4.2 | 4.5 | 4.6 | 4.4 | 4.3 | 5.3 | 5.2 |
| | amount of scattered Si [mg/kg] | | 0 | 0 | 350 | 250 | 280 | 300 | 1100 | 930 |

Differences were observed in the CF tensile strength of a carbon-fiber bundle depending on component types and amounts in each oil agent composition. The CF tensile strength of carbon fibers was especially high in example 1-39 containing 30 mass % each of isophoronediisocyanate-aliphatic alcohol adduct (F-1) and ester compound (E-1), example 1-43 containing 25 mass % each of isophoronediisocyanate-aliphatic alcohol adduct (F-1) and ester compound (E-1), and example 1-44 containing 25 mass % each of isophoronediisocyanate-aliphatic alcohol adduct (F-1) and ester compound (D-2).

Comparative Examples 1-1~1-8

<Preparing Oil Agent Composition and Processed-Oil Solution>

Oil agent compositions and processed-oil solutions were prepared the same as in example 1-1 except that component types and amounts in each oil agent composition were changed as shown in Table 7.

When an antistatic agent was added, the antistatic agent was emulsified to have a predetermined fine particle size before being added.

When amino-modified silicone was used, it was added after a nonionic surfactant was stirred into the ester compound. Also, in comparative examples 1-7 and 1-8 containing amino-modified silicone without using an ester compound, a nonionic surfactant was mixed into amino- As clearly shown clearly in Table 7, relative to each example, the CF tensile strength of carbon-fiber bundles was low in comparative examples 1-1 and 1-2, which were prepared using ester compound (G-1) having one aromatic ring, ester compound (G-2) having two aromatic rings and chain aliphatic ester compound (J-1), but without using amino-modified silicone H.

In comparative examples 1-3~1-6 containing 15-20 mass % of amino-modified silicone H and 40~60 mass % combined of ester compounds (G-1), (G-2) and (J-1), fewer fused fibers were observed, but problems in operational stability were noted.

When amino-modified silicone H was used (comparative examples 1-3~1-8), no fusion was observed in carbon-fiber bundles and the CF tensile strength was excellent. However, the Si amount scattered during stabilization was greater due to the use of silicone, resulting in a process load in the heating process that was too great to allow continuous industrial operation.

Example 2-1

(Preparing Oil Agent Composition and Processed-Oil Solution)

Hydroxybenzoate (A-1) prepared above as an oil agent was used, and an antioxidant was added and heated to be dispersed therein. Nonionic surfactants (K-1, K-4) were added to the mixture and stirred well to prepare an oil agent composition.

While the oil agent composition was being stirred, ion-exchange water was added to set the concentration of the oil agent composition at 30 mass %, and the mixture was emulsified using a homo-mixer. The mean particle diameter of the micelles at that time was measured by a laser diffraction/scattering particle-size distribution analyzer (brand name: LA-910, Horiba Ltd.) and found to be approximately 5.0 μm.

Next, using a high-pressure homogenizer, the oil agent composition was dispersed until the mean particle diameter of the micelles became 0.2 μm or smaller, and an emulsion was obtained. The emulsion was further diluted with ion-exchange water to prepare a processed-oil solution with an oil agent composition concentration of 1.3 mass %.

Types and amounts (mass %) of components in the oil agent composition are shown in Table 8.

(Producing Carbon-Fiber Precursor Acrylic Fiber Bundle)

A precursor fiber bundle to apply the oil agent was prepared as follows. An acrylonitrile-based copolymer (composition ratio: acrylonitrile/acrylamide/methacrylic acid=96.5/2.7/0.8 (mass ratio)) was dispersed in dimethylacetamide at a rate of 21 mass % and dissolved by heating to prepare a spinning dope solution. In a 38° C. coagulation bath filled with a dimethylacetamide solution with a concentration of 67 mass %, the spinning dope solution was discharged from a spinning nozzle having 50000 holes with a hole diameter (diameter) of 50 μm to make coagulated fibers. The coagulated fibers were washed in a water tank to remove the solvent and were drawn to be three times as long to obtain a water-swollen precursor fiber bundle.

The water-swollen precursor fiber bundle was introduced into the oil-treatment tank filled with the processed-oil solution prepared as above to apply the oil agent.

The precursor fiber bundle with the applied oil agent was subjected to dry and densification using a roller with a surface temperature of 150° C., and steam drawing was performed under 0.3 MPa pressure to make the bundle five times as long. Accordingly, a carbon-fiber precursor acrylic fiber bundle was obtained. The number of filaments in the carbon-fiber precursor acrylic fiber bundle was 50000, and the single fiber fineness was 1.3 dTex.

Bundling property and operating efficiency during the production process were evaluated, and the amount of adhered oil agent on the carbon-fiber precursor acrylic fiber bundle was measured. The results are shown in Table 8.

(Producing Carbon-Fiber Bundle)

The carbon-fiber precursor acrylic fiber bundle was subjected to heating under a nitrogen atmosphere in a stabilization furnace with a temperature gradient of 220~260° C. for 40 minutes to produce a stabilized fiber bundle.

Next, the stabilized fiber bundle was baked for three minutes while passing through a carbonization furnace with a temperature gradient of 400~1400° C. Accordingly, a carbon-fiber bundle was obtained.

The amount of Si scattered during stabilization was measured. Also, the number of fusions in the carbon-fiber bundle and the CF tensile strength were measured. The results are shown in Table 8.

Examples 2-2~2-3

Oil agent compositions and processed-oil solutions were prepared the same as in example 2-1 except that component types and amounts in each oil agent composition were changed as shown in Table 8, and carbon-fiber precursor acrylic fiber bundles and carbon-fiber bundles were produced. Then, the fiber bundles were each measured and evaluated. The results are shown in Table 8.

Example 2-4

(Preparing Oil Agent Composition and Processed-Oil Solution)

An antioxidant was heated and dispersed into compound (A-1) prepared as above. Nonionic surfactants (K-1, K-4) were added to the mixture and stirred well, and ester compounds (G-1, G-2) were further added and stirred thoroughly to prepare an oil agent composition.

While the oil agent composition was being stirred, ion-exchange water was further added to set the concentration of the oil agent composition at 30 mass %, and the mixture was emulsified by a homo-mixer. The mean particle diameter of the micelles at that time was measured by a laser diffraction/scattering particle-size distribution analyzer (brand name: LA-910, Horiba Ltd.) and found to be approximately 4.5 μm.

Next, using a high-pressure homogenizer, the oil agent composition was dispersed until the mean particle diameter of the micelles became 0.2 μm or smaller, and an emulsion of the oil agent composition was obtained. The emulsion was further diluted with ion-exchange water to prepare a processed-oil solution with an oil agent composition concentration of 1.3 mass %.

Types and amounts (mass %) of components in the oil agent composition are shown in Table 8.

Except that the obtained processed-oil solution was used, a carbon-fiber precursor acrylic fiber bundle and a carbon-fiber bundle were produced the same as in example 2-1, and were measured and evaluated. The results are shown in Table 8.

Examples 2-5~2-9

Oil agent compositions were prepared the same as in example 2-4 except that component types and amounts in each oil agent composition were changed as shown in Table 8, and carbon-fiber precursor acrylic fiber bundles and carbon-fiber bundles were produced. Then, the fiber bundles were each measured and evaluated. The results are shown in Table 8.

Comparative Examples 2-1~2-11

Oil agent compositions and processed-oil solutions were prepared the same as in example 2-1 or 2-4 except that component types and amounts in each oil agent composition were changed as shown in Table 9.

When preparing comparative examples 2-1~2-9 without using compound (A1), the antioxidant was dispersed in advance in any one of ester compound G, chain aliphatic ester or amino-modified silicone H.

When preparing comparative example 2-6 using both amino-modified silicone H and ester compound (aromatic ester) G, amino-modified silicone H was added after a nonionic surfactant was stirred in ester compound (aromatic ester) G When preparing comparative examples 2-7 and 2-8 using amino-modified silicone H but without ester compound (aromatic ester) G or a chain aliphatic ester, ion-exchange water was added after a nonionic surfactant was stirred into amino-modified silicone H with an antioxidant dispersed therein beforehand.

Except that obtained processed-oil solutions prepared as above were used, carbon-fiber precursor acrylic fiber bundles and carbon-fiber bundles were produced the same as in example 2-1, and were measured and evaluated. The results are shown in Table 9.

TABLE 8

| | | | example | | | | | | | | |
|---|---|---|---|---|---|---|---|---|---|---|---|
| | | | 2-1 | 2-2 | 2-3 | 2-4 | 2-5 | 2-6 | 2-7 | 2-8 | 2-9 |
| oil agent composition [mass %] | compound A | A-1 | 100 | 100 | 100 | 10 | 29 | 50 | 50 | 50 | 95 |
| | ester compound G | G-1 | — | — | — | 45 | 35.5 | 25 | 50 | 50 | 5 |
| | | G-2 | — | — | — | 45 | 35.5 | 25 | — | — | — |
| | aliphatic ester | J-1 | — | — | — | — | — | — | — | — | — |
| | | J-2 | — | — | — | — | — | — | — | — | — |
| | amino-modified silicone H | H-1 | — | — | — | — | — | — | — | — | — |
| | | H-2 | — | — | — | — | — | — | — | — | — |
| | nonionic surfactant | K-1 | 10 | 27 | 101 | 10 | 27 | — | 50 | 23 | 75 |
| | | K-4 | 10 | 13 | 49 | 10 | 13 | 50 | — | 40 | 75 |
| | antioxidant | L-1 | 5 | 3 | 1 | 3 | 3 | 1 | 3 | 1 | 5 |
| amount of adhered oil agent [mass %] | | | 1.0 | 1.3 | 1.2 | 1.4 | 0.9 | 1.0 | 0.8 | 1.2 | 1.5 |
| adhered amount of each component [mass %] | compound A | A-1 | 0.8 | 0.91 | 0.48 | 0.11 | 0.18 | 0.33 | 0.26 | 0.37 | 0.56 |
| | ester compound G | G-1 | — | — | — | 0.51 | 0.22 | 0.17 | 0.26 | 0.37 | 0.03 |
| | | G-2 | — | — | — | 0.51 | 0.22 | 0.17 | — | — | — |
| | aliphatic ester | J-1 | — | — | — | — | — | — | — | — | — |
| | | J-2 | — | — | — | — | — | — | — | — | — |
| | amino-modified silicone H | H-1 | — | — | — | — | — | — | — | — | — |
| | | H-2 | — | — | — | — | — | — | — | — | — |
| | nonionic surfactant | K-1 | 0.08 | 0.25 | 0.48 | 0.11 | 0.17 | — | 0.26 | 0.17 | 0.44 |
| | | K-4 | 0.08 | 0.12 | 0.23 | 0.11 | 0.08 | 0.33 | — | 0.29 | 0.44 |
| | antioxidant | L-1 | 0.04 | 0.03 | 0.005 | 0.03 | 0.02 | 0.01 | 0.02 | 0.01 | 0.03 |
| | bundling property | | A | A | A | A | A | A | A | A | A |
| | operating efficiency | | A | A | A | A | A | A | A | A | A |
| | number of fusions | | A | A | A | A | A | A | A | A | A |
| | CF tensile strength [GPa] | | 4.9 | 5.0 | 4.7 | 4.7 | 4.8 | 5.0 | 5.1 | 5.2 | 5.0 |
| | amount of scattered Si [mg/kg] | | 0 | 0 | 0 | 0 | 0 | 0 | 0 | 0 | 0 |

TABLE 9

| | | | comparative example | | | | | | | | | | |
|---|---|---|---|---|---|---|---|---|---|---|---|---|---|
| | | | 2-1 | 2-2 | 2-3 | 2-4 | 2-5 | 2-6 | 2-7 | 2-8 | 2-9 | 2-10 | 2-11 |
| oil agent composition [mass %] | compound A | A-1 | — | — | — | — | — | — | — | — | — | 50 | 50 |
| | ester compound G | G-1 | 35.5 | 35.5 | — | — | 50 | — | — | — | — | — | — |
| | | G-2 | 35.5 | 35.5 | — | — | 50 | 43 | — | — | 42 | — | — |
| | aliphatic ester | J-1 | 29 | — | 100 | — | — | — | — | — | 29 | 50 | — |
| | | J-2 | — | 29 | — | 100 | — | — | — | — | 29 | — | 50 |
| | amino-modified silicone H | H-1 | — | — | — | — | — | 57 | — | 100 | — | — | — |
| | | H-2 | — | — | — | — | — | — | 100 | — | — | — | — |
| | nonionic surfactant | K-1 | 27 | 27 | 6 | 6 | 40 | 27 | — | 30 | 28 | 23 | 23 |
| | | K-4 | 13 | 13 | 16 | 16 | 23 | 13 | 23 | 15 | — | 40 | 40 |
| | antioxidant | L-1 | 3 | 3 | 2.5 | 2.5 | 3 | 3 | 2.5 | 8 | 14 | 1 | 1 |
| amount of adhered oil agent [mass %] | | | 0.8 | 0.7 | 0.9 | 1.1 | 0.8 | 1.1 | 1.2 | 1.0 | 1.2 | 0.9 | 1.0 |
| adhered amount of each component [mass %] | compound A | A-1 | — | — | — | — | — | — | — | — | — | 0.27 | 0.3 |
| | ester compound G | G-1 | 0.2 | 0.17 | — | — | 0.24 | — | — | — | — | — | — |
| | | G-2 | 0.2 | 0.17 | — | — | 0.24 | 0.33 | — | — | 0.35 | — | — |
| | aliphatic ester | J-1 | 0.16 | — | 0.72 | — | — | — | — | — | 0.25 | 0.27 | — |
| | | J-2 | — | 0.14 | — | 0.88 | — | — | — | — | 0.25 | — | 0.3 |
| | amino-modified silicone H | H-1 | — | — | — | — | — | 0.44 | — | 0.65 | — | — | — |
| | | H-2 | — | — | — | — | — | — | 0.96 | — | — | — | — |
| | nonionic surfactant | K-1 | 0.15 | 0.13 | 0.04 | 0.05 | 0.19 | 0.21 | — | 0.2 | 0.24 | 0.13 | 0.14 |
| | | K-4 | 0.07 | 0.06 | 0.12 | 0.14 | 0.11 | 0.1 | 0.22 | 0.1 | — | 0.22 | 0.24 |
| | antioxidant | L-1 | 0.02 | 0.01 | 0.02 | 0.02 | 0.01 | 0.02 | 0.02 | 0.05 | 0.12 | 0.01 | 0.01 |
| | bundling property | | B | B | C | C | B | A | A | A | B | B | B |
| | operating efficiency | | B | B | C | C | A | A | A | A | B | A | A |
| | number of fusions | | C | C | C | C | C | A | A | A | C | C | C |
| | CF tensile strength [GPa] | | 3.9 | 4.0 | 3.4 | 3.6 | 4.1 | 5.0 | 5.2 | 5.1 | 3.5 | 4.3 | 4.5 |
| | amount of scattered Si [mg/kg] | | 0 | 0 | 0 | 0 | 0 | 60 | 1280 | 830 | 0 | 0 | 0 |

As clearly shown in Table 8, the amount of adhered oil agent was appropriate in each example. The bundling property of carbon-fiber precursor acrylic fiber bundles and operating efficiency in the production process were excellent. In all the examples, no operational issues were identified that would affect the continuous production of carbon-fiber bundles.

Also, substantially no fusion was found among single fibers in the carbon-fiber bundles produced in each example, the CF tensile strength was high, and mechanical characteristics were excellent. In addition, since no silicone was contained, the amount of Si scattered in the heating process was substantially zero. Thus, the process load in the heating process was low.

CF tensile strength of carbon-fiber bundles obtained in each example was higher than those of comparative examples 2-1~2-5 and 2-9 prepared using an oil agent composition that does not contain amino-modified silicone H.

When composition ratios of compound A (hydroxybenzoate) and a nonionic surfactant were changed (examples 2-1~2-3), CF tensile strength of carbon-fiber bundles was higher in example 2-2 containing a total of 40 parts by mass of nonionic surfactants (K-1: 27 parts by mass, K-4: 13 parts by mass).

Also, when the composition ratios of compound A and ester compound G were each 50 parts by mass (examples 2-6~2-8), CF tensile strength was higher. Among those, the CF tensile strength was highest in example 2-8, which contains 50 parts by mass of compound A, 50 parts by mass of trimellitic acid ester (G-1), 23 parts by mass of nonionic surfactant (K-1) and 40 parts by mass of nonionic surfactant (K-4).

On the other hand, as is clear in Table 9, instead of compound A (hydroxybezoate), a chain aliphatic ester or a chain aliphatic ester and ester compound (aromatic ester) G were used (comparative examples 2-1~2-4, 2-9), the amount of adhered oil agent was appropriate and hardly any Si was observed scattered in the heating process. However, bundling property of carbon-fiber precursor acrylic fiber bundles and operating efficiency during the fiber production were low, and more fused bundles were observed in the obtained carbon-fiber bundles. Moreover, CF tensile strength of carbon-fiber bundles was lower than in each of the examples.

Especially, when an oil agent composition was prepared without ester compound (aromatic compound) G, but using only a chain aliphatic ester, nonionic surfactant and antioxidant (comparative examples 2-3, 2-4), bundling property, operating efficiency and CF tensile strength were notably low.

When an oil agent composition was prepared using ester compound (aromatic ester) G and a high content of an antioxidant (comparative example 2-9), the CF tensile strength was notably low.

Instead of compound A (hydroxybenzoate), only ester compound (aromatic ester) G was used (comparative example 2-5), operating efficiency was excellent and substantially no Si was observed being scattered during stabilization, but bundling property of the obtained carbon-fiber precursor acrylic fiber bundles was low. In addition, the number of fused fibers was greater in the produced carbon-fiber bundles, and CF tensile strength was notably low relative to that of each example.

When amino-modified silicone H was contained (comparative examples 2-6~2-8), bundling property and operating efficiency were excellent, and substantially no fusion was observed in the produced carbon-fiber bundles. CF tensile strength was substantially the same as that in each example. However, the Si amount scattered during stabilization was greater due to the use of silicone, resulting in a process load in the heating process that was too great to allow continuous industrial operation.

When compound A (hydroxybenzoate) and a chain aliphatic ester were mixed (comparative examples, 2-10, 2-11), CF tensile strength was higher than that in comparative examples 2-1~2-5 and 2-9 prepared without amino-modified silicone H. However, such CF tensile strength was far from the level of the examples. Also, bundling property was rather low, and the number of fused fibers was greater.

Example 3-1

(Preparing Oil Agent Composition)

Ester compounds (G-1, G-2) were stirred into ester compound (B-1) in which an antioxidant was heated and mixed to be dispersed beforehand. Nonionic surfactants (K-6, K-7) were stirred into the mixture. After the mixture was stirred well, ion-exchange water was further added to set the concentration of the oil agent composition at 30 mass %, and the mixture was emulsified by a homo-mixer. The mean particle diameter of the micelles at that time was measured by a laser diffraction/scattering particle-size distribution analyzer (brand name: LA-910, Horiba Ltd.) and found to be approximately 1.0 μm.

Next, using a high-pressure homogenizer, the oil agent composition was dispersed until the mean particle diameter of the micelles became 0.2 μm or smaller, and an emulsion of the oil agent composition was obtained.

Types and amounts (mass %) of components in the oil agent composition are shown in Table 10.

(Producing Carbon-Fiber Precursor Acrylic Fiber Bundle)

A precursor fiber bundle to apply the oil agent composition was produced as follows. An acrylonitrile-based copolymer (composition ratio: acrylonitrile/acrylamide/methacrylic acid=96.5/2.7/0.8 (mass ratio)) was dispersed in dimethylacetamide at a rate of 21 mass % and dissolved by heating to prepare a spinning dope solution. In a 38° C. coagulation bath filled with a dimethylacetamide solution with a concentration of 67 mass %, the spinning dope solution was discharged from a spinning nozzle having 12000 holes with a hole diameter (diameter) of 50 μm to make coagulated fibers. The coagulated fibers were washed in a water tank to remove the solvent and were drawn to be three times as long to obtain a water-swollen precursor fiber bundle.

A processed-oil solution was prepared by diluting the emulsion of the oil agent composition with ion-exchange water to set a concentration of the oil agent composition at 1.3 mass %. The oil-treatment tank was filled with the prepared processed-oil solution, and the water-swollen precursor fiber bundle was introduced to the tank to apply the emulsion.

The precursor fiber bundle with the applied emulsion was subjected to dry and densification using a roller with a surface temperature of 150° C., and steam drawing was performed under 0.3 MPa pressure to make the bundle five times as long. Accordingly, a carbon-fiber precursor acrylic fiber bundle was obtained.

Bundling property and operating efficiency during the production process were evaluated, and the amount of adhered oil agent on the carbon-fiber precursor acrylic fiber bundle was measured. Also, from the measured value of the amount of adhered oil agent and the component makeup of the oil agent composition, the adhered amount of each component was obtained. The results are shown in Table 10.

(Producing Carbon-Fiber Bundle)

The carbon-fiber precursor acrylic fiber bundle was subjected to heating in a stabilization furnace with a temperature gradient of 220~260° C. to produce a stabilized fiber bundle.

Next, the stabilized fiber bundle was baked under nitrogen atmosphere for three minutes while passing through a carbonization furnace with a temperature gradient of 400~1400° C. Accordingly, a carbon-fiber bundle was obtained.

The amounts of the oil agent composition and its derivatives remaining in the stabilized fiber bundle obtained by stabilization the carbon-fiber precursor acrylic fiber bundle (remaining amount of oil agent) and the amount of Si scattered during stabilization were measured.

Also, the number of fusions in the carbon-fiber bundle and the CF tensile strength were measured. The results are shown in Table 1.

Examples 3-2~3-9

Oil agent compositions were prepared the same as in example 3-1 except that component types and amounts in each oil agent composition were changed as shown in Table 1, and carbon-fiber precursor acrylic fiber bundles and carbon-fiber bundles were produced. Then, the fiber bundles were each measured and evaluated. The results are shown in Table 10.

Comparative Examples 3-1~3-9

Oil agent compositions were prepared the same as in example 3-1 except that component types and amounts in each oil agent composition were changed as shown in Table 11, and a nonionic surfactant was added to ester compound G, a chain aliphatic ester or a mixture of the two.

The antioxidant was dispersed in advance in any of ester compound G, chain aliphatic ester or amino-modified silicone H. When amino-modified silicone H was used, it was added after a nonionic surfactant was stirred in ester compound G. In comparative examples 2-7 and 2-8 containing amino-modified silicone H but without ester compound G, a nonionic surfactant was stirred into amino-modified silicone H with an antioxidant dispersed in advance. Then, ion-exchange water was added.

Except that the oil agent compositions prepared as above were used, carbon-fiber precursor acrylic fiber bundles and carbon-fiber bundles were produced the same as in example 3-1, and were measured and evaluated. The results are shown in Table 11.

TABLE 10

| | | | example | | | | | | | | |
|---|---|---|---|---|---|---|---|---|---|---|---|
| | | | 3-1 | 3-2 | 3-3 | 3-4 | 3-5 | 3-6 | 3-7 | 3-8 | 3-9 |
| oil agent composition [mass %] | compound B | B-1 | 43 | — | 87.5 | — | 64.5 | — | — | 100 | — |
| | compound C | C-1 | — | 43 | — | 87.5 | — | 73 | 62.5 | — | 100 |
| | ester compound G | G-1 | 28.5 | 28.5 | — | 12.5 | 35.5 | 9 | 19 | — | — |
| | | G-2 | 28.5 | 28.5 | 12.5 | — | — | 18 | 19 | — | — |
| | nonionic surfactant | K-6 | 27 | 27 | 11 | 11 | — | 36 | 11 | 11 | 11 |
| | | K-7 | 13 | 13 | 11 | 11 | 5 | 36 | 12.5 | 11 | 11 |
| | antioxidant | L-2 | 3 | 3 | 2.5 | 2.5 | 2 | 9 | 1 | 2.5 | 2.5 |
| amount of adhered oil agent [mass %] | | | 1.5 | 1.4 | 1.1 | 1.3 | 1.2 | 1.0 | 1.5 | 1.2 | 1.3 |
| adhered amount of each component [mass %] | compound B | B-1 | 0.45 | — | 0.77 | — | 0.72 | — | — | 0.96 | — |
| | compound C | C-1 | — | 0.42 | — | 0.90 | — | 0.40 | 0.75 | — | 1.04 |
| | ester compound G | G-1 | 0.30 | 0.28 | — | 0.13 | 0.40 | 0.05 | 0.23 | — | — |
| | | G-2 | 0.30 | 0.28 | 0.11 | — | — | 0.10 | 0.23 | — | — |
| | nonionic surfactant | K-6 | 0.28 | 0.26 | 0.10 | 0.12 | — | 0.20 | 0.13 | 0.11 | 0.12 |
| | | K-7 | 0.14 | 0.13 | 0.10 | 0.12 | 0.06 | 0.20 | 0.15 | 0.11 | 0.12 |
| | antioxidant | L-2 | 0.03 | 0.03 | 0.02 | 0.03 | 0.02 | 0.05 | 0.01 | 0.02 | 0.02 |
| evaluation | bundling property | | A | A | A | B | B | A | A | B | B |
| | operating efficiency | | A | A | A | A | A | A | A | A | A |
| | amount of remaining oil agent [mass %] | | 0.7 | 0.7 | 0.6 | 0.7 | 0.7 | 0.7 | 0.8 | 0.6 | 0.6 |
| | number of fusions | | A | A | A | A | A | A | A | A | A |
| | CF tensile strength [GPa] | | 5.1 | 5.2 | 5.0 | 5.0 | 4.9 | 5.1 | 5.2 | 4.6 | 4.8 |
| | amount of scattered Si [mg/kg] | | 0 | 0 | 0 | 0 | 0 | 0 | 0 | 0 | 0 |

TABLE 11

| | | | comparative example | | | | | | | | |
|---|---|---|---|---|---|---|---|---|---|---|---|
| | | | 3-1 | 3-2 | 3-3 | 3-4 | 3-5 | 3-6 | 3-7 | 3-8 | 3-9 |
| oil agent composition [mass %] | compound B | B-1 | — | — | — | — | — | — | — | — | — |
| | compound C | C-1 | — | — | — | — | — | — | — | — | — |
| | ester compound G | G-1 | 28.5 | 28.5 | — | — | 50 | — | — | — | — |
| | | G-2 | 28.5 | 28.5 | — | — | 50 | 57 | — | — | 33.4 |
| | aliphatic ester | J-1 | 43 | — | 100 | — | — | — | — | — | 33.3 |
| | | J-2 | — | 43 | — | 100 | — | — | — | — | 33.3 |
| | amino-modified silicone H | H-1 | — | — | — | — | — | 43 | — | 100 | — |
| | | H-2 | — | — | — | — | — | — | 100 | — | — |
| | nonionic surfactant | K-6 | 27 | 27 | 11 | 11 | 27 | 27 | — | 13 | 33.3 |
| | | K-7 | 13 | 13 | 11 | 11 | 13 | 13 | 9 | 13 | — |
| | antioxidant | L-2 | 3 | 3 | 2.5 | 2.5 | 3 | 3 | 2 | 7 | 33.3 |
| amount of adhered oil agent [mass %] | | | 1.6 | 1.5 | 1.1 | 1.0 | 1.3 | 1.4 | 1.5 | 1.2 | 1.4 |
| adhered amount of each component [mass %} | compound B | B-1 | — | — | — | — | — | — | — | — | — |
| | compound C | C-1 | — | — | — | — | — | — | — | — | — |
| | ester compound G | G-1 | 0.32 | 0.3 | — | — | 0.46 | — | — | — | — |
| | | G-2 | 0.32 | 0.3 | — | — | 0.46 | 0.56 | — | — | 0.28 |
| | aliphatic ester | J-1 | 0.48 | — | 0.88 | — | — | — | — | — | 0.28 |
| | | J-2 | — | 0.45 | — | 0.8 | — | — | — | — | 0.28 |
| | amino-modified silicone H | H-1 | — | — | — | — | — | 0.42 | — | 0.9 | — |
| | | H-2 | — | — | — | — | — | — | 1.35 | — | — |
| | nonionic surfactant | K-6 | 0.3 | 0.29 | 0.1 | 0.09 | 0.25 | 0.27 | — | 0.12 | 0.28 |
| | | K-7 | 0.15 | 0.14 | 0.1 | 0.09 | 0.12 | 0.13 | 0.12 | 0.12 | — |
| | antioxidant | L-2 | 0.03 | 0.03 | 0.02 | 0.02 | 0.03 | 0.03 | 0.03 | 0.06 | 0.28 |
| evaluation | bundling property | | B | B | C | C | B | A | A | A | C |
| | operating efficiency | | B | B | C | C | A | A | A | A | C |
| | amount of remaining oil agent [mass %] | | 0.6 | 0.6 | 0.2 | 0.2 | 0.5 | 0.7 | 1.1 | 0.8 | 0.4 |

TABLE 11-continued

| | comparative example | | | | | | | | |
|---|---|---|---|---|---|---|---|---|---|
| | 3-1 | 3-2 | 3-3 | 3-4 | 3-5 | 3-6 | 3-7 | 3-8 | 3-9 |
| number of fusions | C | C | C | C | C | A | A | A | C |
| CF tensile strength [GPa] | 3.9 | 4.0 | 3.5 | 3.7 | 4.2 | 5.1 | 5.3 | 5.2 | 3.8 |
| amount of scattered Si [mg/kg] | 0 | 0 | 0 | 0 | 0 | 450 | 1440 | 960 | 0 |

As clearly shown in Table 10, the amount of adhered oil agent was appropriate in each example. The bundling property of carbon-fiber precursor acrylic fiber bundles and operating efficiency in the production process were excellent.

In examples 3-4 and 3-5, in which ratios of compound B and compound C were relatively high in the oil agent compositions and triisodecyl trimellitate (G-1) was added as ester compound G, bundling property was lower than in other examples, but not so low as to cause problems.

In all the examples, no operational issues were identified that would affect the continuous production of carbon-fiber bundles.

In each example, the remaining amounts of the oil agent composition and its derivative in the stabilized fiber bundle after the stabilization process were sufficient to exhibit the function of the oil agent composition. It was found that the oil agent composition was effective until stabilization was completed.

The carbon-fiber bundle obtained in each example showed substantially no fused fibers, CF tensile strength was high and mechanical characteristics were excellent. In addition, since no silicone was contained, substantially no Si was observed scattered during the heating process. Thus, the process load in the heating process was low.

Differences were observed in the CF tensile strength of a carbon-fiber bundle depending on component types and amounts in each oil agent composition. The CF tensile strength of carbon fibers was especially high when compound B or compound C and two types of ester compounds G were used (examples 3-1, 3-2, 3-6, 3-7).

If the types and amounts of components except for compounds B and C (cyclohexanedicarboxylate) were the same, but the type of cyclohexanedicarboxylate was different (examples 3-1 and 3-2), the CF tensile strength of the carbon-fiber bundle was higher when ester compound (B-2) made of 1,4-cyclohexanedicarboxylic acid, oleic alcohol and 3-methyl-1,5-pentadiol (molar ratio of 2.0:2.0:1.0) was used as cyclohexanedicarboxylate (example 3-2).

Examples 3-8 and 3-9 prepared without adding ester compound G showed lower CF tensile strength of carbon-fiber bundles than that in examples 3-1~3-7.

On the other hand, as is clear in Table 11, when chain aliphatic esters (J-1, J-2) were used instead of compounds (B) and (C) (comparative examples 3-1~3-4, 3-9), the amount of adhered oil agent was appropriate and substantially no Si was observed scattered in the heating process. However, bundling property was not always sufficient. In addition, operating efficiency was low and more fused fibers were observed. Further, the CF tensile strength of carbon-fiber bundles was lower than that in each example.

Especially, in comparative examples 3-3 and 3-4, in which an oil agent composition did not contain ester compound G and was made of a chain aliphatic ester, nonionic surfactants and antioxidants, the amounts of the oil agent composition and its derivative remaining in the stabilized fiber bundle were low after the stabilization process, indicating that the oil agent composition did not remain effective during stabilization. The CF tensile strength was notably low.

In comparative example 3-9 containing a greater amount of antioxidant, bundling property and operating efficiency were low, more fused fibers were observed in the obtained carbon-fiber bundles, and CF tensile strength was notably lower than that of each example.

When ester compound G and nonionic surfactants were used (comparative example 3-5), bundling property and operating efficiency were excellent, the amount of Si scattered during stabilization was substantially zero, but a greater number of fused fibers was observed in the produced carbon-fiber bundles, and the CF tensile strength was notably lower than that of each example.

When amino-modified silicone H was contained (comparative examples 3-6~3-8) bundling property and operating efficiency were excellent, and greater amounts of remaining oil agent composition and its derivative were found in stabilized fibers after stabilization, and there was no fusion in carbon-fiber bundles. In addition, CF tensile strength was about the same as in each example. However, the Si amount scattered during stabilization was greater due to the use of silicone, resulting in a process load in the heating process that was too great to allow continuous industrial operation.

Example 4-1

(Preparing Oil Agent Composition and Processed-Oil Solution)

Cyclohexanedicarboxylate (B-1) was used as the oil agent, into which an antioxidant was heated and dispersed. Nonionic surfactants (K-1, K-4) were added to the mixture and stirred well to prepare an oil agent composition.

While the oil agent composition was stirred, ion-exchange water was added to set the concentration of the oil agent composition at 30 mass %, and the mixture was emulsified by a homo-mixer. The mean particle diameter of the micelles at that time was measured by a laser diffraction/scattering particle-size distribution analyzer (brand name: LA-910, Horiba Ltd.) and found to be approximately 1.0 μm.

Next, using a high-pressure homogenizer, the oil agent composition was dispersed until the mean particle diameter of the micelles became 0.01~0.2 μm, and an emulsion of the oil agent composition was obtained. The emulsion was further diluted with ion-exchange water to prepare a processed-oil solution with an oil agent composition concentration of 1.3 mass %.

Types and amounts (mass %) of components in the oil agent composition are shown in Table 12.

(Producing Carbon-Fiber Precursor Acrylic Fiber Bundle)

A precursor fiber bundle to apply the oil agent was prepared as follows. An acrylonitrile-based copolymer (composition ratio: acrylonitrile/acrylamide/methacrylic acid=96.5/2.7/0.8 (mass ratio)) was dispersed in dimethylacetamide at a rate of 21 mass % and dissolved by heating to prepare a spinning dope solution. In a 38° C. coagulation bath filled with a dimethylacetamide solution with a concentration of 67 mass %, the spinning dope solution was discharged from a spinning nozzle having 50000 holes with a hole diameter (diameter) of 50 μm to make coagulated fibers. The coagulated fibers were washed in a water tank to remove the solvent and were drawn to be three times as long to obtain a water-swollen precursor fiber bundle.

The water-swollen precursor fiber bundle was introduced into the oil-treatment tank filled with the processed-oil solution prepared as above to apply the oil agent.

The precursor fiber bundle with the applied oil agent was subjected to dry and densification using a roller with a surface temperature of 150° C., and steam drawing was performed under 0.3 MPa pressure to make the bundle five times as long. Accordingly, a carbon-fiber precursor acrylic fiber bundle was obtained. The number of filaments in the carbon-fiber precursor acrylic fiber bundle was 50000, and the single fiber fineness was 1.3 dTex.

Bundling property and operating efficiency during the production process were evaluated, and the amount of adhered oil agent on the carbon-fiber precursor acrylic fiber bundle was measured. The results are shown in Table 12.

(Producing Carbon-Fiber Bundle)

The carbon-fiber precursor acrylic fiber bundle was subjected to heat in a stabilization furnace with a temperature gradient of 220~260° C. for 40 minutes to produce a stabilized fiber bundle.

Next, the stabilized fiber bundle was baked under a nitrogen atmosphere for three minutes while passing through a carbonization furnace with a temperature gradient of 400~1400° C. Accordingly, a carbon-fiber bundle was obtained.

The amount of Si scattered during stabilization was measured. Also, the number of fusions in the carbon-fiber bundle and the CF tensile strength were measured. The results are shown in Table 12.

Examples 4-2, 4-3

Oil agent compositions and processed-oil solutions were prepared the same as in example 4-1 except that component types and amounts in each oil agent composition were changed as shown in Table 12, and carbon-fiber precursor acrylic fiber bundles and carbon-fiber bundles were produced. Then, the fiber bundles were each measured and evaluated. The results are shown in Table 12.

Comparative Examples 4-1~4-9

Oil agent compositions and processed-oil solutions were prepared the same as in example 4-1 except that component types and amounts in each oil agent composition were changed as shown in Table 12.

An antioxidant was dispersed in advance in any of an aromatic ester (ester compound G), a chain aliphatic ester or amino-modified silicone H. When amino-modified silicone H and an aromatic ester were both used, amino-modified silicone H was added after a nonionic surfactant was stirred into the aromatic ester. In comparative examples 4-7 and 4-8 containing amino-modified silicone H but not an aromatic ester or a chain aliphatic ester, ion-exchange water was added after a nonionic surfactant was stirred into amino-modified silicone H with an antioxidant already dispersed therein.

Except that the obtained processed-oil solution prepared above was used, carbon-fiber precursor acrylic fiber bundles and carbon-fiber bundles were produced the same as in example 4-1, and were measured and evaluated. The results are shown in Table 12.

TABLE 12

| | | | example | | | comparative example | | | | | | | | |
|---|---|---|---|---|---|---|---|---|---|---|---|---|---|---|
| | | | 4-1 | 4-2 | 4-3 | 4-1 | 4-2 | 4-3 | 4-4 | 4-5 | 4-6 | 4-7 | 4-8 | 4-9 |
| oil agent composition [mass %] | compound B | B-1 | 100 | — | — | — | — | — | — | — | — | — | — | — |
| | compound C | C-1 | — | 100 | — | — | — | — | — | — | — | — | — | — |
| | | C-2 | — | — | 100 | — | — | — | — | — | — | — | — | — |
| | ester compound G | G-1 | — | — | — | 35.5 | 35.5 | — | — | 50 | — | — | — | — |
| | | G-2 | — | — | — | 35.5 | 35.5 | — | — | 50 | 43 | — | — | 42 |
| | aliphatic ester | J-1 | — | — | — | 29 | — | 100 | — | — | — | — | — | 29 |
| | | J-2 | — | — | — | — | 29 | — | 100 | — | — | — | — | 29 |
| | amino-modified silicone H | H-1 | — | — | — | — | — | — | — | — | 57 | — | 100 | — |
| | | H-2 | — | — | — | — | — | — | — | — | — | 100 | — | — |
| | nonionic surfactant | K-1 | 27 | 27 | 27 | 27 | 27 | 6 | 6 | 40 | 27 | — | 30 | 28 |
| | | K-4 | 13 | 13 | 13 | 13 | 13 | 16 | 16 | 23 | 13 | 23 | 15 | — |
| | antioxidant | L-1 | 3 | 3 | 3 | 3 | 3 | 2.5 | 2.5 | 3 | 3 | 2.5 | 8 | 14 |
| amount of adhered oil agent [mass %] | | | 1.0 | 1.1 | 0.9 | 0.8 | 0.7 | 0.9 | 1.1 | 0.8 | 1.1 | 1.2 | 1.0 | 1.2 |
| adhered amount of each component [mass %] | compound B | B-1 | 0.70 | — | — | — | — | — | — | — | — | — | — | — |
| | compound C | C-1 | — | 0.77 | — | — | — | — | — | — | — | — | — | — |
| | | C-2 | — | — | 0.63 | — | — | — | — | — | — | — | — | — |
| | ester compound G | G-1 | — | — | — | 0.20 | 0.17 | — | — | 0.24 | — | — | — | — |
| | | G-2 | — | — | — | 0.20 | 0.17 | — | — | 0.24 | 0.33 | — | — | 0.35 |
| | aliphatic ester | J-1 | — | — | — | 0.16 | — | 0.72 | — | — | — | — | — | 0.25 |
| | | J-2 | — | — | — | — | 0.14 | — | 0.88 | — | — | — | — | 0.25 |
| | amino-modified silicone H | H-1 | — | — | — | — | — | — | — | — | 0.44 | — | 0.65 | — |
| | | H-2 | — | — | — | — | — | — | — | — | — | 0.96 | — | — |
| | nonionic surfactant | K-1 | 0.19 | 0.20 | 0.17 | 0.15 | 0.13 | 0.04 | 0.05 | 0.19 | 0.21 | — | 0.20 | 0.24 |
| | | K-4 | 0.09 | 0.10 | 0.08 | 0.07 | 0.06 | 0.12 | 0.14 | 0.11 | 0.10 | 0.22 | 0.10 | — |
| | antioxidant | L-1 | 0.02 | 0.02 | 0.02 | 0.02 | 0.01 | 0.02 | 0.02 | 0.01 | 0.02 | 0.02 | 0.05 | 0.12 |
| | bundling property | | A | A | A | B | B | C | C | B | A | A | A | B |
| | operating efficiency | | A | A | A | B | B | C | C | A | A | A | A | B |
| | number of fusions | | A | A | A | C | C | C | C | C | A | A | A | C |
| | CF tensile strength [GPa] | | 4.6 | 4.7 | 4.6 | 3.9 | 4.0 | 3.4 | 3.6 | 4.1 | 5.0 | 5.2 | 5.1 | 3.5 |

TABLE 12-continued

| | example | | | comparative example | | | | | | | | |
|---|---|---|---|---|---|---|---|---|---|---|---|---|
| | 4-1 | 4-2 | 4-3 | 4-1 | 4-2 | 4-3 | 4-4 | 4-5 | 4-6 | 4-7 | 4-8 | 4-9 |
| amount of scattered Si [mg/kg] | 0 | 0 | 0 | 0 | 0 | 0 | 0 | 0 | 60 | 1280 | 830 | 0 |

As clearly shown in Table 12, the amount of adhered oil agent was appropriate in each example. The bundling property of carbon-fiber precursor acrylic fiber bundles and operating efficiency in the production process were excellent. In all the examples, no operational issues were identified that would affect the continuous production of carbon-fiber bundles.

Also, substantially no fusion was found among single fibers in the carbon-fiber bundles produced in each example, the CF tensile strength was high, and mechanical characteristics were excellent. In addition, since no silicone was contained, the amount of Si scattered in the heating process was substantially zero. Thus, the process load in the heating process was low.

The CF tensile strength of a carbon-fiber bundle obtained in each example was higher than those in comparative examples 4-1~4-5 and 4-9, prepared using oil agent compositions that do not have amino-modified silicone H. When the components and their amounts except for a cyclohexanedicarboxylate were the same and the structure of the cyclohexanedicarboxylate was different (examples 4-1~4-3), the CF tensile strength of carbon-fiber bundles was high in example 4-2 in which the oil agent was cyclohexanedicarboxylate (C-1) made of cyclohexanedicarboxylic acid, oleic alcohol and 3-methyl-1,5-pentadiol (molar ratio of 2.0:2.0:1.0).

On the other hand, instead of cyclohexanedicarboxylate, when a chain aliphatic ester or a chain aliphatic ester and aromatic ester (ester compound G) were used (comparative examples 4-1~4-4, 4-9), the amount of adhered oil agent was appropriate and substantially no Si was observed scattered in the heating process. However, bundling property of carbon-fiber precursor acrylic fiber bundles and operating efficiency during the fiber production were low, and quite a few fused fibers were observed in the obtained carbon-fiber bundles. Moreover, the CF tensile strength of carbon-fiber bundles was lower than that in each example.

Especially, when the oil agent composition did not contain an aromatic ester and was made of a chain aliphatic ester, nonionic surfactants and an antioxidant (comparative examples 4-3, 4-4), bundling property, operating efficiency and CF tensile strength were notably low.

When the oil agent composition contained an aromatic ester but the amount of an antioxidant was great (comparative example 4-9), CF tensile strength was notably low.

When only an aromatic ester was used instead of a cyclohexanedicarboxylate (comparative example 4-5), operating efficiency was excellent, and substantially no Si was observed scattered during stabilization. However, bundling property of the obtained carbon-fiber precursor acrylic fiber bundle was low. In addition, a greater number of fused fibers were observed in the carbon-fiber bundle, and CF tensile strength was notably lower than that in each example.

When amino-modified silicone H was contained (comparative examples 4-6, 4-7, 4-8), excellent bundling property and operating efficiency were achieved, while substantially no fused fibers were observed in the produced carbon-fiber bundles. CF tensile strength was substantially the same as that in each example. However, the Si amount scattered during stabilization was greater due to the use of silicone, resulting in a process load in the heating process that was too great to allow continuous industrial operation.

Example 5-1

(Preparing Oil Agent Composition)

Nonionic surfactants (K-5~K-7) were stirred into ester compound (D-1) with an already dissolved antioxidant therein and amino-modified silicone H1 was added. Ion-exchange water was further added to set the concentration of the oil agent composition at 30 mass %, and the mixture was emulsified by a homo-mixer. The mean particle diameter of the micelles at that time was measured by a laser diffraction/scattering particle-size distribution analyzer (brand name: LA-910, Horiba Ltd.) and found to be approximately 2 μm.

Next, using a high-pressure homogenizer, the oil agent composition was dispersed until the mean particle diameter of the micelles became 0.2 μm or smaller, and an emulsion of the oil agent composition was obtained.

Types and amounts (mass %) of components in the oil agent composition are shown in Table 13.

(Producing Carbon-Fiber Precursor Acrylic Fiber Bundle)

A precursor fiber bundle on which to adhere the oil agent composition was prepared as follows. An acrylonitrile-based copolymer (composition ratio: acrylonitrile/acrylamide/methacrylic acid=96/3/1 (mass ratio)) was dissolved in dimethylacetamide to prepare a spinning dope solution. In a coagulation bath filled with a dimethylacetamide solution, the spinning dope solution was discharged from a spinning nozzle having 12000 holes with a hole diameter (diameter) of 50 μm to make coagulated fibers. The coagulated fibers were washed in a water tank to remove the solvent and were drawn to be three times as long to obtain a water-swollen precursor fiber bundle.

A processed-oil solution was prepared by diluting the emulsion of the oil agent composition with ion-exchange water to set a concentration of the oil agent composition at 1.3 mass %. The oil-treatment tank was filled with the prepared processed-oil solution, and the water-swollen precursor fiber bundle was introduced to the tank to apply the emulsion.

The precursor fiber bundle with the applied emulsion was subjected to dry and densification using a roller with a surface temperature of 180° C., and steam drawing was performed under 0.2 MPa pressure to make the bundle five times as long. Accordingly, a carbon-fiber precursor acrylic fiber bundle was obtained.

Bundling property during the production process was evaluated, and the amount of adhered oil agent on the carbon-fiber precursor acrylic fiber bundle was measured. Also, from the measured value of the amount of adhered oil agent and the component makeup of the oil agent composition, the adhered amount of each component was obtained. The results are shown in Table 13. Moreover, operational stability of the carbon-fiber precursor acrylic fiber bundle during the production process was evaluated, and those results also are shown in Table 13.

(Producing Carbon-Fiber Bundle)

The carbon-fiber precursor acrylic fiber bundle was subjected to heating in a stabilization furnace with a temperature gradient of 220~260° C. to produce a stabilized fiber bundle. Next, the stabilized fiber bundle was baked under a nitrogen atmosphere in a carbonization furnace with a temperature gradient of 400~1300° C. Accordingly, a carbon-fiber bundle was obtained.

The amount of Si scattered during stabilization was measured. Also, the number of fusions in the carbon-fiber bundle and the CF tensile strength were measured. The results are shown in Table 13.

Examples 5-2~5-11

Oil agent compositions were prepared the same as in example 5-1 except that the component types and amounts in each oil agent composition were changed as shown in Table 13, and carbon-fiber precursor acrylic fiber bundles and carbon-fiber bundles were produced. Then, the fiber bundles were each measured and evaluated. The results are shown in Table 13.

Comparative Examples 5-1~5-8

Oil agent compositions were prepared the same as in example 5-1 except that the component types and amounts in each oil agent composition were changed as shown in Table 14, and carbon-fiber precursor acrylic fiber bundles and carbon-fiber bundles were produced. Then, the fiber bundles were each measured and evaluated. The results are shown in Table 14.

TABLE 13

| | | | example | | | | | | | | | | |
|---|---|---|---|---|---|---|---|---|---|---|---|---|---|
| | | | 5-1 | 5-2 | 5-3 | 5-4 | 5-5 | 5-6 | 5-7 | 5-8 | 5-9 | 5-10 | 5-11 |
| oil agent composition [mass %] | compound D | D-1 | 60 | — | — | — | — | — | — | — | 57 | — | — |
| | | D-2 | — | — | 60 | — | — | — | — | — | — | — | — |
| | | D-3 | — | — | — | — | — | — | — | — | — | 57 | — |
| | compound E | E-1 | — | 60 | — | 40 | 80 | 40 | 89 | 57 | — | — | 57 |
| | amino-modified silicone H | H-1 | 20 | — | — | 40 | 5 | 35 | — | — | — | — | — |
| | | H-3 | — | 20 | — | — | — | — | — | — | — | — | — |
| | | H-4 | — | — | 20 | — | — | — | — | — | — | — | — |
| | nonionic surfactant | K-6 | 9 | 9 | 9 | 9 | 5 | 10 | 5 | 20 | 20 | 20 | 20 |
| | | K-5 | 5 | 5 | 5 | 5 | 5 | 10 | 5 | 20 | 20 | 20 | 20 |
| | | K-7 | 5 | 5 | 5 | 5 | 4 | — | — | — | — | — | — |
| | antioxidant | L-2 | 1 | 1 | 1 | 1 | 1 | 5 | 1 | 3 | 3 | 3 | 3 |
| amount of adhered oil agent [mass %] | | | 1.1 | 1.4 | 1.3 | 1.2 | 1.6 | 1.2 | 1.5 | 1.5 | 0.8 | 0.8 | 0.9 |
| adhered amount of each component [mass %] | compound D | D-1 | 0.67 | — | — | — | — | — | — | — | 0.47 | — | — |
| | | D-2 | — | — | 0.79 | — | — | — | — | — | — | — | — |
| | | D-3 | — | — | — | — | — | — | — | — | — | 0.47 | — |
| | compound E | E-1 | — | 0.85 | — | 0.48 | 1.27 | 0.48 | 1.34 | 0.86 | — | — | 0.53 |
| | amino-modified silicone H | H-1 | 0.22 | — | — | 0.48 | 0.08 | 0.43 | — | — | — | — | — |
| | | H-3 | — | 0.28 | — | — | — | — | — | — | — | — | — |
| | | H-4 | — | — | 0.26 | — | — | — | — | — | — | — | — |
| | nonionic surfactant | K-6 | 0.10 | 0.12 | 0.12 | 0.11 | 0.08 | 0.12 | 0.07 | 0.30 | 0.16 | 0.16 | 0.19 |
| | | K-5 | 0.05 | 0.07 | 0.06 | 0.06 | 0.08 | 0.12 | 0.07 | 0.30 | 0.16 | 0.16 | 0.19 |
| | | K-7 | 0.05 | 0.07 | 0.06 | 0.06 | 0.07 | — | — | — | — | — | — |
| | antioxidant | L-2 | 0.01 | 0.01 | 0.01 | 0.01 | 0.01 | 0.06 | 0.01 | 0.04 | 0.02 | 0.02 | 0.03 |
| evaluation | bundling property | | A | A | A | A | A | A | A | A | A | A | A |
| | operating efficiency | | A | A | A | A | A | A | A | A | A | A | A |
| | number of fusions | | A | A | A | A | A | A | A | A | A | A | A |
| | CF tensile strength [GPa] | | 5.3 | 5.4 | 5.2 | 5.5 | 5.3 | 5.3 | 5.1 | 5.0 | 4.8 | 4.8 | 4.9 |
| | amount of scattered Si [mg/kg] | | 180 | 210 | 220 | 440 | 60 | 380 | 0 | 0 | 0 | 0 | 0 |

TABLE 14

| | | | comparative example | | | | | | | |
|---|---|---|---|---|---|---|---|---|---|---|
| | | | 5-1 | 5-2 | 5-3 | 5-4 | 5-5 | 5-6 | 5-7 | 5-8 |
| oil agent composition [mass %] | ester compound G | G-2 | 60 | — | — | — | 80 | — | — | — |
| | | G-3 | — | 60 | — | — | — | — | — | — |
| | aliphatic ester | J-3 | — | — | 60 | — | — | — | — | — |
| | | J-4 | — | — | — | 60 | — | 40 | — | — |
| | amino-modified silicone H | H-1 | 20 | — | — | — | — | — | 90 | — |
| | | H-3 | — | 20 | — | — | — | — | — | — |
| | | H-4 | — | — | 20 | — | — | — | — | — |
| | | H-5 | — | — | — | 20 | — | — | — | 80 |
| | nonionic surfactant | K-6 | 9 | 9 | 9 | 9 | 9 | 25 | — | 5 |
| | | K-5 | 5 | 5 | 5 | 5 | 5 | 25 | — | 5 |
| | | K-7 | 5 | 5 | 5 | 5 | 5 | 3 | 9 | 9 |
| | antioxidant | L-2 | 1 | 1 | 1 | 1 | 1 | 7 | 1 | 1 |

TABLE 14-continued

| | | | comparative example | | | | | | | |
|---|---|---|---|---|---|---|---|---|---|---|
| | | | 5-1 | 5-2 | 5-3 | 5-4 | 5-5 | 5-6 | 5-7 | 5-8 |
| amount of adhered oil agent [mass %] | | | 1.3 | 1.2 | 1.3 | 1.4 | 1.5 | 1.4 | 1.2 | 1.1 |
| adhered | ester compound G | G-2 | 0.79 | — | — | — | 1.21 | — | — | — |
| amount | | G-3 | — | 0.73 | — | — | — | — | — | — |
| of each | aliphatic ester | J-3 | — | — | 0.79 | — | — | — | — | — |
| component | | J-4 | — | — | — | 0.85 | — | 0.56 | — | — |
| [mass %] | amino-modified silicone H | H-1 | 0.26 | — | — | — | — | — | 1.08 | — |
| | | H-3 | — | 0.24 | — | — | — | — | — | — |
| | | H-4 | — | — | 0.26 | — | — | — | — | — |
| | | H-5 | — | — | — | 0.28 | — | — | — | 0.89 |
| | nonionic surfactant | K-6 | 0.12 | 0.11 | 0.12 | 0.12 | 0.13 | 0.35 | — | 0.05 |
| | | K-5 | 0.06 | 0.06 | 0.06 | 0.07 | 0.07 | 0.35 | — | 0.05 |
| | | K-7 | 0.06 | 0.06 | 0.06 | 0.07 | 0.07 | 0.04 | 0.11 | 0.10 |
| | antioxidant | L-2 | 0.01 | 0.01 | 0.01 | 0.01 | 0.01 | 0.10 | 0.01 | 0.01 |
| evaluation | e bundling property | | A | C | B | C | A | C | A | A |
| | operating efficiency | | B | C | C | C | B | C | A | A |
| | number of fusions | | C | C | C | C | C | C | A | A |
| | CF tensile strength [GPa] | | 4.5 | 4.6 | 4.5 | 4.4 | 4.2 | 3.9 | 5.1 | 5.0 |
| | amount of scattered Si [mg/kg] | | 250 | 280 | 190 | 230 | 0 | 0 | 1050 | 920 |

As clearly shown in Table 13, the amount of adhered oil agent was appropriate in each example. The bundling property of carbon-fiber precursor acrylic fiber bundles and operating efficiency in the production process were excellent. In all the examples, no operational issues were identified that would affect the continuous production of carbon-fiber bundles.

Also, substantially no fusion was found among single fibers in the carbon-fiber bundles produced in each example, the CF tensile strength was high, and mechanical characteristics were excellent. In addition, the amount of Si scattered in the heating process was low. Thus, the process load in the heating process was low.

Regarding example 5-4 containing 40 mass % of amino-modified silicone (H-1) in the oil agent composition, and example 5-6 containing 35 mass % of amino-modified silicone (H-1) in the oil agent composition, a greater amount of Si compound was observed scattered during the heating process, but the amount was not at a level that would cause problems.

Differences were observed in the CF tensile strength of a carbon-fiber bundle depending on component types and amounts in each oil agent composition. Especially high CF tensile strength of carbon fibers was observed when ester compound (E-1) made of 1,4-cyclohexanedimethanol, oleic acid and dimer acid (molar ratio of 1.0:1.25:0.375) was used (example 5-2). When the same ester compound (E-1) was used and the amount of amino-modified silicone (H-1) was 40 mass % (example 5-4), CF tensile strength of the carbon-fiber bundle was high.

In example 5-6, the content of amino-modified silicone (H-1) is relatively high, but the CF tensile strength was almost the same as that of other examples. That is because the amount of added antioxidant was greater than that in the other examples, preventing higher CF tensile strength of the carbon-fiber bundle from being expressed.

Examples 5-7 and 5-8 without amino-modified silicone H showed lower CF tensile strength of carbon-fiber bundles than those in examples 5-1~5-6.

On the other hand, as is clear in Table 14, in comparative example 5-1, containing polyoxyethylene bisphenol A lauric acid ester (G-1) instead of compound D and compound E, the amount of oil agent adhered to carbon-fiber precursor acrylic fiber bundle was appropriate, bundling property was excellent, and the amount of Si was observed scattered in the heating process was low. However, operating efficiency was a bit low. Moreover, quite a few fused single fibers were observed in the obtained carbon-fiber bundle, and the CF tensile strength was notably low relative to that in each of the examples.

Regarding comparative example 5-2, containing dioctyl phthalate (G-2) instead of compounds (D, E), comparative example 5-3, containing polyethylene glycol diacrylate (J-3), and comparative example 5-4 containing pentaerythritol tetrastearate (J-4), the Si amount scattered in the heating process was small, but bundling property of the produced carbon-fiber precursor acrylic fiber bundle and operating efficiency in the production process were significantly low, and it was difficult to perform continuous industrial production. There were many fused single fibers in carbon-fiber bundles, and CF tensile strength was notably low compared with that in each example.

Regarding comparative example 5-5 prepared using polyoxyethylene bisphenol A lauric acid ester (G-1) instead of compounds (D, E) and without containing amino-modified silicone H, bundling property of the obtained carbon-fiber precursor acrylic fiber bundle was excellent and no Si was observed scattered in the heating process. However, the number of fusions in the carbon-fiber bundle was high, and CF tensile strength was notably low relative to that in each example.

Regarding comparative example 5-6, containing pentaerythritol tetrastearate (J-4) instead of compounds (D, E) and containing no amino-modified silicone H, no Si was observed scattered in the heating process, but bundling property of the produced carbon-fiber precursor acrylic fiber bundle and operating efficiency in the production process were low, and it was difficult to perform continuous industrial production. Since a greater number of fusions was found in the carbon-fiber bundles and the CF tensile strength was notably low, a high-quality carbon-fiber bundle was hard to obtain.

Regarding comparative examples 5-7 and 5-8 containing amino-modified silicone H as a main component, bundling property of the produced carbon-fiber precursor acrylic fiber bundles and operating efficiency in the production process were low, and the number of fused fibers found in the carbon-fiber bundles and CF tensile strength were about the same as those in each example. However, a significantly greater amount of Si was observed scattered during the heating process, resulting in a process load in the heating process that was too great to allow continuous industrial operation.

Example 6-1

(Preparing Oil Agent Composition and Processed-Oil Solution)

Cyclohexanedimethanol ester (D-1) was used as the oil agent, to which an antioxidant was added and dissolved. Nonionic emulsifiers (K-8, K-9) were further added and stirred well to prepare an oil agent composition.

Then, while the oil agent composition was being stirred, ion-exchange water was added to set the concentration of the oil agent composition at 30 mass %, and the mixture was emulsified by a homo-mixer. The mean particle diameter of the micelles at that time was measured by a laser diffraction/scattering particle-size distribution analyzer (brand name: LA-910, Horiba Ltd.) and found to be approximately 2.0 μm.

Next, using a high-pressure homogenizer, the oil agent composition was dispersed until the mean particle diameter of the micelles became 0.01~0.2 μm, and an emulsion of the oil agent composition was obtained. The emulsion was further diluted with ion-exchange water to prepare a processed-oil solution with a concentration of the oil agent composition set at 1.0 mass %.

Types and amounts (mass %) of components in the oil agent composition are shown in Table 15.

(Producing Carbon-Fiber Precursor Acrylic Fiber Bundle)

A precursor fiber bundle on which to adhere the oil agent composition was prepared as follows. An acrylonitrile-based copolymer (composition ratio: acrylonitrile/acrylamide/methacrylic acid=96/3/1 (mass ratio)) was dissolved in dimethylacetamide to prepare a spinning dope solution. In a coagulation bath filled with a dimethylacetamide solution, the spinning dope solution was discharged from a spinning nozzle having 60000 holes with a hole diameter (diameter) of 50 μm to make coagulated fibers. The coagulated fibers were washed in a water tank to remove the solvent and were drawn to be three times as long to obtain a water-swollen precursor fiber bundle.

The water-swollen precursor fiber bundle was introduced into the oil-treatment tank filled with the processed-oil solution prepared as above to apply the oil agent on the precursor fiber bundle.

The precursor fiber bundle with the applied oil agent was subjected to dry and densification using a roller with a surface temperature of 180° C., and steam drawing was performed under 0.2 MPa pressure to make the bundle five times as long. Accordingly, a carbon-fiber precursor acrylic fiber bundle was obtained. The number of filaments in the carbon-fiber precursor acrylic fiber bundle was 60000, and the single fiber fineness was 1.2 dTex.

Bundling property and operating efficiency during the production process were evaluated, and the amount of adhered oil agent on the carbon-fiber precursor acrylic fiber bundle was measured. The results are shown in Table 15.

(Producing Carbon-Fiber Bundle)

The carbon-fiber precursor acrylic fiber bundle was subjected to heat in a stabilization furnace with a temperature gradient of 220~260° C. to produce a stabilized fiber bundle.

Next, the stabilized fiber bundle was baked under a nitrogen atmosphere in a carbonization furnace with a temperature gradient of 400~1350° C. Accordingly, a carbon-fiber bundle was obtained.

The amount of Si scattered during stabilization was measured. Also, the number of fusions in the carbon-fiber bundle and the CF tensile strength were measured. The results are shown in Table 15.

Examples 6-2~6-5

Oil agent compositions and processed-oil solutions were prepared the same as in example 6-1 except that component types and amounts in each oil agent composition were changed as shown in Table 15, and carbon-fiber precursor acrylic fiber bundles and carbon-fiber bundles were produced. Then, the fiber bundles were each measured and evaluated. The results are shown in Table 15.

Comparative Examples 6-1~6-8

Oil agent compositions and processed-oil solutions were prepared the same as in example 6-1 except that component types and amounts in each oil agent composition were changed as shown in Table 15.

An antioxidant was dispersed in advance in any of an aromatic ester (ester compound G), an aliphatic ester or amino-modified silicone H. When amino-modified silicone H and an ester were both used, amino-modified silicone H was added after a nonionic emulsifier was stirred into the ester. In comparative example 6-8 containing amino-modified silicone H but not an aromatic ester or an aliphatic ester, ion-exchange water was added after a nonionic emulsifier was stirred into amino-modified silicone H with an antioxidant already dispersed therein.

Except that the processed-oil solutions prepared as above were used, carbon-fiber precursor acrylic fiber bundles and carbon-fiber bundles were produced the same as in example 6-1, and were measured and evaluated. The results are shown in Table 15.

TABLE 15

| | | | example | | | | | comparative example | |
|---|---|---|---|---|---|---|---|---|---|
| | | | 6-1 | 6-2 | 6-3 | 6-4 | 6-5 | 6-1 | 6-2 |
| oil agent composition [mass %] | compound D | D-1 | 100 | — | — | — | — | — | — |
| | | D-3 | — | — | — | 100 | — | — | — |
| | compound E | E-1 | — | 100 | 100 | — | — | — | — |
| | | E-2 | — | — | — | — | 100 | — | — |
| | ester compound G | G-2 | — | — | — | — | — | 63 | — |
| | | G-3 | — | — | — | — | — | — | 63 |
| | aliphatic ester | J-3 | — | — | — | — | — | — | — |
| | | J-4 | — | — | — | — | — | — | — |

TABLE 15-continued

| | | | | | | | | | |
|---|---|---|---|---|---|---|---|---|---|
| | amino-modified silicone H | H-7 | — | — | — | — | — | 37 | — |
| | | H-8 | — | — | — | — | — | — | 37 |
| | | H-4 | — | — | — | — | — | — | — |
| | | H-5 | — | — | — | — | — | — | — |
| | nonionic surfactant | K-8 | 35 | 35 | 27 | 35 | 35 | 6 | 6 |
| | | K-9 | 35 | 35 | — | 35 | 35 | 11 | 11 |
| | | K-4 | — | — | — | — | — | 6 | 6 |
| | antioxidant | L-1 | 5 | 5 | 7 | 5 | 5 | 1 | 1 |
| amount of adhered oil agent [mass %] | | | 0.8 | 0.8 | 0.9 | 0.8 | 0.9 | 0.8 | 0.9 |
| adhered | compound D | D-1 | 0.46 | — | — | — | — | — | — |
| amount | | D-3 | — | — | — | 0.46 | — | — | — |
| of each | compound E | E-1 | — | 0.46 | 0.67 | — | — | — | — |
| component | | E-2 | — | — | — | — | 0.51 | — | — |
| [mass %] | ester compound G | G-2 | — | — | — | — | — | 0.41 | — |
| | | G-3 | — | — | — | — | — | — | 0.46 |
| | aliphatic ester | J-3 | — | — | — | — | — | — | — |
| | | J-4 | — | — | — | — | — | — | — |
| | amino-modified silicone H | H-7 | — | — | — | — | — | 0.24 | — |
| | | H-8 | — | — | — | — | — | — | 0.27 |
| | | H-4 | — | — | — | — | — | — | — |
| | | H-5 | — | — | — | — | — | — | — |
| | | K-8 | 0.16 | 0.16 | 0.18 | 0.16 | 0.18 | 0.04 | 0.04 |
| | nonionic surfactant | K-9 | 0.16 | 0.16 | — | 0.16 | 0.18 | 0.07 | 0.08 |
| | | K-4 | — | — | — | — | — | 0.04 | 0.04 |
| | antioxidant | L-1 | 0.02 | 0.02 | 0.05 | 0.02 | 0.03 | 0.01 | 0.01 |
| evaluation | bundling property | | A | A | A | A | A | C | B |
| | operating efficiency | | A | A | A | A | A | B | C |
| | number of fusions | | A | A | A | A | A | A | A |
| | CF tensile strength [GPa] | | 4.8 | 5.0 | 4.9 | 4.8 | 4.9 | 4.4 | 4.6 |
| | amount of scattered Si [mg/kg] | | 0 | 0 | 0 | 0 | 0 | 360 | 470 |

| | | | | comparative example | | | | | |
|---|---|---|---|---|---|---|---|---|---|
| | | | | 6-3 | 6-4 | 6-5 | 6-6 | 6-7 | 6-8 |
| | oil agent | compound D | D-1 | — | — | — | — | — | — |
| | composition | | D-3 | — | — | — | — | — | — |
| | [mass %] | compound E | E-1 | — | — | — | — | — | — |
| | | | E-2 | — | — | — | — | — | — |
| | | ester compound G | G-2 | — | — | 100 | — | — | — |
| | | | G-3 | — | — | — | — | — | — |
| | | aliphatic ester | J-3 | 63 | — | — | — | — | — |
| | | | J-4 | — | 63 | — | 100 | — | — |
| | | amino-modified silicone H | H-7 | — | — | — | — | 100 | — |
| | | | H-8 | — | — | — | — | — | — |
| | | | H-4 | 37 | — | — | — | — | — |
| | | | H-5 | — | 37 | — | — | — | 100 |
| | | nonionic surfactant | K-8 | 6 | 6 | 6 | 62 | — | 6 |
| | | | K-9 | 11 | 11 | 11 | 62 | — | — |
| | | | K-4 | 6 | 6 | 6 | 7 | 10 | 10 |
| | | antioxidant | L-1 | 1 | 1 | 1 | 17 | 1 | 1 |
| | amount of adhered oil agent [mass %] | | | 0.8 | 1.0 | 0.8 | 1.1 | 1.2 | 1.3 |
| | adhered | compound D | D-1 | — | — | — | — | — | — |
| | amount | | D-3 | — | — | — | — | — | — |
| | of each | compound E | E-1 | — | — | — | — | — | — |
| | component | | E-2 | — | — | — | — | — | — |
| | [mass %] | ester compound G | G-2 | — | — | 0.65 | — | — | — |
| | | | G-3 | — | — | — | — | — | — |
| | | aliphatic ester | J-3 | 0.41 | — | — | — | — | — |
| | | | J-4 | — | 0.51 | — | 0.44 | — | — |
| | | amino-modified silicone H | H-7 | — | — | — | — | 1.08 | — |
| | | | H-8 | — | — | — | — | — | — |
| | | | H-4 | 0.24 | — | — | — | — | — |
| | | | H-5 | — | 0.3 | — | — | — | 1.11 |
| | | | K-8 | 0.04 | 0.05 | 0.04 | 0.28 | — | 0.07 |
| | | nonionic surfactant | K-9 | 0.07 | 0.09 | 0.07 | 0.28 | — | — |
| | | | K-4 | 0.04 | 0.05 | 0.04 | 0.03 | 0.11 | 0.11 |
| | | antioxidant | L-1 | 0.01 | 0.01 | 0.01 | 0.08 | 0.01 | 0.01 |
| | evaluation | bundling property | | C | C | A | C | A | A |
| | | operating efficiency | | C | C | B | C | A | A |
| | | number of fusions | | A | A | C | C | A | A |
| | | CF tensile strength [GPa] | | 4.3 | 4.0 | 4.1 | 3.8 | 5.2 | 5.1 |
| | | amount of scattered Si [mg/kg] | | 420 | 460 | 0 | 0 | 1070 | 950 |

As clearly shown in Table 15, the amount of adhered oil agent was appropriate in each example. The bundling property of carbon-fiber precursor acrylic fiber bundles and operating efficiency in the production process were excellent. In all the examples, no operational issues were identified that would affect the continuous production of carbon-fiber bundles.

Also, in carbon-fiber bundles produced in each example, substantially no fused fibers were observed among single fibers, CF tensile strength was high and mechanical characteristics were excellent. Moreover, the amount of Si scattered in the heating process was small, and the process load in the heating process was low.

In example 6-2 prepared using ester compound (E-1) made of 1,4-cyclohexanedimethanol, oleic acid and dimer acid obtained by dimerizing oleic acid, CF tensile strength of carbon-fiber bundles was higher than in example 6-1 prepared using ester compound (D-1) made of 1,4-cyclohexanedimethanol and oleic acid. By using dimer acid, cross linking was structured in ester compound (E-1), thus resulting in higher heat resistance and viscosity. Thus, when the oil agent composition is applied on fiber surfaces, it is thought that the oil agent is suppressed from moving on the fiber surface, and the oil components are hardly ever applied unevenly and are spread uniformly on fiber surfaces.

The CF tensile strength of the carbon-fiber bundle was lower in example 6-3 than in example 6-2. That is because the amount of added antioxidant was relatively greater in example 6-3 than in example 6-2, preventing higher CF tensile strength from being expressed.

When example 6-4 using ester compound (D-3) and example 6-5 using ester compound (E-2) were compared, evaluation results were substantially the same, but the CF tensile strength of example 6-5 was higher. That is thought to be because of the cross-linking effects of dimer acid the same as above.

On the other hand, in comparative example 6-1, containing polyoxyethylene bisphenol A lauric ester (G-2) instead of cyclohexanedimethanol ester, the amount of adhered oil agent was appropriate, and the evaluation of the number of fused fibers in the carbon-fiber bundle was excellent, about the same as in each example. However, bundling property of the obtained carbon-fiber precursor acrylic fiber bundle was low and operating efficiency in the production process was rather low. CF tensile strength of the produced carbon-fiber bundle was notably low compared with each example.

The amount of Si scattered during the heating process was 360 mg/kg.

Instead of cyclohexanedimethanol ester, comparative example 6-2 was prepared using dioctyl phthalate (G-3), comparative example 6-3 used polyethylene glycol diacrylate (J-3), and comparative example 6-4 used pentaerythritol tetrastearate (J-4). In those comparative examples, the evaluation results on the number of fused fibers in carbon-fiber bundles were excellent, about the same level of each example. However, bundling property of carbon-fiber precursor acrylic fiber bundles and operating efficiency in the production process were significantly low, making it difficult to perform continuous industrial production. CF tensile strength of the obtained carbon-fiber bundles was notably low compared with that of each example. The amount of Si scattered during the heating process was 420~470 mg/kg.

In comparative example 6-5, which contained polyoxyethylene bisphenol A lauric acid ester (G-2) instead of cyclohexanedimethanol ester and did not contain amino-modified silicone H, no Si was observed scattered in the heating process, but bundling property of the carbon-fiber precursor acrylic fiber bundle was low and operating efficiency in the production process was slightly low. Also, more fused fibers among single fibers were found in the obtained carbon-fiber bundle, and CF tensile strength was notably low compared with that of each example.

In comparative example 6-6, which contained pentaerythritol tetrastearate (J-4) instead of cyclohexanedimethanol ester and did not contain amino-modified silicone H, no Si was observed scattered in the heating process, but bundling property of the carbon-fiber precursor acrylic fiber bundle and operating efficiency in the production process were low, making it difficult to perform continuous industrial operations. Also, since more fused fibers among single fibers were found in the obtained carbon-fiber bundle, and CF tensile strength was notably low, it was difficult to obtain a high-quality carbon-fiber bundle.

In comparative examples 6-7 and 6-8 prepared by using amino-modified silicone H as a main component, bundling property of carbon-fiber precursor acrylic fiber bundles, operating efficiency during the production process, number of fused fibers found in carbon-fiber bundles, and CF tensile strength were excellent, showing approximately the same levels in each example. However, since a significantly greater amount of Si was observed scattered in the heating process, the load during the heating process was too great to perform continuous industrial operations.

Example 7-1

(Preparing Oil Agent Composition and Processed-Oil Solution)

Isophoronediisocyanate-aliphatic alcohol adduct (F-1) prepared above as an oil agent was used, into which an antioxidant was hot-mixed and dispersed. Nonionic emulsifiers (K-1, K-4) were further added and stirred to prepare an oil agent composition.

Then, while the oil agent composition was being stirred, ion-exchange water was added to set the concentration of the oil agent composition at 30 mass %, and the mixture was emulsified by a homo-mixer. The mean particle diameter of the micelles at that time was measured by a laser diffraction/scattering particle-size distribution analyzer (brand name: LA-910, Horiba Ltd.) and found to be approximately 3.0 μm.

Next, using a high-pressure homogenizer, the oil agent composition was dispersed until the mean particle diameter of the micelles became 0.2 μm or smaller, and an emulsion of the oil agent composition was obtained. The emulsion was further diluted with ion-exchange water to prepare a processed-oil solution with a concentration of the oil agent composition set at 1.3 mass %.

Types and amounts (mass %) of components in the oil agent composition are shown in Table 16.

(Producing Carbon-Fiber Precursor Acrylic Fiber Bundle)

A precursor fiber bundle on which to apply the oil agent was prepared as follows. An acrylonitrile-based copolymer (composition ratio: acrylonitrile/acrylamide/methacrylic acid=96.5/2.7/0.8 (mass ratio)) was dispersed in dimethylacetamide at a rate of 21 mass %, and heated and dissolved to prepare a spinning dope solution. In a 38° C. coagulation bath filled with a dimethylacetamide solution with a concentration of 67 mass %, the spinning dope solution was discharged from a spinning nozzle having 50000 holes with a hole diameter (diameter) of 50 μm to make coagulated fibers. The coagulated fibers were washed in a water tank to remove the solvent and were drawn to be three times as long to obtain a water-swollen precursor fiber bundle.

The water-swollen precursor fiber bundle was introduced into the oil-treatment tank filled with the processed-oil solution prepared as above to apply the oil agent on the precursor fiber bundle.

The precursor fiber bundle with the applied oil agent was subjected to dry and densification using a roller with a surface temperature of 150° C., and steam drawing was performed under 0.3 MPa pressure to make the bundle five times as long. Accordingly, a carbon-fiber precursor acrylic fiber bundle was obtained. The number of filaments in the carbon-fiber precursor acrylic fiber bundle was 50000, and the single fiber fineness was 1.2 dTex.

Bundling property and operating efficiency during the production process were evaluated, and the amount of adhered oil agent on the carbon-fiber precursor acrylic fiber bundle was measured. The results are shown in Table 16.

(Producing Carbon-Fiber Bundle)

The carbon-fiber precursor acrylic fiber bundle was subjected to heating while passing through a stabilization furnace with a temperature gradient of 220~260° C. for 40 minutes to produce a stabilized fiber bundle.

Next, the stabilized fiber bundle was baked under a nitrogen atmosphere for three minutes while passing through a carbonization furnace with a temperature gradient of 400~1400° C. Accordingly, a carbon-fiber bundle was obtained.

The amount of Si scattered during stabilization was measured. Also, the number of fusions in the carbon-fiber bundle and the CF tensile strength were measured. The results are shown in Table 16.

Examples 7-2~7-3

Oil agent compositions and processed-oil solutions were prepared the same as in example 7-1 except that component types and amounts in each oil agent composition were changed as shown in Table 16, and carbon-fiber precursor acrylic fiber bundles and carbon-fiber bundles were produced, measured and evaluated. The results are shown in Table 16.

Example 7-4

(Preparing Oil Agent Composition and Processed-Oil Solution)

An antioxidant was hot-mixed into compound (F-1) prepared above and dispersed. Nonionic surfactants (K-1, K-4) were added and stirred well, and ester compounds (G-1, G-2) were further added and stirred well to prepare an oil agent composition.

Then, while the oil agent composition was being stirred, ion-exchange water was added to set the concentration of the oil agent composition at 30 mass %, and the mixture was emulsified by a homo-mixer. The mean particle diameter of the micelles at that time was measured by a laser diffraction/scattering particle-size distribution analyzer (brand name: LA-910, Horiba Ltd.) and found to be approximately 3.0 μm.

Next, using a high-pressure homogenizer, the oil agent composition was dispersed until the mean particle diameter of the micelles became 0.2 μm or smaller, and an emulsion of the oil agent composition was obtained. The emulsion was further diluted with ion-exchange water to prepare a processed-oil solution with a concentration of the oil agent composition set at 1.3 mass %.

Types and amounts (mass %) of components in the oil agent composition are shown in Table 16.

Except that the processed-oil solution prepared above was used, a carbon-fiber precursor acrylic fiber bundle and a carbon-fiber bundle were produced the same as in example 7-1. Then, the fiber bundles were each measured and evaluated. The results are shown in Table 16.

Examples 7-5~7-9

Oil agent compositions were prepared the same as in example 7-4 except that component types and amounts in each oil agent composition were changed as shown in Table 16, and carbon-fiber precursor acrylic fiber bundles and carbon-fiber bundles were produced, measured and evaluated. The results are shown in Table 16.

Comparative Examples 7-1~7-11

Oil agent compositions and processed-oil solutions were prepared the same as in example 7-1 or 7-4 except that component types and amounts in each oil agent composition were changed as shown in Table 17.

In comparative examples 7-1~7-9 prepared without using compound F, the antioxidant was dispersed in advance into any of ester compound G, chain aliphatic ester or amino-modified silicone H.

In comparative example 7-6 prepared using both amino-modified silicone H and ester compound (aromatic ester) G, amino-modified silicone H was added after a nonionic surfactant was stirred into the ester compound (aromatic ester) G In comparative examples 7-7 and 7-8 prepared by using amino-modified silicone H but without ester compound (aromatic ester) G or a chain aliphatic ester, ion-exchange water was added after a nonionic surfactant was stirred into amino-modified silicone H with an antioxidant dispersed therein.

Except that the processed-oil solutions prepared above were used, carbon-fiber precursor acrylic fiber bundles and carbon-fiber bundles were produced the same as in example 7-1. Then, the fiber bundles were each measured and evaluated. The results are shown in Table 17.

TABLE 16

| | | | example | | | | | | | | |
|---|---|---|---|---|---|---|---|---|---|---|---|
| | | | 7-1 | 7-2 | 7-3 | 7-4 | 7-5 | 7-6 | 7-7 | 7-8 | 7-9 |
| oil agent composition [mass %] | isoholondiisocyanate-aliphatic alcohol adduct | F-1 | 100 | 100 | 100 | 10 | 29 | 50 | 50 | 50 | 95 |
| | ester compound G | G-1 | — | — | — | 45 | 35.5 | 25 | 50 | 50 | 5 |
| | | G-2 | — | — | — | 45 | 35.5 | 25 | — | — | — |
| | aliphatic ester | J-1 | — | — | — | — | — | — | — | — | — |
| | | J-2 | — | — | — | — | — | — | — | — | — |

TABLE 16-continued

| | | | example | | | | | | | | |
|---|---|---|---|---|---|---|---|---|---|---|---|
| | | | 7-1 | 7-2 | 7-3 | 7-4 | 7-5 | 7-6 | 7-7 | 7-8 | 7-9 |
| | amino-modified silicone H | H-1 | — | — | — | — | — | — | — | — | — |
| | | H-2 | — | — | — | — | — | — | — | — | — |
| | nonionic surfactant | K-1 | 10 | 27 | 101 | 10 | 27 | — | 50 | 23 | 75 |
| | | K-4 | 10 | 13 | 49 | 10 | 13 | 50 | — | 40 | 75 |
| | antioxidant | L-1 | 5 | 3 | 1 | 3 | 3 | 1 | 3 | 1 | 5 |
| amount of adhered oil agent [mass %] | | | 1.2 | 1.0 | 0.9 | 1.2 | 0.8 | 1.3 | 1.2 | 1.0 | 0.9 |
| adhered amount of each component [mass %] | isoholondiisocyanate-aliphatic alcohol adduct | F-1 | 0.96 | 0.7 | 0.36 | 0.1 | 0.16 | 0.43 | 0.39 | 0.3 | 0.34 |
| | ester compound G | G-1 | — | — | — | 0.44 | 0.2 | 0.22 | 0.39 | 0.3 | 0.02 |
| | | G-2 | — | — | — | 0.44 | 0.2 | 0.22 | — | — | — |
| | aliphatic ester | J-1 | — | — | — | — | — | — | — | — | — |
| | | J-2 | — | — | — | — | — | — | — | — | — |
| | amino-modified silicone H | H-1 | — | — | — | — | — | — | — | — | — |
| | | H-2 | — | — | — | — | — | — | — | — | — |
| | nonionic surfactant | K-1 | 0.10 | 0.19 | 0.36 | 0.10 | 0.15 | — | 0.39 | 0.14 | 0.26 |
| | | K-4 | 0.10 | 0.09 | 0.18 | 0.10 | 0.07 | 0.43 | — | 0.24 | 0.26 |
| | antioxidant | L-1 | 0.05 | 0.02 | 0.004 | 0.03 | 0.02 | 0.01 | 0.02 | 0.01 | 0.02 |
| evaluation | bundling property | | A | A | A | A | A | A | A | A | A |
| | operating efficiency | | A | A | A | A | A | A | A | A | A |
| | number of fusions | | A | A | A | A | A | A | A | A | A |
| | CF tensile strength [GPa] | | 4.8 | 4.9 | 4.6 | 4.7 | 4.8 | 4.9 | 5.0 | 5.1 | 4.9 |
| | amount of scattered Si [mg/kg] | | 0 | 0 | 0 | 0 | 0 | 0 | 0 | 0 | 0 |

TABLE 17

| | | | comparative example | | | | | | | | | | |
|---|---|---|---|---|---|---|---|---|---|---|---|---|---|
| | | | 7-1 | 7-2 | 7-3 | 7-4 | 7-5 | 7-6 | 7-7 | 7-8 | 7-9 | 7-10 | 7-11 |
| oil agent composition [mass %] | isoholondiisocyanate-aliphatic alcohol adduct | F-1 | — | — | — | — | — | — | — | — | — | 50 | 50 |
| | ester compound G | G-1 | 35.5 | 35.5 | — | — | 50 | — | — | — | — | — | — |
| | | G-2 | 35.5 | 35.5 | — | — | 50 | 43 | — | — | 42 | — | — |
| | aliphatic ester | J-1 | 29 | — | 100 | — | — | — | — | — | 29 | 50 | — |
| | | J-2 | — | 29 | — | 100 | — | — | — | — | 29 | — | 50 |
| | amino-modified silicone H | H-1 | — | — | — | — | — | 57 | — | 100 | — | — | — |
| | | H-2 | — | — | — | — | — | — | 100 | — | — | — | — |
| | nonionic surfactant | K-1 | 27 | 27 | 6 | 6 | 40 | 27 | — | 30 | 28 | 23 | 23 |
| | | K-4 | 13 | 13 | 16 | 16 | 23 | 13 | 23 | 15 | — | 40 | 40 |
| | antioxidant | L-1 | 3 | 3 | 2.5 | 2.5 | 3 | 3 | 2.5 | 8 | 14 | 1 | 1 |
| amount of adhered oil agent [mass %] | | | 0.8 | 0.7 | 0.9 | 1.1 | 0.8 | 1.1 | 1.2 | 1.0 | 1.2 | 1.0 | 0.9 |
| adhered amount of each component [mass %] | isoholondiisocyanate-aliphatic alcohol adduct | F-1 | — | — | — | — | — | — | — | — | — | 0.3 | 0.27 |
| | ester compound G | G-1 | 0.2 | 0.17 | — | — | 0.24 | — | — | — | — | — | — |
| | | G-2 | 0.2 | 0.17 | — | — | 0.24 | 0.33 | — | — | 0.35 | — | — |
| | aliphatic ester | J-1 | 0.16 | — | 0.72 | — | — | — | — | — | 0.25 | 0.3 | — |
| | | J-2 | — | 0.14 | — | 0.88 | — | — | — | — | 0.25 | — | 0.27 |
| | amino-modified silicone H | H-1 | — | — | — | — | — | 0.44 | — | 0.65 | — | — | — |
| | | H-2 | — | — | — | — | — | — | 0.96 | — | — | — | — |
| | nonionic surfactant | K-1 | 0.15 | 0.13 | 0.04 | 0.05 | 0.19 | 0.21 | — | 0.2 | 0.24 | 0.14 | 0.13 |
| | | K-4 | 0.07 | 0.06 | 0.12 | 0.14 | 0.11 | 0.1 | 0.22 | 0.1 | — | 0.24 | 0.22 |
| | antioxidant | L-1 | 0.02 | 0.01 | 0.02 | 0.02 | 0.01 | 0.02 | 0.02 | 0.05 | 0.12 | 0.01 | 0.01 |
| evaluation | bundling property | | B | B | C | C | B | A | A | A | B | B | B |
| | operating efficiency | | B | B | C | C | A | A | A | A | B | A | A |
| | number of fusions | | C | C | C | C | C | A | A | A | C | C | C |
| | CF tensile strength [GPa] | | 3.9 | 4.0 | 3.4 | 3.6 | 4.1 | 5.0 | 5.2 | 5.1 | 3.5 | 4.2 | 4.3 |
| | amount of scattered Si [mg/kg] | | 0 | 0 | 0 | 0 | 0 | 60 | 1280 | 830 | 0 | 0 | 0 |

As clearly shown in Table 16, the amount of adhered oil agent was appropriate in each example. The bundling property of carbon-fiber precursor acrylic fiber bundles and operating efficiency in the production process were excellent. In all the examples, no operational issues were identified that would affect the continuous production of carbon-fiber bundles.

Also, substantially no fusion was found among single fibers in the carbon-fiber bundles produced in each example, the CF tensile strength was high, and mechanical characteristics were excellent. In addition, since no silicone was contained, the amount of Si scattered in the heating process was substantially zero. Thus, the process load in the heating process was low.

The CF tensile strength of the carbon-fiber bundle obtained in each example was higher than that in comparative examples 7-1~7-5, 7-9 each prepared using an oil agent composition that did not contain amino-modified silicone H.

When the composition amounts of compound F (isophoronediisocyanate-aliphatic alcohol adduct) and a nonionic surfactant were changed (examples 7-1~7-3), the CF tensile strength of the carbon-fiber bundle was higher in example 7-2 containing a total of 40 parts by mass of nonionic surfactants (K-1: 27 parts by mass, K-4: 13 parts by mass).

Also, the CF tensile strength was high when 50 parts by mass each of compound F and ester compound G were contained (examples 7-6~7-8). Among those, the CF tensile strength was highest in example 7-8 containing 50 parts by mass of compound F, 50 parts by mass of trimellitate ester (G-1), 23 parts by mass of nonionic surfactant (K-1) and 40 parts by mass of nonionic surfactant (K-4).

On the other hand, when a chain aliphatic ester or ester compound (aromatic ester) G or a chain aliphatic ester was used instead of compound F (isophoronediisocyanate-aliphatic alcohol adduct) (comparative examples 7-1~7-4, 7-9), the amount of adhered oil agent was appropriate, and the amount of Si scattered in the heating process was substantially zero. However, bundling property of carbon-fiber precursor acrylic fiber bundles and the operating efficiency during the production process were low, and more fused fibers were found in the obtained carbon-fiber bundles. Moreover, the CF tensile strength of the carbon-fiber bundles was lower than that in each example.

Especially, when an oil agent composition was prepared not using ester compound (aromatic ester) G but using only a chain aliphatic ester, nonionic surfactant and antioxidant (comparative examples 7-3, 7-4), bundling property, operating efficiency and CF tensile strength were significantly low.

When ester compound (aromatic ester) G was contained but a greater amount of antioxidant was contained (comparative example 7-9), CF tensile strength was notably low.

When only ester compound (aromatic ester) G was used instead of compound F (isophoronediisocyanate-aliphatic alcohol adduct) (comparative example 7-5), operating efficiency was excellent and substantially no Si was scattered in the stabilization process, but bundling property of the carbon-fiber precursor acrylic fiber bundle was low. Also, more fused fibers were found in the subsequent carbon-fiber bundle, and the CF tensile strength was notably lower than that of each example.

When amino-modified silicone H was contained (comparative examples 7-6~7-8), bundling property and operating efficiency were good, and no fused fibers were found in the carbon-fiber bundles. The CF tensile strength was about the same level as that in each example. However, due to the silicone, more Si was observed scattered in the stabilization process, and a greater load was exerted in the heating process, thus making it difficult to perform continuous industrial operations.

When compound F (isophoronediisocyanate-aliphatic alcohol adduct) and a chain aliphatic ester were both used (comparative examples 7-10, 7-11), the CF tensile strength was higher than in comparative examples (7-1~7-5, 7-9) without amino-modified silicone H, but such CF tensile strength was not as good as that of the examples. Also, problems such as lower bundling property and more fused fibers were identified.

POTENTIAL INDUSTRIAL APPLICATIONS

Using an oil agent for carbon-fiber precursor acrylic fiber, an oil agent composition containing the oil agent, and a processed-oil solution with the oil agent composition dispersed in water according to the present invention, fusion among single fibers during the heating process is effectively suppressed. Moreover, lowered operating efficiency that occurs due to an oil agent containing silicone as a main component is suppressed, and carbon-fiber precursor acrylic fiber bundles with excellent bundling property are achieved. Carbon-fiber bundles with excellent mechanical characteristics are produced from such carbon-fiber precursor acrylic fiber bundles at high production yield.

In addition, using the carbon-fiber precursor acrylic fiber bundles according to the present invention, fusion among single fibers during the heating process is effectively suppressed, while lowered operating efficiency that occurs due to an oil agent containing silicone as a main component is suppressed. Furthermore, carbon-fiber bundles with excellent mechanical characteristics are produced at high yield.

Carbon-fiber bundles obtained from carbon-fiber precursor acrylic fiber bundles on which the oil agent of the present invention is adhered may be made into prepreg and formed as composite materials. In addition, composite materials formed using the carbon-fiber bundles are suitable for sports applications such as golf shafts, fishing rods and the like. Moreover, such composite materials are used as structural materials in automobile and aerospace industries, or for storage tanks for various gases.

What is claimed is:

1. A method for manufacturing a carbon-fiber bundle, comprising heat treating a carbon-fiber precursor acrylic fiber bundle under a 200~400° C. oxidizing atmosphere, followed by heat treating under a 1000° C. or higher inert atmosphere, wherein an oil agent is adhered to the carbon-fiber precursor acrylic fiber bundle, and the oil agent comprises compound A which is represented by formula (1a):

(1a)

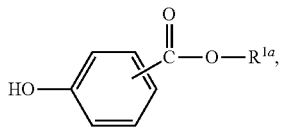

wherein $R^{1a}$ is a hydrocarbon group having 8~20 carbon atoms.

2. The method of claim 1, wherein the oil agent further comprises at least one type of compound selected from the group consisting of B, C, D, E and F:

B: compound B obtained through a reaction of a cyclohexanedicarboxylic acid and a monohydric aliphatic alcohol having 8~22 carbon atoms;

C: compound C obtained through a reaction of a cyclohexanedicarboxylic acid, a monohydric aliphatic alcohol having 8~22 carbon atoms, a polyhydric alcohol having 2~10 carbon atoms and/or a polyoxyalkylene glycol with an oxyalkylene group having 2~4 carbon atoms;

D: compound D obtained through a reaction of a cyclohexanedimethanol and/or cyclohexanediol, and a fatty acid having 8~22 carbon atoms;

E: compound E obtained through a reaction of a cyclohexanedimethanol and/or cyclohexanediol, fatty acid having 8~22 carbon atoms and a dimer acid; and F: compound F obtained through a reaction of 3-isocyanatomethyl-3,5,5-trimethylcyclohexyl=isocyanate and at least one type of compound selected from the group consisting of monohydric aliphatic alcohol having 8~22 carbon atoms and a polyoxyalkylene ether compound of a monohydric aliphatic alcohol having 8~22 carbon atoms.

3. The method of claim 2, wherein the oil agent comprises compound B, and wherein compound B is represented by formula (1b):

(1b)

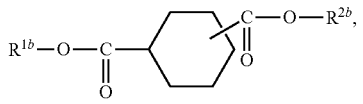

wherein $R^{1b}$ and $R^{2b}$ each independently is a hydrocarbon group having 8~22 carbon atoms.

4. The method of claim 2, wherein the oil agent comprises compound C, and wherein compound C is represented by formula (2b):

(2b)

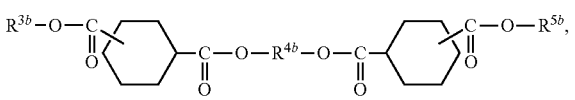

wherein $R^{3b}$ and $R^{5b}$ each independently is a hydrocarbon group having 8~22 carbon atoms, and $R^{4b}$ is a residue obtained by removing two hydroxyl groups from a hydrocarbon group having 2~10 carbon atoms or from a polyoxyalkylene glycol with an oxyalkylene group having 2~4 carbon atoms.

5. The method of claim 2, wherein the oil agent comprises compound D, and wherein compound D is represented by formula (1c):

(1c)

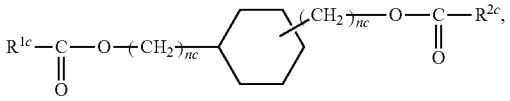

wherein $R^{1c}$ and $R^{2c}$ each independently is a hydrocarbon group having 7~21 carbon atoms, and nc independently represents 0 or 1.

6. The method of claim 2, wherein the oil agent comprises compound E, and wherein compound E is represented by formula (2c):

(2c)

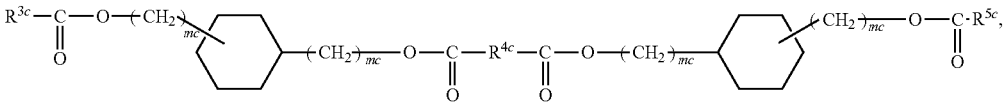

wherein $R^{3c}$ and $R^{5c}$ each independently is a hydrocarbon group having 7~21 carbon atoms, $R^{4c}$ is a hydrocarbon group having 30~38 carbon atoms, and mc independently represents 0 or 1.

7. The method of claim 2, wherein the oil agent comprises compound F, and wherein compound F is represented by formula (1d):

(1d)

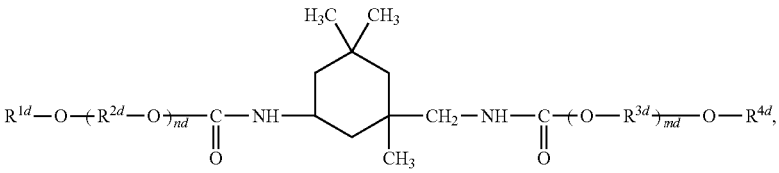

wherein $R^{1d}$ and $R^{4d}$ each independently is a hydrocarbon group having 8~22 carbon atoms, $R^{2d}$ and $R^{3d}$ each independently is a hydrocarbon group having 2~4 carbon atoms, and nd and md each independently mean the average number of added moles in numerals 0~5.

8. The method of claim 1, wherein the oil agent further comprises an ester compound G comprising 1 or 2 aromatic rings.

9. The method of claim 1, wherein the oil agent further comprises an amino-modified silicone H.

10. The method of claim 8, wherein the ester compound G is ester compound G1 represented by formula (1e) and/or ester compound G2 represented by formula (2e):

(1e)

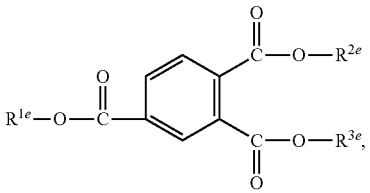

wherein $R^{1c}$~$R^{3e}$ each independently is a hydrocarbon group having 8~16 carbon atoms, and (2e)

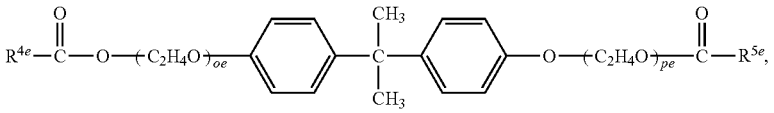

wherein $R^{4e}$ and $R^{5e}$ each independently is a hydrocarbon group having 7~21 carbon atoms, and oe and pe each independently represent 1~5.

11. The method of claim 9, wherein the amino-modified silicone H is an amino-modified silicone represented by formula (3e), and whose kinetic viscosity at 25° C. is 50~500 $mm^2/s$, and whose amino equivalent is 2000~6000 g/mol:

(3e)

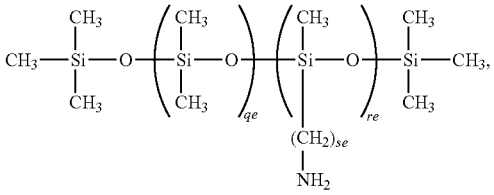

wherein qe and re are any numeral greater than 1, and se is a numeral from 1~5.

12. The method of claim 1, wherein the amount of the oil agent is 0.1~1.5 mass % of dry fiber mass.

13. The method of claim 1, wherein the amount of the oil agent is 0.1~1.5 mass % of dry fiber mass, and an ester compound G having 1 or 2 aromatic rings or an amino-modified silicone H is adhered to the carbon-fiber precursor acrylic fiber bundle at 0.0~1.2 mass % of dry fiber mass.

14. The method of claim 1, wherein a nonionic surfactant is adhered to the carbon-fiber precursor acrylic fiber bundle at 0.05~1.0 mass % of dry fiber mass.

15. The method of claim 1, wherein an antioxidant is adhered to the carbon-fiber precursor acrylic fiber bundle at 0.01~0.1 mass % of dry fiber mass.

16. The method of claim 1, wherein a surfactant is adhered to the carbon-fiber precursor acrylic fiber bundle at 0.05~1.0 mass % of dry fiber mass, and the surfactant is at least one selected from the group consisting of a polyether block copolymer represented by formula (4e) and a polyoxyethylene alkyl ether represented by formula (5e):

(4e)

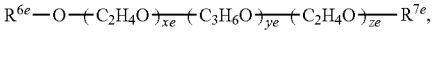

wherein $R^{6e}$ and $R^{7e}$ are each independently a hydrogen atom or a hydrocarbon group having 1~24 carbon atoms, and xe, ye, and ze are each independently from 1~500, (5e)

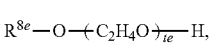

wherein $R^{8e}$ is a hydrocarbon group having 10~20 carbon atoms, and to is from 3~20.

* * * * *